US010384474B2

(12) United States Patent
Hirokawa et al.

(10) Patent No.: US 10,384,474 B2
(45) Date of Patent: Aug. 20, 2019

(54) INKJET RECORDING APPARATUS AND INKJET RECORDING METHOD

(71) Applicant: CANON KABUSHIKI KAISHA, Tokyo (JP)

(72) Inventors: Ryosuke Hirokawa, Kawasaki (JP); Yoichi Takada, Yokohama (JP); Mitsutoshi Noguchi, Kawaguchi (JP); Shingo Okushima, Kawasaki (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/022,740

(22) Filed: Jun. 29, 2018

(65) Prior Publication Data

US 2019/0009577 A1 Jan. 10, 2019

(30) Foreign Application Priority Data

Jul. 4, 2017 (JP) ..... 2017-131278

(51) Int. Cl.

| | |
|---|---|
| ***B41J 11/00*** | (2006.01) |
| ***B41J 2/005*** | (2006.01) |
| ***B41J 2/045*** | (2006.01) |
| ***B41J 2/14*** | (2006.01) |
| ***B41J 2/175*** | (2006.01) |
| ***B41J 2/18*** | (2006.01) |
| ***B41J 2/19*** | (2006.01) |
| ***B41J 29/38*** | (2006.01) |

(52) U.S. Cl.

CPC ..... *B41J 11/002* (2013.01); *B41J 2/0057* (2013.01); *B41J 2/0458* (2013.01); *B41J 2/04528* (2013.01); *B41J 2/04563* (2013.01); *B41J 2/1404* (2013.01); *B41J 2/14024* (2013.01); *B41J 2/175* (2013.01); *B41J 2/18* (2013.01); *B41J 2/19* (2013.01); *B41J 11/0015* (2013.01); *B41J 29/38* (2013.01); *B41J 2202/12* (2013.01); *B41J 2202/20* (2013.01)

(58) Field of Classification Search

CPC .... B41J 11/002; B41J 2/0057; B41J 2/04528; B41J 2/04563; B41J 2/0458; B41J 2/14024; B41J 2/1404

See application file for complete search history.

(56) References Cited

U.S. PATENT DOCUMENTS

| | | | | |
|---|---|---|---|---|
| 5,875,373 | A * | 2/1999 | Sato | G03G 15/2003 219/216 |
| 6,655,772 | B2 | 12/2003 | Danzuka et al. | |
| 7,697,881 | B2 * | 4/2010 | Hayashi | G03G 15/2039 399/399 |
| 9,102,137 | B2 | 8/2015 | Koitabashi et al. | |
| 2008/0006176 | A1 | 1/2008 | Houjou | |

(Continued)

*Primary Examiner* — Lamson D Nguyen

(74) *Attorney, Agent, or Firm* — Venable LLP

(57) ABSTRACT

An inkjet recording apparatus includes an ejection head configured to eject an ink to form an image, a head heater configured to heat the ejection head to a temperature T1 and a control unit configured to control the temperature of the ejection head and the temperature at an image forming position by the ejection head. The control unit controls heating of the ejection head by the head heater and the temperature at the image forming position in such a way that the temperature of the ejection head is higher than the temperature at the image forming position.

17 Claims, 40 Drawing Sheets

(56) References Cited

U.S. PATENT DOCUMENTS

| | | | |
|---|---|---|---|
| 2016/0303847 | A1 | 10/2016 | Soma et al. |
| 2017/0217216 | A1 | 8/2017 | Ohnishi et al. |
| 2017/0341381 | A1 | 11/2017 | Aoki et al. |
| 2018/0154670 | A1* | 6/2018 | Sano ..... B41J 2/01 |
| 2018/0345657 | A1 | 12/2018 | Inoue et al. |
| 2019/0009549 | A1 | 1/2019 | Takada et al. |
| 2019/0009592 | A1 | 1/2019 | Okushima et al. |

* cited by examiner

INKJET RECORDING APPARATUS AND INKJET RECORDING METHOD

BACKGROUND OF THE INVENTION

Field of the Invention

The present invention relates to an inkjet recording apparatus and an inkjet recording method.

Description of the Related Art

Inkjet recording methods include an image forming system in which a liquid composition containing a coloring material (ink) is used to form an image on an intermediate transfer medium and the image is transferred onto a recording medium such as paper. In such a conventional system, a challenge is to achieve high transferability. U.S. Patent Application Publication No. 2008/0006176 discloses a system of heating a transfer medium to a temperature not lower than the minimum film-forming temperature (MFT) of a polymer emulsion in an ink.

Such a system of heating a medium to which an ink is ejected from an ink ejection head to form an image (hereinafter called an ejection target medium) as the system of heating a transfer medium disclosed in U.S. Patent Application Publication No. 2008/0006176 may cause condensation on the ink ejection head. If condensation is caused on a nozzle of an ink ejection head, an ink meniscus near the nozzle may be broken, and the ink may leak onto an ejection target medium.

In order to solve the problem, the present invention is intended to provide an inkjet recording apparatus that has a structure using an ink ejection head to form an image on a heated ejection target medium and suppresses condensation on the ink ejection head and to provide an inkjet recording method.

SUMMARY OF THE INVENTION

An aspect of the present invention provides an inkjet recording apparatus including an ejection head configured to eject an ink to form an image, a transfer medium configured to temporarily hold the image formed by the ejection head, a head heater configured to heat the ejection head to a target temperature T1, a transfer medium heater configured to heat the transfer medium, a transfer unit configured to transfer the image, temporarily held on the transfer medium, onto a recording medium, and a control unit configured to perform such adjustment as to satisfy a relationship of T1>T2, where T1 is the target temperature of the ejection head and T2 is a heated temperature of the transfer medium at an image forming position by the ejection head.

In the inkjet recording apparatus, the ejection head is movable between the image forming position and an escape position displaced from the image forming position, and the control unit is configured to perform such control as to start heating of the ejection head at the escape position and, after heating adjustment of the temperature of the ejection head to the target temperature T1, to move the ejection head to the image forming position.

Another aspect of the present invention provides an inkjet recording apparatus including an ejection head configured to eject an ink to form an image, a transfer medium configured to temporarily hold the image formed by the ejection head, a head heater configured to heat the ejection head to a target temperature T1, a transfer medium heater configured to heat the transfer medium, a transfer unit configured to transfer the image, temporarily held on the transfer medium, onto a recording medium, and a control unit configured to perform such adjustment as to satisfy a relationship of T1>T2, where T1 is the target temperature of the ejection head and T2 is a heated temperature of the transfer medium at an image forming position by the ejection head.

In the inkjet recording apparatus, after heating adjustment of the ejection head to the target temperature T1, the control unit starts heating adjustment of the transfer medium at the image forming position.

Still another aspect of the present invention provides an inkjet recording apparatus including an ejection head configured to eject an ink to form an image, a transfer medium configured to temporarily hold the image formed by the ejection head, a head heater configured to heat the ejection head to a target temperature T1, a transfer medium heater configured to heat the transfer medium, a transfer unit configured to transfer the image, temporarily held on the transfer medium, onto a recording medium, and a control unit configured to perform such adjustment as to satisfy a relationship of T1>T2, where T1 is the target temperature of the ejection head and T2 is a heated temperature of the transfer medium at an image forming position by the ejection head.

In the inkjet recording apparatus, the control unit allows the head heater to heat the ejection head at the image forming position and the transfer medium heater to heat the transfer medium and controls the head heater and the transfer medium heater in such a way that a temperature of the transfer medium is lower than a temperature of the ejection head before the ejection head reaches the target temperature T1.

Still another aspect of the present invention provides an inkjet recording apparatus including an ejection head configured to eject an ink to form an image, a support unit facing the ejection head at an image forming position and configured to support a recording medium on which an image is formed, a head heater configured to heat the ejection head to a target temperature T1, a support unit heater configured to heat the support unit, and a control unit configured to perform such adjustment as to satisfy a relationship of T1>T2, where T1 is the target temperature of the ejection head and T2 is a heated temperature of the recording medium on the support unit at the image forming position by the ejection head.

In the inkjet recording apparatus, the control unit is configured to perform such adjustment that, at startup of the apparatus, a temperature of the ejection head at the image forming position is maintained to be higher than a temperature of the support unit at the image forming position.

Still another aspect of the present invention provides an inkjet recording method using an inkjet recording apparatus that includes an ejection head configured to eject an ink to form an image,
a transfer medium configured to temporarily hold the image formed by the ejection head,
a head heater configured to heat the ejection head,
a transfer medium heater configured to heat the transfer medium, and
a transfer unit configured to transfer the image, temporarily held on the transfer medium, onto a recording medium.

The inkjet recording method includes a head heating step of adjusting the ejection head by heating to a target temperature T1, and a transfer medium heating step of adjusting the transfer medium by heating, at an image forming position by the ejection head, to a heated temperature T2.

In the method, the temperature T1 and the temperature T2 satisfy a relationship of T1>T2.

In the head heating step, the heating of the ejection head is started at an escape position displaced from the image forming position and, after heating adjustment of the ejection head to the target temperature T1, the ejection head moves to the image forming position, and
in the transfer medium heating step, before or after the movement of the ejection head to the image forming position, a temperature of the transfer medium at the image forming position is adjusted by heating to the temperature T2.

Further features of the present invention will become apparent from the following description of exemplary embodiments with reference to the attached drawings.

DESCRIPTION OF THE EMBODIMENTS

Figure 1:
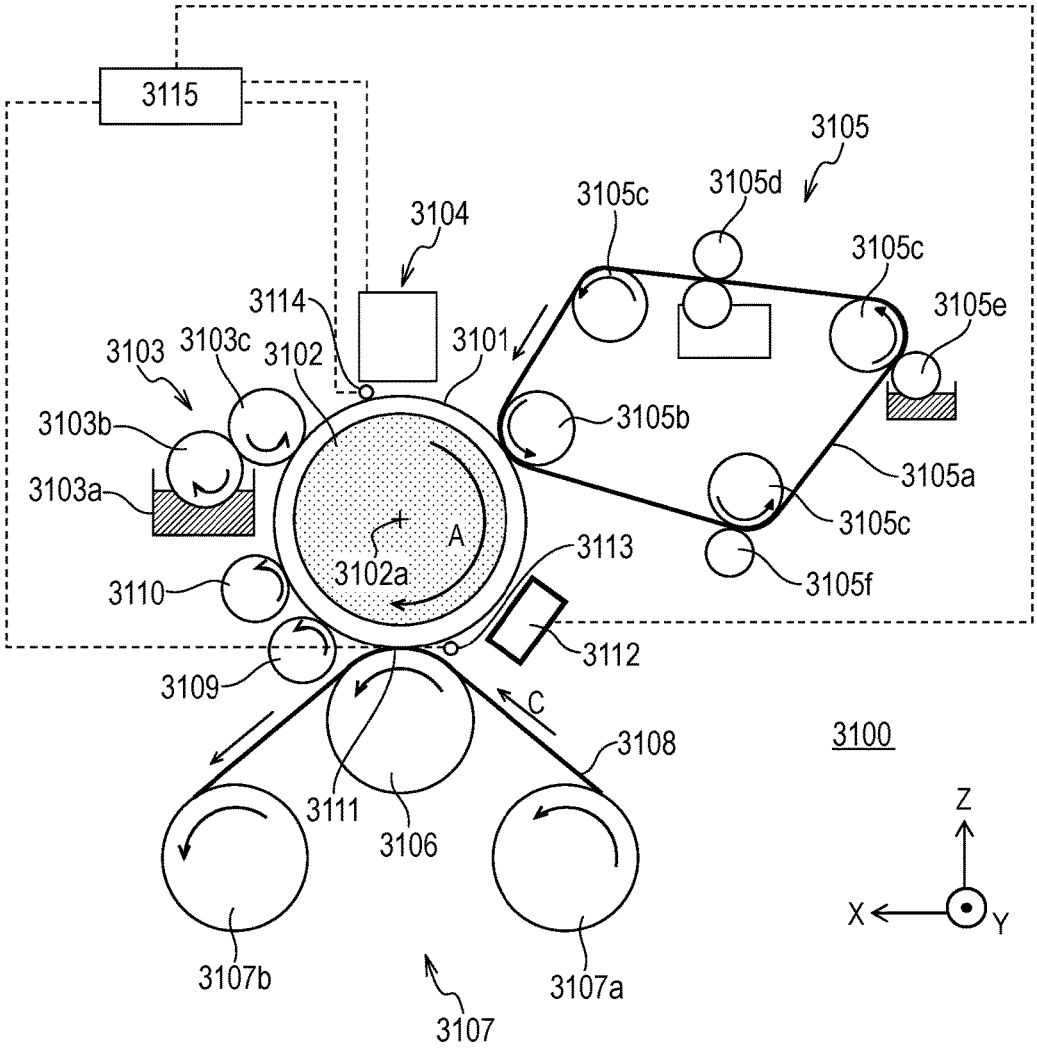
FIG. 1 is a schematic view showing an exemplary structure of a transfer type inkjet recording apparatus in an embodiment of the present invention.

Preferred embodiments of the present invention will now be described in detail in accordance with the accompanying drawings.

In the system of heating an ejection target medium, condensation may be observed on an ink ejection head when the temperature of an ejection target medium (a transfer medium or a recording medium) under ink ejection is higher than the temperature of the ink ejection head. In the present invention, it has been found that the condensation can be prevented when the temperature of the ink ejection head at the time of image formation (called T1) is higher than the temperature of the ejection target medium under ink ejection (called T2). It has been also found that the condensation may be insufficiently prevented depending on temperature increase processes at the time of apparatus startup when heating of a transfer medium or a support member on a recording medium and heating of a head are started. Various studies on both the temperature increase processes demonstrate that it is important to perform such control that the temperature of the ejection head located at an image forming position at the time of apparatus startup is higher than the temperature of the transfer medium or the support member on a recording medium at the image forming position.

In other words, an inkjet recording apparatus pertaining to an embodiment of the present invention includes an ejection head configured to eject an ink to form an image, an ejection target medium on which an image is formed by the ejection head (a transfer medium or a recording medium), a head heater configured to heat the ejection head to a target temperature T1, and a heater configured to heat the ejection target medium. The inkjet recording apparatus is characterized by including a control unit configured to perform such adjustment as to satisfy the relationship of T1>T2 at the time of formation of the image where T1 is the temperature of the ejection head and T2 is the heated temperature of the ejection target medium at a position where an image is formed by the ejection head (image forming position).

An inkjet recording apparatus pertaining to an embodiment of the present invention will now be described with reference to drawings.

The inkjet recording apparatus of the embodiment includes the following two types. One is an inkjet recording apparatus in which an ink is ejected onto a transfer medium as an ejection target medium to form an ink image, then a liquid is absorbed from the ink image by a liquid absorbing member (liquid removing member), and the ink image is transferred to a recording medium. The other is an inkjet recording apparatus in which an ink image is formed on a recording medium such as paper and fabric as an ejection target medium and a liquid is absorbed from the ink image on the recording medium by a liquid absorbing member. In the present invention, the former inkjet recording apparatus is called a transfer type inkjet recording apparatus, and the latter inkjet recording apparatus is called a direct drawing type inkjet recording apparatus, for convenience hereinafter. The transfer medium in the transfer type inkjet recording apparatus is also called a medium for temporarily holding an ink image.

First, the transfer type inkjet recording apparatus will be described.

(Transfer Type Inkjet Recording Apparatus)

FIG. 1 is a schematic view showing an exemplary schematic structure of a transfer type inkjet recording apparatus 3100 in the present embodiment. The recording apparatus is a single wafer type inkjet recording apparatus in which an ink image is transferred from a transfer medium 3101 to a recording medium 3108 to produce a recorded product. In the present embodiment, X-direction, Y-direction and Z-direction represent the width direction (entire length direction), the depth direction and the height direction, respectively, of the inkjet recording apparatus 3100. The recording medium 3108 is conveyed in the X-direction.

The transfer type inkjet recording apparatus 3100 of the present invention, as shown in FIG. 1, includes a transfer medium 3101 supported on a support member 3102, a reaction liquid applying device 3103 for applying, onto the transfer medium 3101, a reaction liquid that is reacted with color inks, an ink applying device (hereinafter also simply called "recording device") 3104 including ejection heads for applying, onto the transfer medium 3101 with the reaction liquid, color inks to form an ink image as an image of the inks on the transfer medium, a liquid removing device 3105 for removing a liquid component from the ink image on the transfer medium, and a pressing member for transfer 3106 for transferring the ink image from which the liquid component is removed on the transfer medium to a recording medium 3108 such as paper. An ejection surface of the ejection head faces the surface of the transfer medium 2 while a small clearance (for example, several millimeters) is interposed therebetween. The transfer type inkjet recording apparatus 3100 may include a transfer medium cleaning member 3109 for cleaning the surface of the transfer medium 3101 after transfer, as needed. The transfer medium 3101, the reaction liquid applying device 3103, the inkjet heads of the recording device 3104, the liquid removing device 3105 and the transfer medium cleaning member 3109 naturally have sufficient lengths in the Y-direction for the width of a recording medium 3108 to be used. The transfer type inkjet recording apparatus 3100 may include a transfer medium cooling member 3110 for cooling the transfer medium 3101 after transfer, as needed.

The transfer medium 3101 rotates around a rotating shaft 3102*a* of the support member 3102 as the center in the arrow direction A in FIG. 1. As the support member 3102 rotates, the transfer medium 3101 moves. Onto the moving transfer medium 3101, the reaction liquid applying device 3103 applies a reaction liquid, and the recording device 3104 applies inks sequentially, forming an ink image on the transfer medium 3101. As the transfer medium 3101 moves, the ink image formed on the transfer medium 3101 moves to a position at which a liquid absorbing member 3105*a* included in the liquid removing device 3105 comes into contact with the ink image on the transfer medium 3101.

The movement of the liquid removing device 3105 synchronizes with the rotation of the transfer medium 3101. The ink image formed on the transfer medium 3101 undergoes the state of contact with the moving liquid absorbing member 3105*a*. During the contact state, the liquid absorbing member 3105*a* removes the liquid component from the ink image on the transfer medium. In the contact state, the liquid absorbing member 3105*a* is particularly preferably pressed against the transfer medium 3101 at a certain pressing force for helping the liquid absorbing member 3105*a* to function effectively.

The removal of the liquid component can be expressed from a different point of view as concentrating the ink constituting the image formed on the transfer medium. Concentrating the ink means that the proportion of the solid component contained in the ink, such as a coloring material and a polymer, increases relative to the liquid component contained in the ink owing to reduction in the liquid component.

The ink image after liquid component removal has a higher ink concentration than the ink image before liquid removal and is moved by the transfer medium 3101 to a transfer section 3111 at which the ink image comes into contact with a recording medium 3108 conveyed by recording medium conveying devices 3107. When a pressing member 3106 presses against the transfer medium 3101 while the ink image after liquid removal is in contact with the recording medium 3108, the ink image is transferred onto the recording medium 3108. The ink image transferred onto the recording medium 3108 is a reverse image of the ink image after liquid removal.

In the present embodiment, the reaction liquid is applied onto the transfer medium, and then inks are applied to form an image. Hence, in a non-imaging area where no image is formed by inks, the reaction liquid is not reacted with inks but is left. In the apparatus, the liquid absorbing member 3105*a* comes into contact with not only an image but also an unreacted reaction liquid and removes the liquid component in the reaction liquid together.

Although the above description expresses that the liquid component is removed from the image, the expression is not limited to removal of the liquid component only from the image but means that the liquid component is removed at least from the image on the transfer medium.

The liquid component may be any liquid component that does not have a certain shape but has flowability and a substantially constant volume.

The liquid component is exemplified by water and an organic solvent contained in an ink or a reaction liquid.

Members constituting the transfer type inkjet recording apparatus in the embodiment will next be described.

<Transfer Medium>

The transfer medium 3101 includes a surface layer having an image formation surface. As the material of the surface layer, various materials such as polymers and ceramics can be appropriately used, and a material having a high compressive elastic modulus is preferred from the viewpoint of durability and the like. Specific examples include acrylic polymers, acrylic silicone polymers, fluorine-containing polymers and condensates prepared by condensation of a hydrolyzable organic silicon compound. In order to improve the wettability of a reaction liquid, transferability and the like, a surface treatment may be performed. Examples of the surface treatment include flame treatment, corona treatment, plasma treatment, polishing treatment, roughening treatment, active energy ray-irradiation treatment, ozone treatment, surfactant treatment and silane coupling treatment. These treatments may be performed in combination. The surface layer may have any surface shape.

The transfer medium preferably includes a compressible layer having such a function as to absorb pressure fluctuations. A provided compressible layer absorbs deformation to disperse local pressure fluctuations, and satisfactory transferability can be maintained even during high speed printing. Examples of the member for the compressible layer include acrylonitrile-butadiene rubber, acrylic rubber, chloroprene rubber, urethane rubber and silicone rubber. It is preferred that at the time of molding of such a rubber material, predetermined amounts of a vulcanizing agent, a vulcanization accelerator and the like be added, and a foaming agent, hollow microparticles or a filler such as sodium chloride be further added as needed to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer medium preferably further includes an elastic layer between the surface layer and the compressible layer. As the member for the elastic layer, various materials such as polymers and ceramics can be appropriately used. From the viewpoint of processing characteristics and the like, various elastomer materials and rubber materials are preferably used. Specific examples include silicone rubber, fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers and nitrile-butadiene rubber. Specifically, silicone rubber, fluorosilicone rubber and phenylsilicone rubber, which have a small compress set, are preferred from the viewpoint of dimensional stability and durability. These materials have a small temperature change in elastic modulus, and thus are preferred from the viewpoint of transferability.

Between the layers included in the transfer medium (the surface layer, the elastic layer, the compressible layer), various adhesives or double-sided adhesive tapes may be interposed in order to fix/hold the layers. The transfer medium may also include a reinforcing layer having a high compressive elastic modulus in order to suppress lateral elongation when installed in an apparatus or to maintain resilience. A woven fabric may be used as the reinforcing layer. The transfer medium can be prepared by combination of any layers made from the above materials.

The size of the transfer medium can be freely selected depending on the size of an intended print image. The shape of the transfer medium may be any shape and is specifically exemplified by a sheet shape, a roller shape, a belt shape and an endless web shape.

<Support Member>

The transfer medium 3101 is supported on a support member 3102. As the supporting manner of the transfer medium, various adhesives or double-sided adhesive tapes may be used. Alternatively, a transfer medium attached with an installing member made from a metal, ceramics, a polymer or the like may be supported on the support member 3102 by using the installing member.

The support member 3102 is required to have a certain structural strength from the viewpoint of conveyance accuracy and durability. As the material for the support member, metals, ceramics, polymers and the like are preferably used. Specifically, aluminum, iron, stainless steel, acetal polymers, epoxy polymers, polyimide, polyethylene, polyethylene terephthalate, nylon, polyurethane, silica ceramics, and alumina ceramics are particularly preferably used in terms of the rigidity capable of withstanding the pressure at the time of transfer, dimensional accuracy and reduction of the inertia during operation to improve the control responsivity. Combination use of these materials is also preferred.

<Transfer Medium Heating Device>

A transfer medium heating device (transfer medium heater) 3112 is a device for heating an ink image on the transfer medium before transfer. By heating an ink image, a polymer in the ink image is melted to improve the transferability to a recording medium. The heating temperature can be not lower than the minimum film-forming temperature (MFT) of a polymer. The MFT can be determined with an apparatus in accordance with a conventionally known technique including JIS K 6828-2: 2003 and ISO2115: 1996. From the viewpoint of transferability and image toughness, an ink image may be heated at a temperature higher than MFT by 10° C. or more or may be heated at a temperature higher than MFT by 20° C. or more. The transfer medium heating device 3112 may be a known heating device such as various lamps including an infrared lamp and a warm air fan. In terms of heating efficiency, an infrared heater can be used.

The temperature detecting device for the transfer medium 3101 may be any device, and a noncontact detecting device using, for example, luminance, color or infrared intensity or a contact detecting device using, for example, thermoelectromotive force, electric resistance or magnetism can be used. A noncontact detecting device is preferred from the viewpoint of deterioration in durability of the transfer medium 3101.

The location of the temperature detecting device for the transfer medium is not limited to particular sites, and the temperature can be detected in the transfer medium or from the outside. FIG. 1 shows a temperature detecting device before transfer 3113 for detecting the temperature before transfer and a temperature detecting device 3114 for detecting the temperature under the ejection head. The transfer medium temperature T2 at the image forming position in the embodiment is detected by the temperature detecting device 3114, for example.

<Temperature Control Section>

3115 is a control unit for controlling the operations of the ink applying device 3104 and the transfer medium heating device 3112 (heating adjustment, movement, for example) in response to temperature information from the temperature detecting devices 3113, 3114 and a device for detecting the temperature of an ejection head in the ink applying device 3104 (not shown). The control unit 3115 can further control the operations of the reaction liquid applying device, the liquid removing device, the pressing member for transfer, the recording medium conveying device, the transfer medium cleaning member, the transfer medium cooling member and the like.

<Reaction Liquid Applying Device>

The inkjet recording apparatus of the embodiment includes a reaction liquid applying device 3103 for applying a reaction liquid onto the transfer medium 3101. The reaction liquid applying device 3103 in FIG. 1 shows the case of a gravure offset roller including a reaction liquid container 3103*a* for storing a reaction liquid and reaction liquid applying members 3103*b*, 3103*c* for applying the reaction liquid in the reaction liquid container 3103*a* onto the transfer medium 3101.

The reaction liquid applying device 3103 may be any device capable of applying a reaction liquid onto a transfer medium 3101, and conventionally known various devices can be appropriately used. Specific examples include a gravure offset roller, an inkjet head, a die coater and a blade coater. The application of a reaction liquid by the reaction liquid applying device may be performed before the ink application or after the ink application as long as the reaction liquid can be mixed (reacted) with an ink on the transfer medium. Preferably, the reaction liquid is applied before the ink application. The application of a reaction liquid before the ink application enables suppression of bleeding, which is caused by mixing of inks applied adjacent to each other, or beading, which is caused by pulling of a previously applied ink by a subsequently applied ink, at the time of image recording by the inkjet system.

<Reaction Liquid>

The reaction liquid causes aggregation of a component having an anionic group (a polymer, a self-dispersible pigment, for example) in an ink when coming into contact with the ink, and contains a reactant. Examples of the reactant include cationic components such as a polyvalent metal ion and a cationic polymer and organic acids.

Examples of the polyvalent metal ion include divalent metal ions such as $Ca^{2+}$, $Cu^{2+}$, $Mg^{2+}$, $Sr^{2+}$, $Ba^{2+}$ and $Zn^{2+}$; and trivalent metal ions such as $Fe^{3+}$, $Cr^{3+}$, $Y^{3+}$ and $Al^{3+}$. To allow the reaction liquid to contain a polyvalent metal ion, a polyvalent metal salt (optionally a hydrate) formed by bonding a polyvalent metal ion with an anion can be used. Examples of the anion include inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, $HPO_4^{2-}$ and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. When a polyvalent metal ion is used as the reactant, the content (% by mass) in terms of polyvalent metal salt in the reaction liquid is preferably 1.00% by mass or more to 10.00% by mass or less relative to the total mass of the reaction liquid.

The reaction liquid containing an organic acid has a buffer capacity in an acidic region (a pH of lower than 7.0, preferably a pH of 2.0 to 5.0), thus makes an anionic group of a component present in an ink into an acid form, and causes the component to aggregate. Examples of the organic acid include monocarboxylic acids, such as formic acid, acetic acid, propionic acid, butyric acid, benzoic acid, glycolic acid, lactic acid, salicylic acid, pyrrole carboxylic acid, furan carboxylic acid, picolinic acid, nicotinic acid, thiophene carboxylic acid, levulinic acid and coumaric acid, and salts thereof; dicarboxylic acids, such as oxalic acid, malonic acid, succinic acid, glutaric acid, adipic acid, maleic acid, fumaric acid, itaconic acid, sebacic acid, phthalic acid, malic acid and tartaric acid, and salts and hydrogen salts thereof; tricarboxylic acids, such as citric acid and trimellitic acid, and salts and hydrogen salts thereof, and tetracarboxylic acids such as pyromellitic acid and salts and hydrogen salts thereof.

Examples of the cationic polymer include a polymer having a primary to tertiary amine structure and a polymer having a quaternary ammonium salt structure. Specific examples include polymers having a structure such as vinylamine, allylamine, vinylimidazole, vinylpyridine, dimethylaminoethyl methacrylate, ethyleneimine and guanidine. In order to improve the solubility in the reaction liquid, a cationic polymer may be used in combination with an acidic compound, or a cationic polymer may be subjected to quaternarization treatment. When a cationic polymer is used as the reactant, the content (% by mass) of the cationic polymer in the reaction liquid is preferably 1.00% by mass or more to 10.00% by mass or less relative to the total mass of the reaction liquid.

As components other than the reactant in the reaction liquid, those substantially the same as the water, the water-soluble organic solvents and the additional additives exemplified later as usable in the ink can be used.

<Transfer Medium Cleaning Device>

The inkjet recording apparatus of the embodiment includes a transfer medium cleaning device (transfer medium cleaning member) 3109 for cleaning the transfer medium 3101. The transfer medium cleaning device 3109 in FIG. 1 may be any device that cleans the transfer medium, and conventionally known various devices can be used appropriately. Specific examples include a rubber roller, an SUS roller and a blade.

<Transfer Medium Cooling Device>

The inkjet recording apparatus of the embodiment includes a transfer medium cooling device (transfer medium cooling member) 3110 for cooling the transfer medium 3101. The transfer medium cooling device 3110 in FIG. 1 may be any device that cools the transfer medium, and conventionally known various devices can be used appropriately. Specific examples include a system of bringing a rubber roller or an SUS roller cooled by a chiller into contact and a method using an air knife. The transfer medium cooling device is preferably, appropriately used so that the temperature T2 of the transfer medium at the image forming position will be lower than the temperature T1 of the ejection head.

<Ink Applying Device>

The inkjet recording apparatus of the embodiment includes an ink applying device 3104 for applying an ink to the transfer medium 3101. On the transfer medium, a reaction liquid and an ink are mixed, and the reaction liquid and the ink form an ink image. The liquid removing device 3105 then absorbs a liquid component from the ink image.

In the present embodiment, the ink applying device 3104 includes a full-line circulation head (hereinafter also called an ejection head) extending in the Y-direction. On the ejection head, nozzles are arranged in a region covering the width of an image recording area on a usable recording medium with the maximum size. The ejection head has, on the bottom face (the transfer medium 3101 side), an ink ejection surface having nozzle openings, and the ink ejection surface faces the surface of the transfer medium 3101 while a small clearance (about several millimeters) is interposed therebetween.

Figure 10:
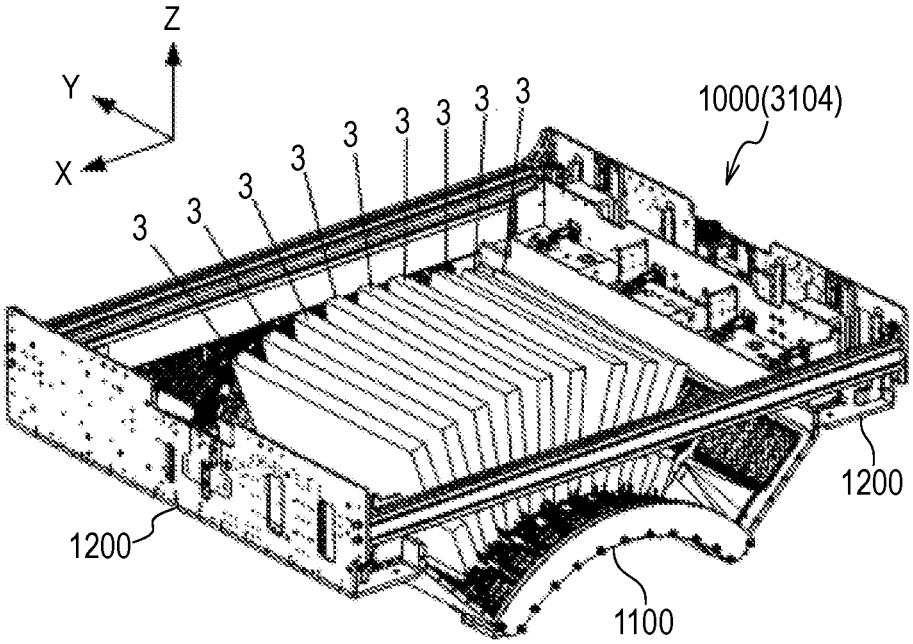
FIG. 10 is a perspective view showing an exemplary ink applying device of a transfer type inkjet recording apparatus in an embodiment of the present invention.

FIG. 10 is a perspective view of an exemplary recording device 1000 as the ink applying device 3104 in the embodiment. Recording heads 3 eject liquid inks onto the transfer medium 3101 to form an ink image as a recorded image on the transfer medium 3101.

In the case of the present embodiment, each recording head 3 is a full-line head extending in the Y-direction, and nozzles are arranged in a region covering the width of an image recording area on a usable recording medium with the maximum size. The recording head 3 has, on the bottom face, an ink ejection surface having nozzle openings, and the ink ejection surface faces the surface of the transfer medium 3101 while a small clearance (for example, several millimeters) is interposed therebetween. In the case of the embodiment, the transfer medium 3101 has such a structure as to cyclically move on a circular orbit, and thus a plurality of recording heads 3 are radially arranged.

Each nozzle has an ejection element. The ejection element is, for example, an element that generates a pressure in a nozzle to eject an ink in the nozzle, and an inkjet head technique for a known inkjet printer is applicable. Examples of the ejection element include an element that causes film boiling of an ink by an electrothermal transducer to form bubbles and ejects the ink, an element that ejects an ink by an electromechanical converter and an element that ejects an ink by using static electricity. From the viewpoint of high-density recording at high speed, an ejection element using an electrothermal transducer can be used.

In the case of the present embodiment, nine recording heads 3 are provided. The recording heads 3 eject different types of inks from each other. The different types of inks are, for example, inks different in coloring material, and are inks including a yellow ink, a magenta ink, a cyan ink and a black ink. A single recording head 3 ejects a single type of an ink, but a single recording head 3 may eject a plurality of types of inks. When a plurality of recording heads 3 are provided as above, some of the recording heads may eject an ink containing no coloring material (for example, a clear ink).

Figure 11:
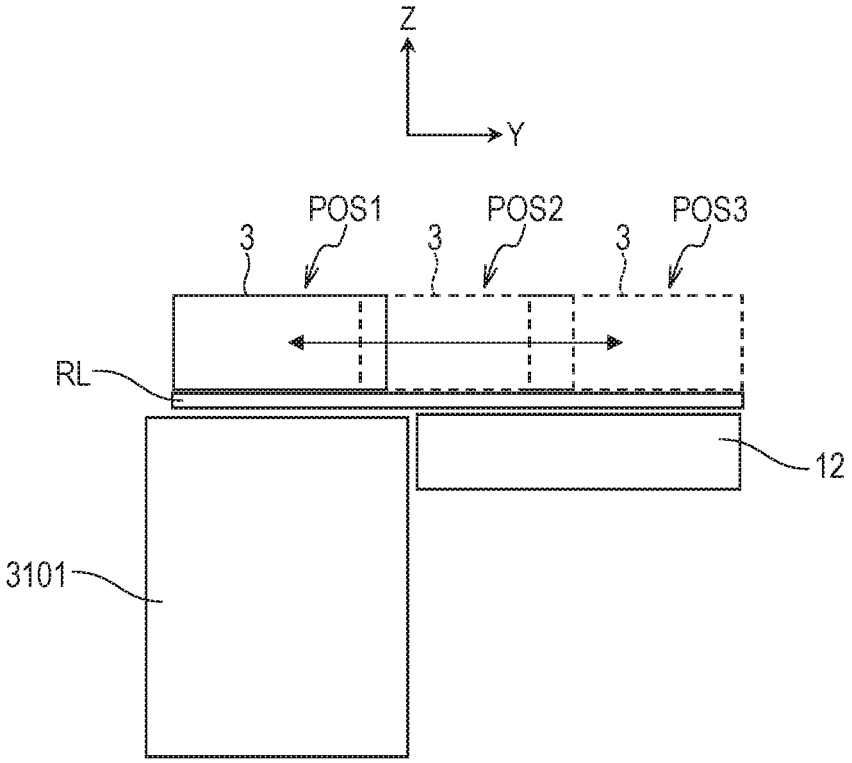
FIG. 11 is a schematic view describing the movement of a head of the ink applying device shown in FIG. 10.

A carriage 1100 supports the plurality of recording heads 3. The end of each recording head 3 at the ink ejection surface side is fixed to the carriage 1100. With this structure, the clearance between the ink ejection surface and the surface of the transfer medium 3101 can be more precisely maintained. As shown in FIG. 11, the carriage 1100 is so constructed as to be displaceable while supporting the recording heads 3, by guidance of guide members RL. In the case of the embodiment, the guide members RL are rail members extending in the Y-direction, and a pair of rail members are provided apart from each other in the X-direction. On the respective sides of the carriage 1100 in the X-direction, slide sections 1200 are provided. The slide sections 1200 engage with the guide members RL and slide along the guide members RL in the Y-direction.

FIG. 11 is a view showing a displacing manner of the recording heads 3 in the recording device 1000 and schematically showing the right lateral of the recording system of the present invention. Behind the recording system, a recovery unit 12 is provided. The recovery unit 12 has a mechanism for recovering the ejection performance of the recording heads 3. Examples of such a mechanism include a cap mechanism of capping the ink ejection surface of a recording head 3, a wiper mechanism of wiping the ink ejection surface and a suction mechanism of sucking the ink in a recording head 3 from the ink ejection surface under negative pressure.

The guide members RL extends over the transfer medium 3101 and the recovery unit 12. The recording heads 3 are displaceable by the guidance of the guide members RL between an ejection position POS1 of the recording heads 3 indicated by solid lines and a recovery position POS3 of the recording heads 3 indicated by broken lines and are moved by a driving mechanism not shown in the drawings.

The ejection position POS1 is an image forming position at which recording heads 3 eject inks to the transfer medium 3101 and is a position at which the ink ejection surfaces of the recording heads 3 face the surface of the transfer medium 3101. The recovery position POS3 is an escape position displaced from the ejection position POS1 and is a position at which the recording heads 3 are located above the recovery unit 12. The recovery unit 12 can perform recovery treatment of the recording heads 3 when the recording heads 3 are located at the recovery position POS3. In the case of the embodiment, the recovery treatment can also be performed while the recording heads 3 are still moving toward the recovery position POS3. A preliminary recovery position POS2 is between the ejection position POS1 and the recovery position POS3, and the recovery unit 12 can perform preliminary recovery treatment of the recording heads 3 at the preliminary recovery position POS2 while the recording heads 3 are moving from the ejection position POS1 toward the recovery position POS3.

The recording device 1000 in the embodiment includes a heater for the ejection heads in order to prevent condensation, and thus heat may increase the viscosity of an ink. However, by using such a head capable of circulating an ink as shown below, the viscosity increase of an ink can be suppressed. The structure of a full-line circulation head will be described.

<Full-Line Circulation Head>

Figure 12:
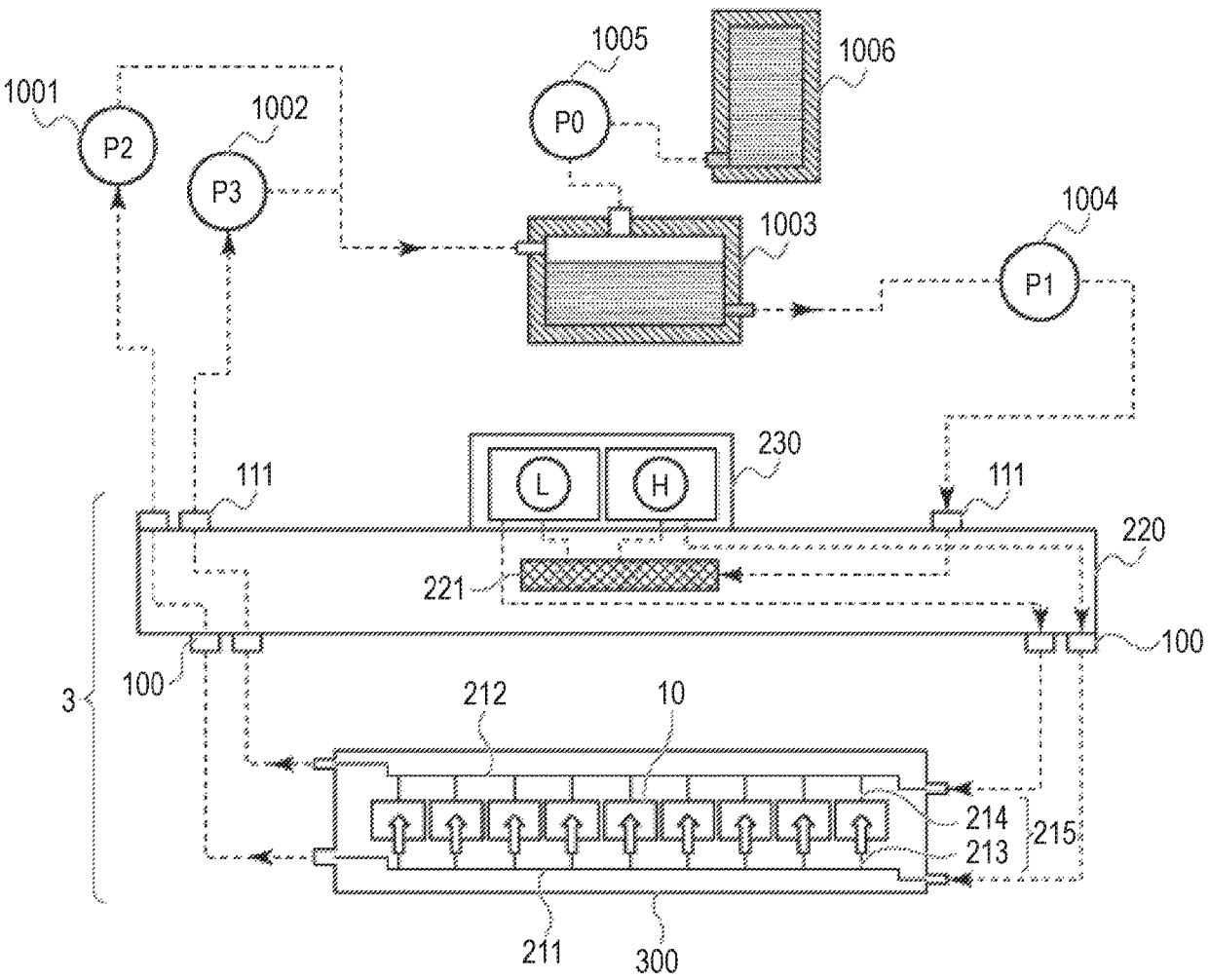
FIG. 12 is a schematic view showing a first circulation mode of a circulation route applied to an ink applying device 1000 of an inkjet recording apparatus pertaining to an embodiment of the present invention.

FIG. 12 is a schematic view showing a first circulation mode of a circulation route applied to the recording device 1000 in the embodiment. A liquid ejection head 3 is fluidly connected to a first circulation pump (for high pressure) 1001, a first circulation pump (for low pressure) 1002, a buffer tank 1003 and the like. FIG. 12 shows only a route through which one color ink of cyan C, magenta M, yellow Y and black K inks flows, for simple explanation, but in an actual device, circulation routes for four color inks are provided in the liquid ejection head 3 and the recording apparatus main unit.

In the first circulation mode, an ink in a main tank 1006 is supplied by a replenishing pump 1005 to the buffer tank 1003 and then is supplied by a second circulation pump 1004 through a liquid connection section 111 to a liquid supply unit 220 of the liquid ejection head 3. Next, the ink is adjusted by a negative pressure control unit 230 connected to the liquid supply unit 220 to have two different negative pressures (high pressure, low pressure), and the divided inks circulate through two flow paths for high pressure and low pressure. The inks in the liquid ejection head 3 circulate in the liquid ejection head by the action of the first circulation pump (for high pressure) 1001 and the first circulation pump (for low pressure) 1002 located downstream of the liquid ejection head 3, then are discharged through liquid connection sections 111 from the liquid ejection head 3, and return to the buffer tank 1003.

The buffer tank 1003 as a sub tank is connected to the main tank 1006, has an air communication hole (not shown) for communication between the inside and the outside of the tank and can discharge bubbles in the ink to the outside. Between the buffer tank 1003 and the main tank 1006, the replenishing pump 1005 is provided. The replenishing pump 1005 sends an ink consumed by ink ejection (discharge) from ejection ports of the liquid ejection head 3, for example, by recording with ink ejection or suction recovery, from the main tank 1006 to the buffer tank 1003.

The two first circulation pumps 1001, 1002 draw a liquid from the liquid connection sections 111 of the liquid ejection head 3 and send the liquid to the buffer tank 1003. The first circulation pump is preferably a displacement pump capable of quantitatively sending a liquid. Specific examples include a tube pump, a gear pump, a diaphragm pump and a syringe pump. The first circulation pump may be a pump having a typical constant flow valve or a relief valve at the pump outlet to achieve a constant flow rate, for example. To drive the liquid ejection head 3, the first circulation pump (for high pressure) 1001 and the first circulation pump (for low pressure) 1002 are activated, and an ink flows at a predetermined flow rate through the common supply flow path 211 and the common collection flow path 212. By allowing an ink to flow in this manner, the temperature of the liquid ejection head 3 at the time of recording is maintained at an optimum temperature. The predetermined flow rate at the time of driving of the liquid ejection head 3 is preferably set to a certain flow rate or more that can maintain such differences in temperature among recording element substrates 10 in the liquid ejection head 3 as not to affect recorded image qualities. If an excessively high flow rate is set, pressure drop in flow paths in the liquid ejection unit 300 increases negative pressure differences among the recording element substrates 10, causing density unevenness on an image. Hence, the flow rate is preferably set in consideration of temperature differences and negative pressure differences among the recording element substrates 10.

The negative pressure control unit 230 is provided on a route between the second circulation pump 1004 and the liquid ejection unit 300. The negative pressure control unit 230 functions to maintain the pressure at the downstream side from the negative pressure control unit 230 (i.e., the liquid ejection unit 300 side) at a preset constant pressure even when the flow rate of an ink in a circulation system fluctuates due to differences in ejection amount per unit area, for example. Two pressure adjustment mechanisms for high pressure (H) and low pressure (L) included in the negative pressure control unit 230 may be any mechanism capable of controlling the pressure at the downstream side from the negative pressure control unit 230 within a certain fluctuation range of an intended set pressure as the center. As an example, a mechanism similar to what is called a "pressure-reducing regulator" can be adopted. In the circulation flow path in the embodiment, the second circulation pump 1004 is used to press the upstream side of the negative pressure control unit 230 through the liquid supply unit 220. With such a structure, the effect of the hydraulic head pressure of the buffer tank 1003 on the liquid ejection head 3 can be suppressed, and thus the layout of the buffer tank 1003 in the recording device 1000 can be more freely designed.

The second circulation pump 1004 may be any pump that has a pump head pressure not lower than a certain value, within the range of an ink circulation flow rate when the liquid ejection head 3 is driven, and a turbo pump or a displacement pump can be used, for example. Specifically, a diaphragm pump is applicable, for example. In place of the second circulation pump 1004, a hydraulic head tank located to give a certain hydraulic head difference with respect to the negative pressure control unit 230 is also applicable, for example.

As shown in FIG. 12, the negative pressure control unit 230 includes two pressure adjustment mechanisms H, L that are set at different control pressures from each other. Of the two negative pressure adjustment mechanisms, the mechanism for setting a relatively high pressure (indicated by H in FIG. 12) and the mechanism for setting a relatively low pressure (indicated by L in FIG. 12) are connected through the liquid supply unit 220 to a common supply route 211 and a common collection flow path 212, respectively, in the liquid ejection unit 300. The liquid ejection unit 300 includes the common supply route 211, the common collection flow path 212, and individual flow paths 215 (individual supply flow paths 213, individual collection flow paths 214) communicating with corresponding recording element substrates. The pressure adjustment mechanism H and the pressure adjustment mechanism L are connected to the common supply flow path 211 and the common collection flow path 212, respectively, and this causes a differential pressure between the two common flow paths. The individual flow paths 215 communicate with the common supply route 211 and the common collection flow path 212, and this generates a flow of some liquid flowing from the common supply flow path 211 through inside flow paths in the recording element substrates 10 to the common collection flow path 212 (arrows in FIGS. 30A to 30C). The two negative pressure adjustment mechanisms H, L are connected through a filter 221 to the route from the liquid connection section 111.

As described above, in the liquid ejection unit 300, such a flow that while a liquid flows in the common supply flow path 211 and the common collection flow path 212, some of the liquid passes through each recording element substrate 10 is generated. Hence, heat generated in each recording element substrate 10 can be exhausted to the outside of the recording element substrate 10 by an ink flowing in the common supply flow path 211 and the common collection flow path 212. With such a structure, when recording is performed with the liquid ejection head 3, an ink flow can be generated also in an ejection port or a pressure chamber not ejecting an ink. This reduces the viscosity of an ink causing viscosity increase in an ejection port, and thus the increase in viscosity of an ink can be suppressed. In addition, an ink causing viscosity increase or foreign substances in an ink can be discharged to the common collection flow path 212. Hence, the liquid ejection head 3 of the embodiment enables high quality image recording at high speed.

<Description of Second Circulation Mode>

Figure 13:
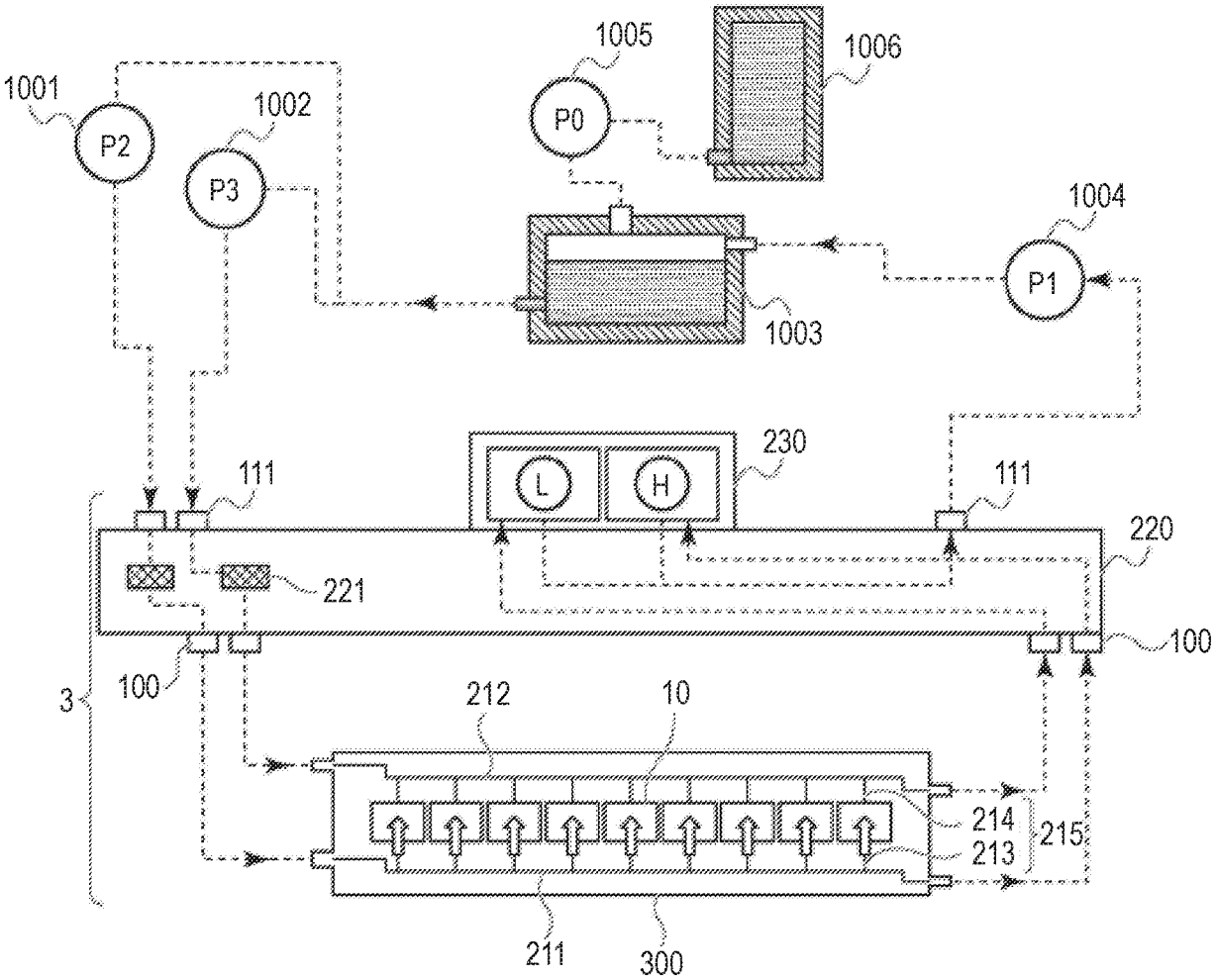
FIG. 13 is a schematic view showing a second circulation mode of a circulation route applied to an ink applying device 1000 of an inkjet recording apparatus pertaining to an embodiment of the present invention.

FIG. 13 is a schematic view showing a second circulation mode of the circulation routes applicable to the recording device of the embodiment, and the second circulation mode differs from the above first circulation mode. The main difference from the first circulation mode is that two pressure adjustment mechanisms included in a negative pressure control unit 230 control the pressure at the upstream from the negative pressure control unit 230 within a certain fluctuation range of an intended set pressure as the center. Another difference from the first circulation mode is that a second circulation pump 1004 functions as a negative pressure source to reduce the pressure at the downstream side of the negative pressure control unit 230. As additional different points, a first circulation pump (for high pressure) 1001 and a first circulation pump (for low pressure) 1002 are provided at the upstream side of a liquid ejection head 3, and the negative pressure control unit 230 is provided at the downstream side of the liquid ejection head 3.

In the second circulation mode, as shown in FIG. 13, an ink in a main tank 1006 is supplied by a replenishing pump 1005 to a buffer tank 1003. Next, the ink is divided into two flow paths, and the divided inks circulate by the action of the negative pressure control unit 230 provided on the liquid ejection head 3, through two flow paths for high pressure and low pressure. The inks divided into two flow paths for high pressure and low pressure are supplied by the action of the first circulation pump (for high pressure) 1001 and the first circulation pump (for low pressure) 1002 through liquid connection sections 111 of the liquid ejection head 3 to the liquid ejection head 3. Next, the inks after circulation in the liquid ejection unit 300 by the action of the first circulation pump (for high pressure) 1001 and the first circulation pump (for low pressure) 1002 flow in the negative pressure control unit 230 and are discharged through a liquid connection section 111 from the liquid ejection head 3. The discharged ink is returned by a second circulation pump 1004 to a buffer tank 1003.

The negative pressure control unit 230 in the second circulation mode functions to stabilize pressure fluctuations at the upstream side of the negative pressure control unit 230 (i.e., the liquid ejection unit 300 side) within a certain range of a preset pressure as the center even when the flow rate fluctuates due to differences in ejection amount per unit area. In the circulation flow path in the embodiment, the second circulation pump 1004 is used to reduce the pressure at the downstream side of the negative pressure control unit 230 through a liquid supply unit 220. With such a structure, the effect of the hydraulic head pressure of the buffer tank 1003 on the liquid ejection head 3 can be suppressed, and thus the layout of the buffer tank 1003 in the recording device 1000 can be more freely selected. In place of the second circulation pump 1004, a hydraulic head tank located to give a certain hydraulic head difference with respect to the negative pressure control unit 230 is also applicable, for example. In the second circulation mode, the negative pressure control unit 230 includes two pressure adjustment mechanisms H, L that are set at different control pressures from each other as with the above first circulation mode. Of the two negative pressure adjustment mechanisms, the mechanism for setting a high pressure (indicated by H in FIG. 13) and the mechanism for setting a low pressure (indicated by L in FIG. 13) are connected through the liquid supply unit 220 to a common supply flow path 211 and a common collection flow path 212, respectively, in the liquid ejection unit 300. The two negative pressure adjustment mechanisms are used to increase the pressure in the common supply flow path 211 relative to the pressure in the common collection flow path 212, and this generates an ink flow flowing from the common supply flow path 211 through individual flow paths 213 and inside flow paths in the recording element substrates 10 to the common collection flow path 212.

With such a second circulation mode, a similar ink flow state to that in the first circulation mode is achieved in the liquid ejection unit 300, but this mode has two different advantages from the case of the first circulation mode. The first is that the negative pressure control unit 230 is located at the downstream side of the liquid ejection head 3 in the second circulation mode, and thus dust or foreign substances generated from the negative pressure control unit 230 are unlikely to flow into the liquid ejection head 3. The second is that in the second circulation mode, the maximum required flow amount supplied from the buffer tank 1003 to the liquid ejection head 3 can be smaller than that in the case of the first circulation mode.

The total flow amount in the common supply flow path 211 and the common collection flow path 212 when an ink circulates during recording standby is regarded as a flow amount A. The value of a flow amount A is defined as the minimum flow amount required to control the temperature difference in a liquid ejection unit 300 within an intended range, for example, for temperature adjustment of a liquid ejection head 3 at the time of recording standby. The ejection flow amount when all the ejection ports of the liquid ejection unit 300 eject an ink (whole ejection) is defined as a flow amount F (ejection amount per ejection port×ejection frequency per unit time×number of ejection ports).

<Description of Liquid Ejection Head Structure>

Figure 14A:
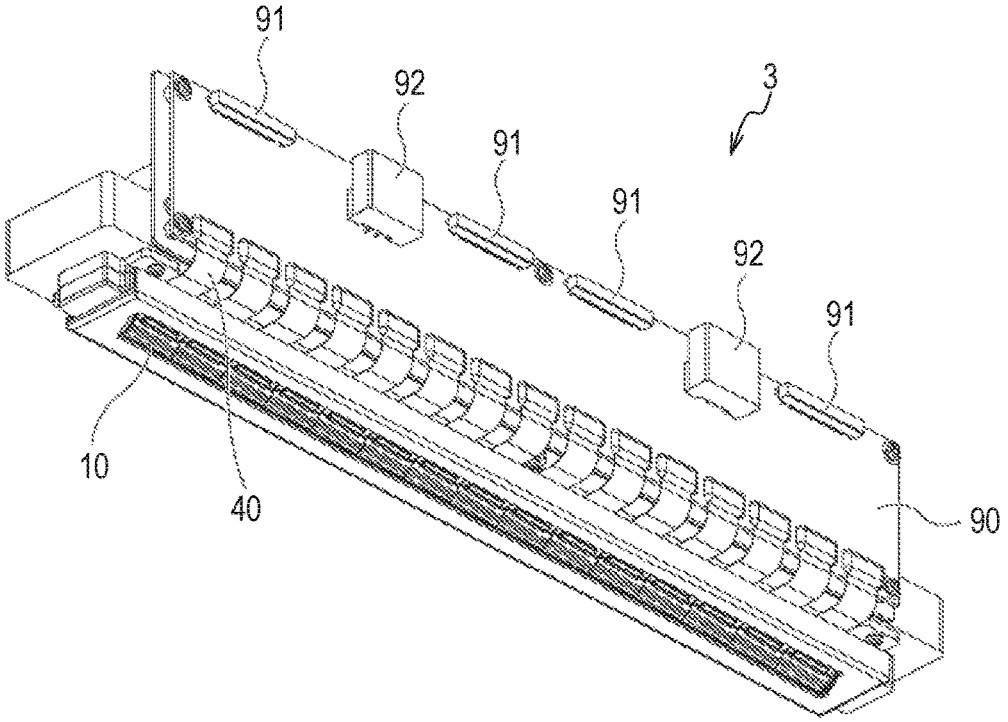
FIGS. 14A and 14B are perspective views showing a liquid ejection head 3 of an inkjet recording apparatus pertaining to an embodiment of the present invention.
Figure 14B:
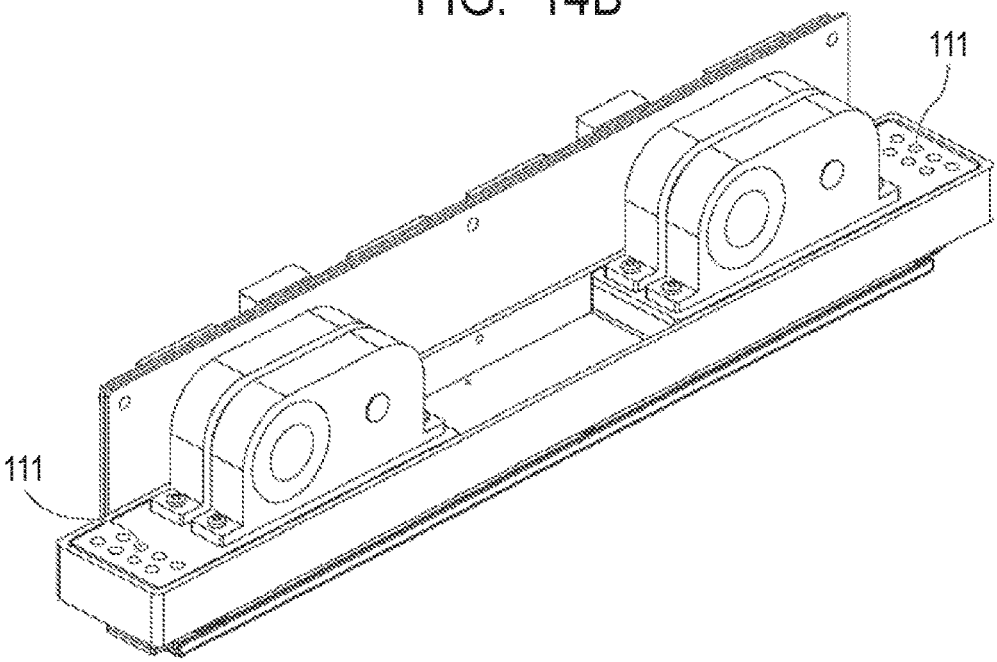

The structure of a liquid ejection head 3 pertaining to the first embodiment will be described. FIGS. 14A and 14B are perspective views showing a liquid ejection head 3 pertaining to the present embodiment. The liquid ejection head 3 is a line liquid ejection head in which 15 recording element substrates 10 are arranged on a straight line (inline arrangement), and each recording element substrate 10 can eject four color inks of cyan C/magenta M/yellow Y/black K inks. As shown in FIG. 14A, the liquid ejection head 3 includes signal input terminals 91 and power supply terminals 92 electrically connected through flexible wiring boards 40 and an electrical wiring board 90 to the recording element substrates 10. The signal input terminals 91 and the power supply terminals 92 are electrically connected to a controller of the recording device 1000 and supply ejection driving signals and electric power required for ejection, respectively, to the recording element substrates 10. Wirings are aggregated by electric circuits in the electrical wiring board 90, and thus the numbers of the signal input terminals 91 and the power supply terminals 92 can be reduced as compared with the number of the recording element substrates 10. This structure can reduce the number of electrical connectors required to be attached/detached when the liquid ejection head 3 is installed in the recording device 1000 or when the liquid ejection head is exchanged. As shown in FIG. 14B, liquid connection sections 111 provided on both ends of the liquid ejection head 3 are connected to the above liquid supply system of the recording device 1000 described in FIG. 12 and FIG. 13. With this structure, four color inks of cyan C/magenta M/yellow Y/black K inks are supplied from the supply system of the recording device 1000 to the liquid ejection head 3, and the inks that have passed through the liquid ejection head 3 are collected to the supply system of the recording device 1000. As described above, each color ink can circulate through a route in the recording device 1000 and a route in the liquid ejection head 3.

Figure 15:
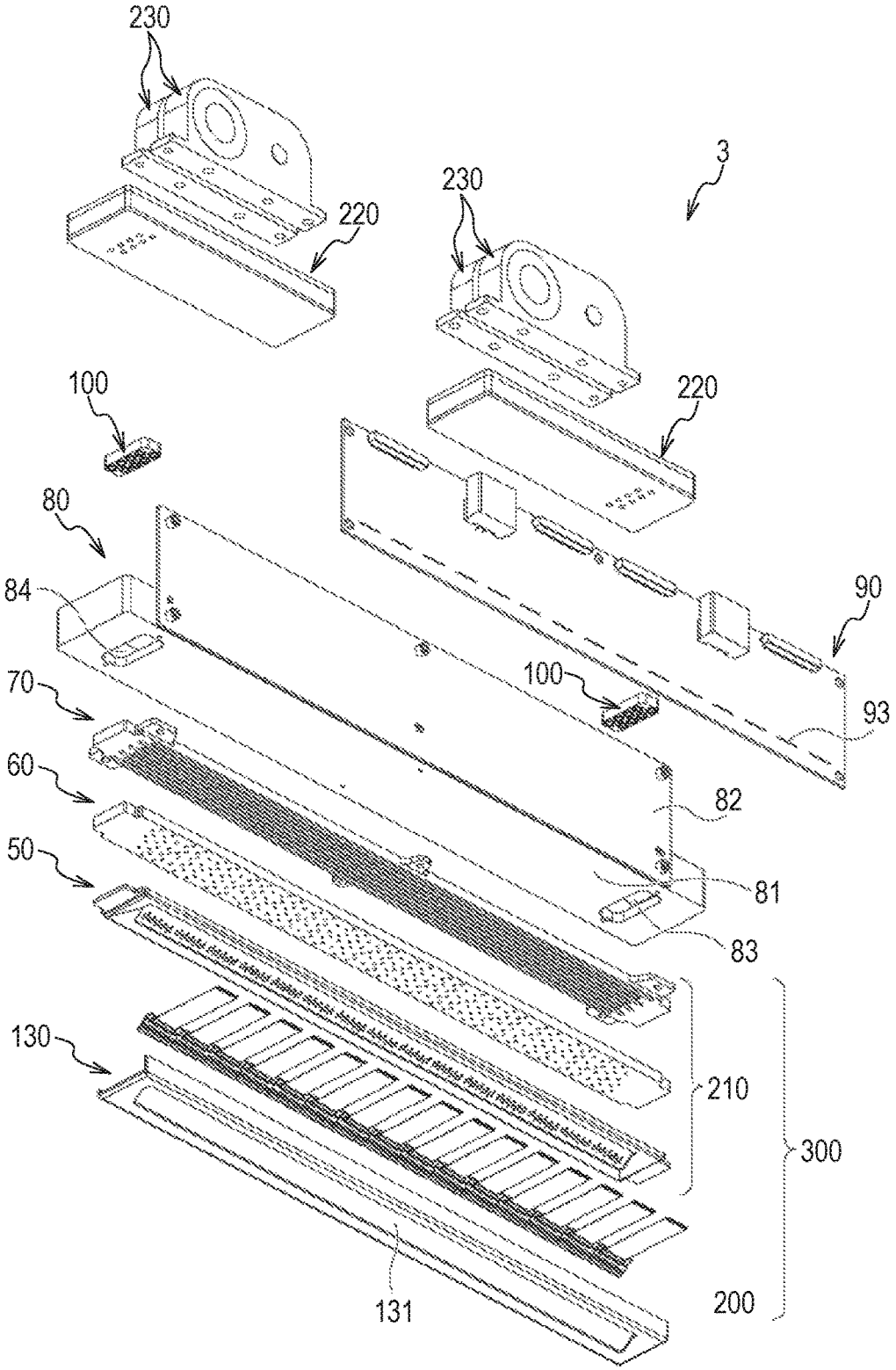
FIG. 15 is an exploded perspective view of the head shown in FIGS. 14A and 14B.

FIG. 15 is an exploded perspective view showing components or units included in the liquid ejection head 3. A liquid ejection unit 300, liquid supply units 220 and an electrical wiring board 90 are attached to a chassis 80. On the liquid supply units 220, liquid connection sections 111 (see FIG. 13) are provided, and in the liquid supply units 220, filters 221 (see FIG. 12, FIG. 13) for corresponding colors are provided to communicate with the corresponding openings of liquid connection sections 111 in order to remove foreign substances in a supplied ink. Each of the two liquid supply units 220 includes filters 221 for two colors. The liquid that has passed through a filter 221 is supplied to a negative pressure control unit 230 for a corresponding ink provided on the liquid supply unit 220. The negative pressure control unit 230 is a unit including a pressure regulating valve for a corresponding color, and a valve, a spring member, and the like provided therein function to greatly reduce a pressure drop change in the supply system of the recording device 1000 (the supply system at the upstream side of the liquid ejection head 3) caused by fluctuations of the liquid flow rate. With this structure, the negative pressure control unit 230 can stabilize negative pressure fluctuations at the downstream side from the pressure control unit (liquid ejection unit 300 side) within a certain range. The negative pressure control unit 230 for each color includes two pressure regulating valves for each color as described in FIG. 12. The two pressure regulating valves are set at different control pressures from each other, and the pressure regulating valve for high pressure and the pressure regulating valve for low pressure communicate with the common supply flow path 211 and the common collection flow path 212, respectively, in the liquid ejection unit 300 (see FIG. 12) through the liquid supply unit 220.

The chassis 80 includes a liquid ejection unit support section 81 and an electrical wiring board support section 82, supports the liquid ejection unit 300 and the electrical wiring board 90, and ensures the rigidity of the liquid ejection head 3. The electrical wiring board support section 82 is for supporting the electrical wiring board 90 and is fixed to the liquid ejection unit support section 81 by screwing. The liquid ejection unit support section 81 has the function of correcting a warpage or deformation of the liquid ejection unit 300 to ensure the relative location accuracy of a plurality of recording element substrates 10 and accordingly suppresses streaky lines or unevenness on a recorded product. Hence, the liquid ejection unit support section 81 preferably has a sufficient rigidity, and the material thereof is preferably a metal material such as SUS and aluminum or a ceramic such as alumina. The liquid ejection unit support section 81 has openings 83, 84 into which joint rubbers 100 are inserted. A liquid supplied from a liquid supply unit 220 is introduced through a joint rubber into a third flow path forming member 70 included in the liquid ejection unit 300.

The liquid ejection unit 300 includes a plurality of ejection modules 200 and a flow path forming member 210, and onto the face of the liquid ejection unit 300 facing a recording medium, a cover member 130 is attached. The cover member 130 is, as shown in FIG. 15, a member having a frame-shaped surface with a long opening 131, and from the opening 131, recording element substrates 10 and sealing members 110 (see FIGS. 19A and 19B) included in the ejection modules 200 are exposed. The frame section surrounding the opening 131 functions as a contact face with a cap member that caps the liquid ejection head 3 during recording standby. Hence, an adhesive, a sealing member, a filler, or the like is preferably applied to the periphery of the opening 131 to fill unevenness or gaps on the ejection port face of the liquid ejection unit 300, thereby forming a closed space at the time of capping.

Next, the structure of the flow path forming member 210 included in the liquid ejection unit 300 will be described. As shown in FIG. 15, the flow path forming member 210 is prepared by stacking a first flow path forming member 50, a second flow path forming member 60 and the third flow path forming member 70 and distributes a liquid supplied from the liquid supply units 220 to each ejection module 200. The flow path forming member 210 is for returning the liquid circulating from the ejection modules 200 to the liquid supply units 220. The flow path forming member 210 is fixed to the liquid ejection unit support section 81 by screwing, which suppresses a warpage or deformation of the flow path forming member 210.

Figure 16A:
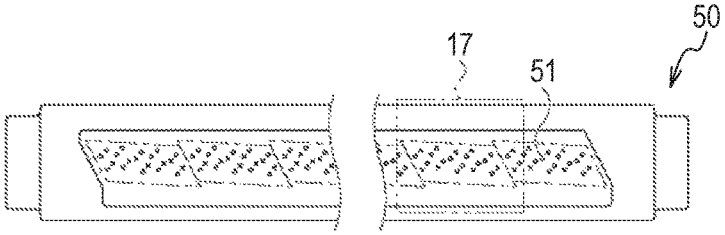
FIGS. 16A, 16B, 16C, 16D, 16E and 16F are views each showing a top face or a back face of a first to third flow path forming member of the head shown in FIG. 15.
Figure 16B:
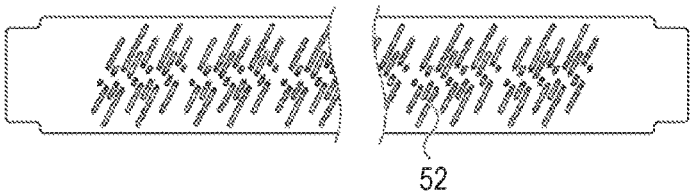
Figure 16C:
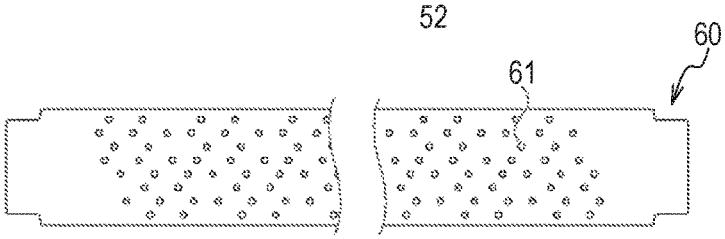
Figure 16D:
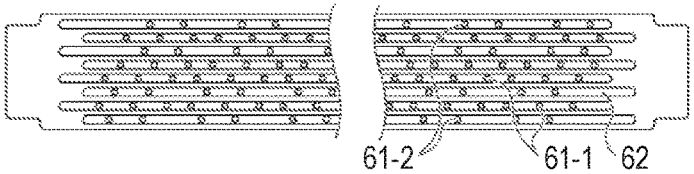
Figure 16E:
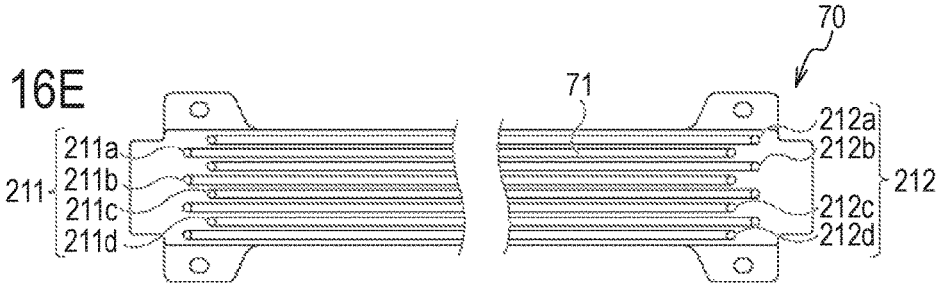
Figure 16F:
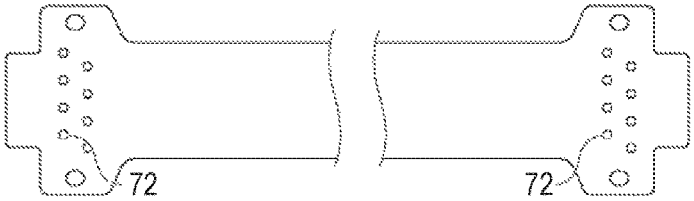

FIGS. 16A to 16F are views showing the front face and the back face of each flow path forming member of the first to third flow path forming members. FIG. 16A shows a face of the first flow path forming member 50, and on the face, the ejection modules 200 are installed. FIG. 16F shows a face of the third flow path forming member 70, and the face is in contact with the liquid ejection unit support section 81. The first flow path forming member 50 joins with the second flow path forming member 60 in such a manner that the contact faces of the respective flow path forming members shown in FIG. 16B and FIG. 16C face toward each other. The second flow path forming member joins with the third flow path forming member in such a manner that the contact faces of the respective flow path forming members shown in FIG. 16D and FIG. 16E face toward each other. By joining the second flow path forming member 60 with the third flow path forming member 70, common flow path grooves 62, 71 formed on the respective flow path forming members define eight common flow paths (211*a*, 211*b*, 211*c*, 211*d*, 212*a*, 212*b*, 212*c*, 212*d*) extending in the longitudinal direction of the flow path forming members. Accordingly, sets of the common supply flow paths 211 and the common collection flow paths 212 for corresponding colors are formed in the flow path forming member 210. An ink is supplied from a common supply flow path 211 to a liquid ejection head 3, and the ink supplied to the liquid ejection head 3 is collected through a common collection flow path 212.

Communication holes 72 of the third flow path forming member 70 (see FIG. 16F) communicate with the corresponding holes in the joint rubber 100 and are fluidly connected to the liquid supply units 220 (see FIG. 15). The bottom faces of the common flow path grooves 62 of the second flow path forming member 60 have a plurality of communication holes 61 (communication holes 61-1 communicating with the common supply flow paths 211, communication holes 61-2 communicating with the common collection flow paths 212), and each communication hole communicates with one end of a corresponding individual flow path groove 52 of the first flow path forming member 50. The other end of each individual flow path groove 52 of the first flow path forming member 50 has a communication hole 51, and through the communication holes 51, the first flow path forming member 50 fluidly communicates with a plurality of ejection modules 200. The individual flow path grooves 52 can aggregate flow paths around the center of the flow path forming member.

The first to third flow path forming members are preferably made from a material having corrosion resistance to a liquid and having a low coefficient of linear expansion. As the material, a composite material (polymer material) containing alumina, a liquid crystal polymer (LCP), polyphenylsulfide (PPS) or polysulfone (PSF) as a base material and containing an inorganic filler including silica microparticles or fibers can be preferably used, for example. As the formation method of the flow path forming member 210, three flow path forming members may be stacked and bonded to each other, or when a polymer composite material is used as the material, a joining method using welding may be used.

Figure 17:
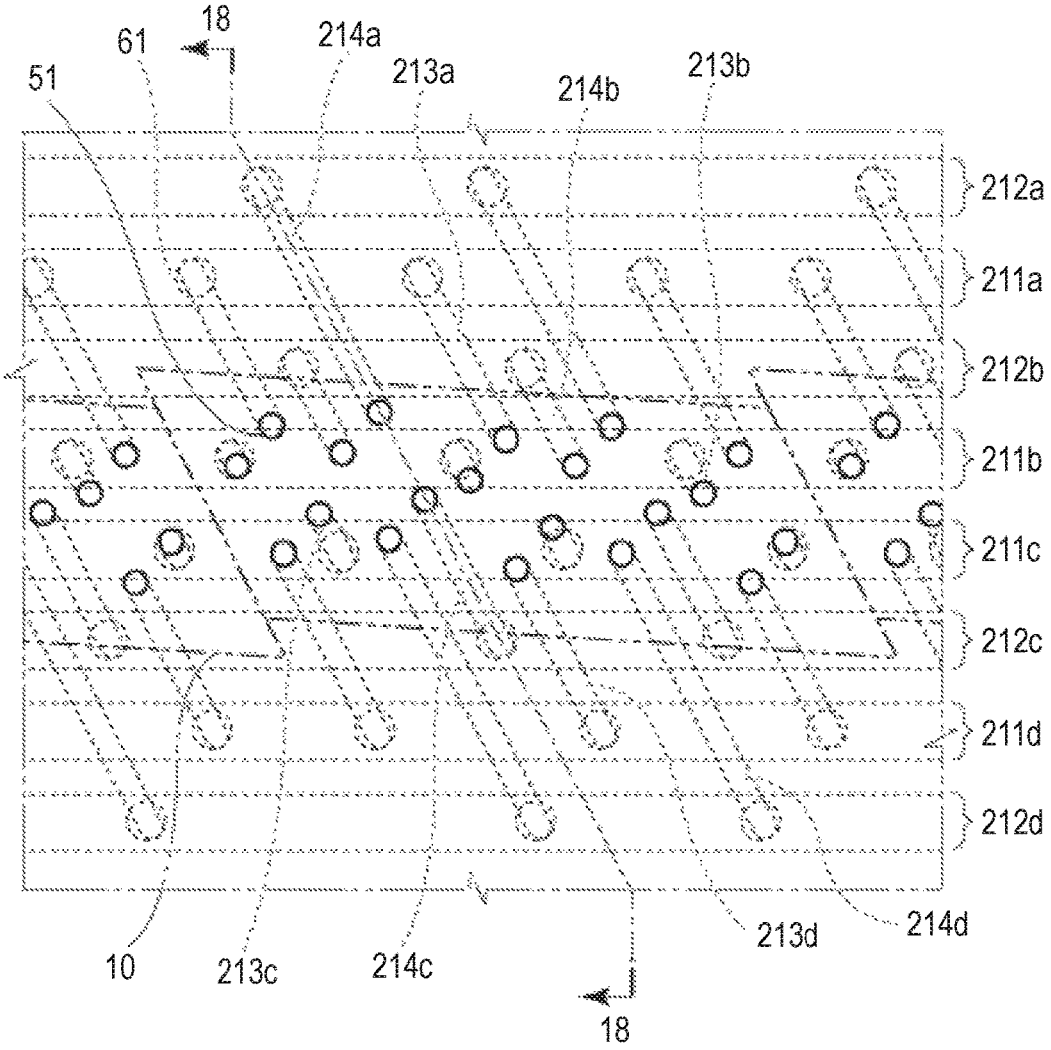
FIG. 17 is an enlarged transparent view showing the region indicated by 17 in FIG. 16A.

FIG. 17 shows the region indicated by 17 in FIG. 16A and is a partially enlarged transparent view of flow paths in the flow path forming member 210 formed by joining the first to third flow path forming members, viewed from the face of the first flow path forming member 50 on which the ejection modules 200 are installed. The common supply flow paths 211 and the common collection flow paths 212 are arranged alternately from the respective endmost flow paths. The connecting relation of flow paths in the flow path forming member 210 will be described.

In the flow path forming member 210, common supply flow paths 211 (211*a*, 211*b*, 211*c*, 211*d*) and common collection flow paths 212 (212*a*, 212*b*, 212*c*, 212*d*) extending in the longitudinal direction of the liquid ejection head 3 are formed for the respective colors. The common supply flow path 211 for each color is connected to a plurality of individual supply flow paths (213*a*, 213*b*, 213*c*, 213*d*) defined by individual flow path grooves 52 through communication holes 61. The common collection flow path 212 for each color is connected to a plurality of individual collection flow paths (214*a*, 214*b*, 214*c*, 214*d*) defined by individual flow path grooves 52 through communication holes 61. With such a flow path structure, an ink can be aggregated from a corresponding common supply flow path 211 through the individual supply flow paths 213 to the recording element substrates 10 located at the center of the flow path forming member. An ink can also be collected from the recording element substrates 10 through the individual collection flow paths 214 to the corresponding common collection flow path 212.

Figure 18:
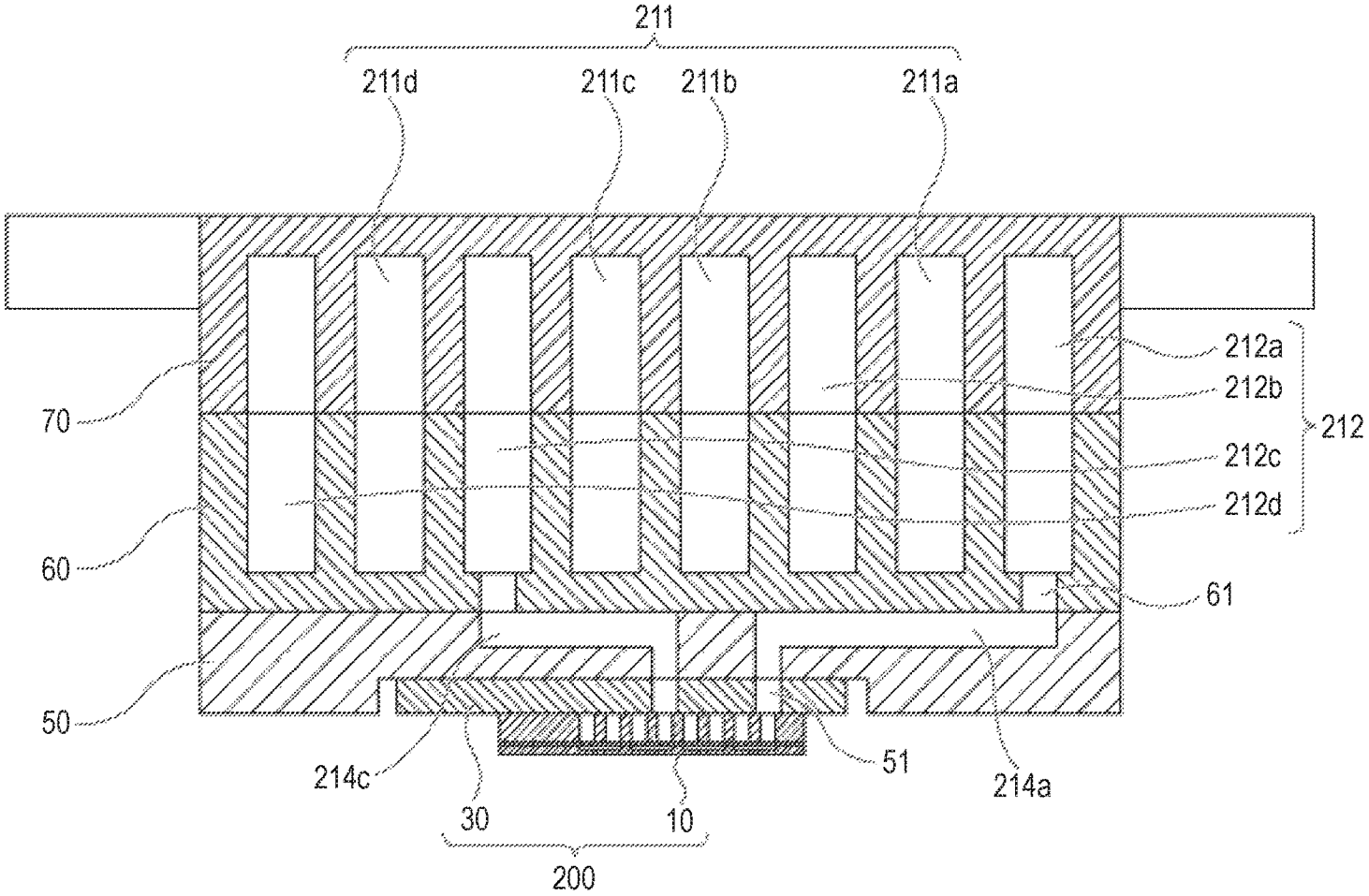
FIG. 18 is a cross-sectional view taken along the line 18-18 in FIG. 17.

FIG. 18 is a view showing a cross section taken along the line 18-18 in FIG. 17. Individual collection flow paths (214*a*, 214*c*) communicate with an ejection module 200 through communication holes 51. FIG. 18 shows only the individual collection flow paths (214*a*, 214*c*), but in another cross section, individual supply flow paths 213 communicate with an ejection module 200 as shown in FIG. 17. In a support member 30 and a recording element substrate 10 included in each ejection module 200, flow paths for supplying inks from the first flow path forming member 50 to recording elements 15 provided in the recording element substrate 10 are formed. In the support member 30 and the recording element substrate 10, flow paths for collecting (circulating) a part or all of the liquid supplied to the recording element 15 to the first flow path forming member 50 are formed.

The common supply flow path 211 for each color is connected to a negative pressure control unit 230 (for high pressure) for the corresponding color through the liquid supply unit 220, and the common collection flow path 212 is connected to the corresponding negative pressure control unit 230 (for low pressure) through the liquid supply unit 220. The negative pressure control units 230 generate a differential pressure (difference in pressure) between the common supply flow path 211 and the common collection flow path 212. With this structure, in the liquid ejection head in the present embodiment including connected flow paths as shown in FIG. 17 and FIG. 18, an ink flow sequentially flowing through the common supply flow path 211, the individual supply flow paths 213*a*, the recording element substrates 10, the individual collection flow paths 213*b*, and the common collection flow path 212 is generated for each ink color.

<Description of Ejection Module>

Figure 19A:
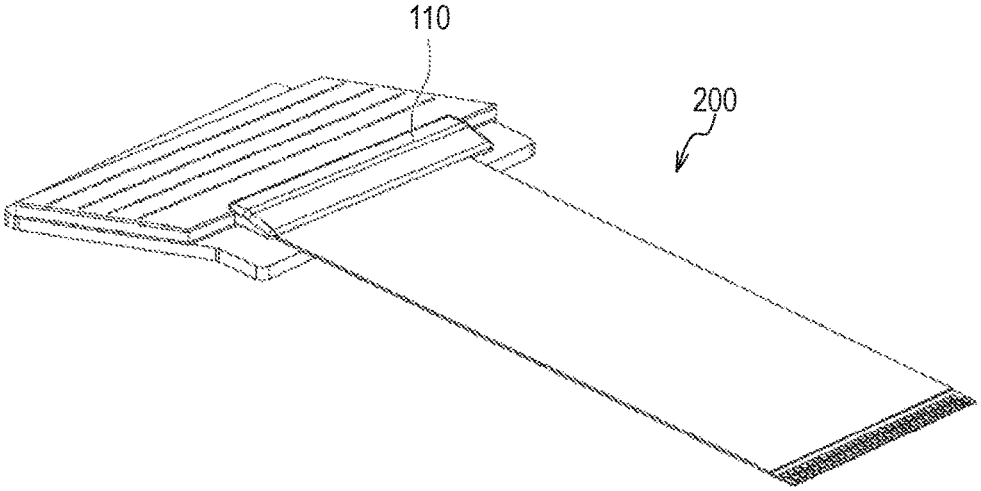
FIG. 19A is a perspective view showing a single ejection module 200.
Figure 19B:
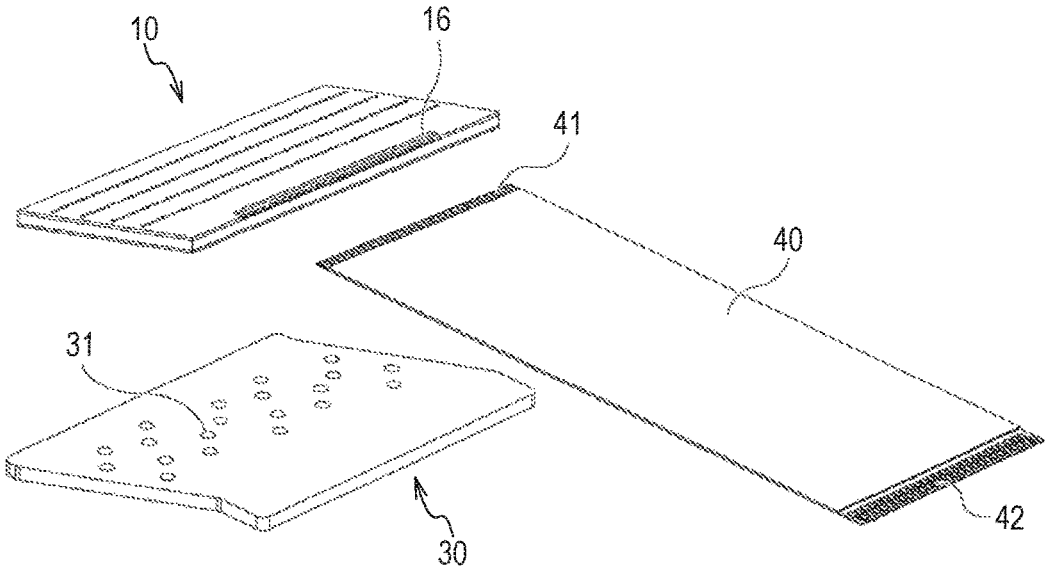
FIG. 19B is an exploded view thereof.

FIG. 19A is a perspective view showing one ejection module 200, and FIG. 19B is an exploded view thereof. To produce the ejection module 200, first, a recording element substrate 10 and a flexible wiring board 40 are bonded onto a support member 30 in which liquid communication holes 31 are previously formed. Next, a terminal 16 on the recording element substrate 10 is electrically connected to a terminal 41 on the flexible wiring board 40 by wire bonding, and then the wire bonded portion (electrical connector) is covered with a sealing member 110 to be sealed. A terminal 42 of the flexible wiring board 40 located opposite to the recording element substrate 10 is electrically connected to a connecting terminal 93 of the electrical wiring board 90 (see FIG. 24). The support member 30 is a supporter for supporting the recording element substrate 10 and is also a flow path forming member for fluid communication between the recording element substrate 10 and the flow path forming member 210. Hence, the support member is preferably a member having high flatness and capable of being joined with the recording element substrate with sufficiently high reliability. The material thereof is preferably alumina or a polymer material, for example.

<Description of Structure of Recording Element Substrate>

Figure 20A:
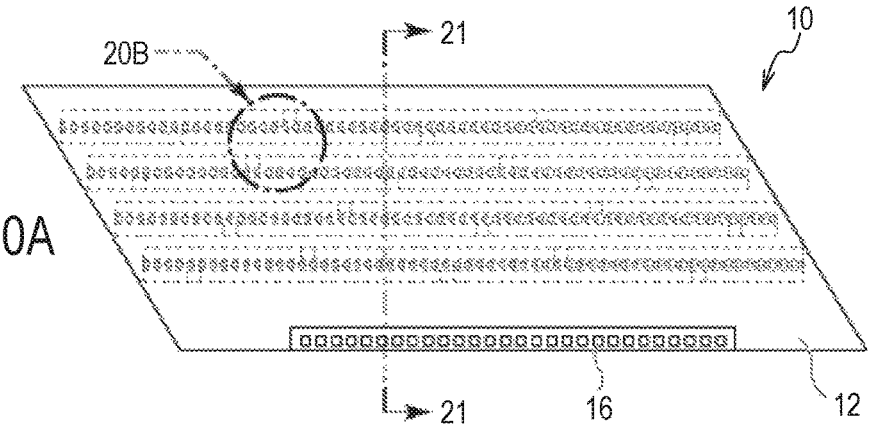
FIG. 20A is a plan view of a face of a recording element substrate 10 on which ejection ports 13 are formed.
Figure 20B:
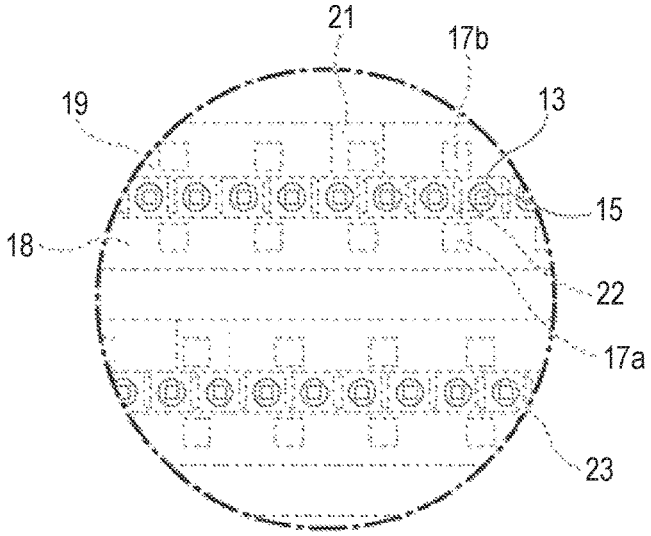
FIG. 20B is an enlarged view of the region indicated by 20B in FIG. 20A.
Figure 20C:
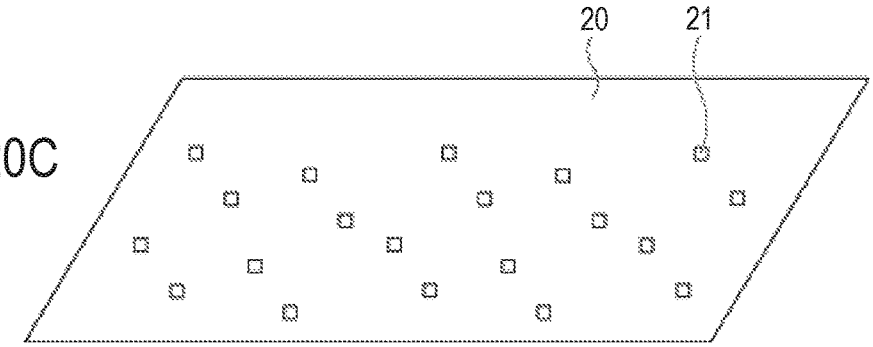
FIG. 20C is a plan view of the back face of the recording element substrate shown in FIG. 20A.

FIG. 20A is a plan view of a face of a recording element substrate 10 on which ejection ports 13 are formed, FIG. 20B is an enlarged view of the region indicated by 20B in FIG. 20A, and FIG. 20C is a plan view of the back face of FIG. 20A. The structure of the recording element substrate 10 in the embodiment will be described. As shown in FIG. 20A, an ejection port forming member 12 of the recording element substrate 10 has four ejection port arrays corresponding to the respective colors. In the following description, the direction in which an ejection port array including a plurality of arranged ejection ports 13 extends is called an "ejection port array direction". As shown in FIG. 20B, at a position corresponding to each ejection port 13, a recording element 15 as a heat generating element for bubbling a liquid by thermal energy is provided. Pressure chambers 23 each having the recording element 15 therein are divided by partition walls 22. Each recording element 15 is electrically connected to a terminal 16 through an electric wiring (not shown) provided in the recording element substrate 10. The recording element 15 generates heat to boil a liquid in response to a pulse signal input from a control circuit of the recording device 1000 through the electrical wiring board 90 (see FIG. 13) and the flexible wiring board 40 (see FIGS. 19A and 19B). By a bubbling force by the boiling, a liquid is ejected from the ejection port 13. As shown in FIG. 20B, along each ejection port array, a liquid supply path 18 extends on one side, and a liquid collection path 19 extends on the other side. The liquid supply path 18 and the liquid collection path 19 are flow paths provided in the recording element substrate 10 and extending in the ejection port array direction and communicate with the ejection ports 13 through supply ports 17*a* and collection ports 17*b*, respectively.

As shown in FIG. 20C, on the face of the recording element substrate 10 opposite to the face on which the ejection ports 13 are formed, a sheet-shaped cover plate 20 is stacked, and the cover plate 20 has a plurality of openings 21 communicating with the liquid supply paths 18 and the liquid collection paths 19 described later. In the present embodiment, three openings 21 are formed for one liquid supply path 18, and two openings 21 are formed for one liquid collection path 19 in the cover plate 20. As shown in FIG. 20B, the openings 21 of the cover plate 20 communicate with the corresponding communication holes 51 shown in FIG. 16A. The cover plate 20 is preferably a plate having sufficient corrosion resistance to a liquid and is required to have high accuracy for the opening shape of the openings 21 and at the opening positions to prevent colors from mixing. The material of the cover plate 20 is thus preferably a photosensitive polymer material or a silicon plate, and the openings 21 are preferably formed by photolithographic process. As described above, the cover plate 20 is for converting the pitch of the flow paths by the openings 21, preferably has a small thickness in consideration of pressure loss, and is desirably formed from a film member.

Figure 21:
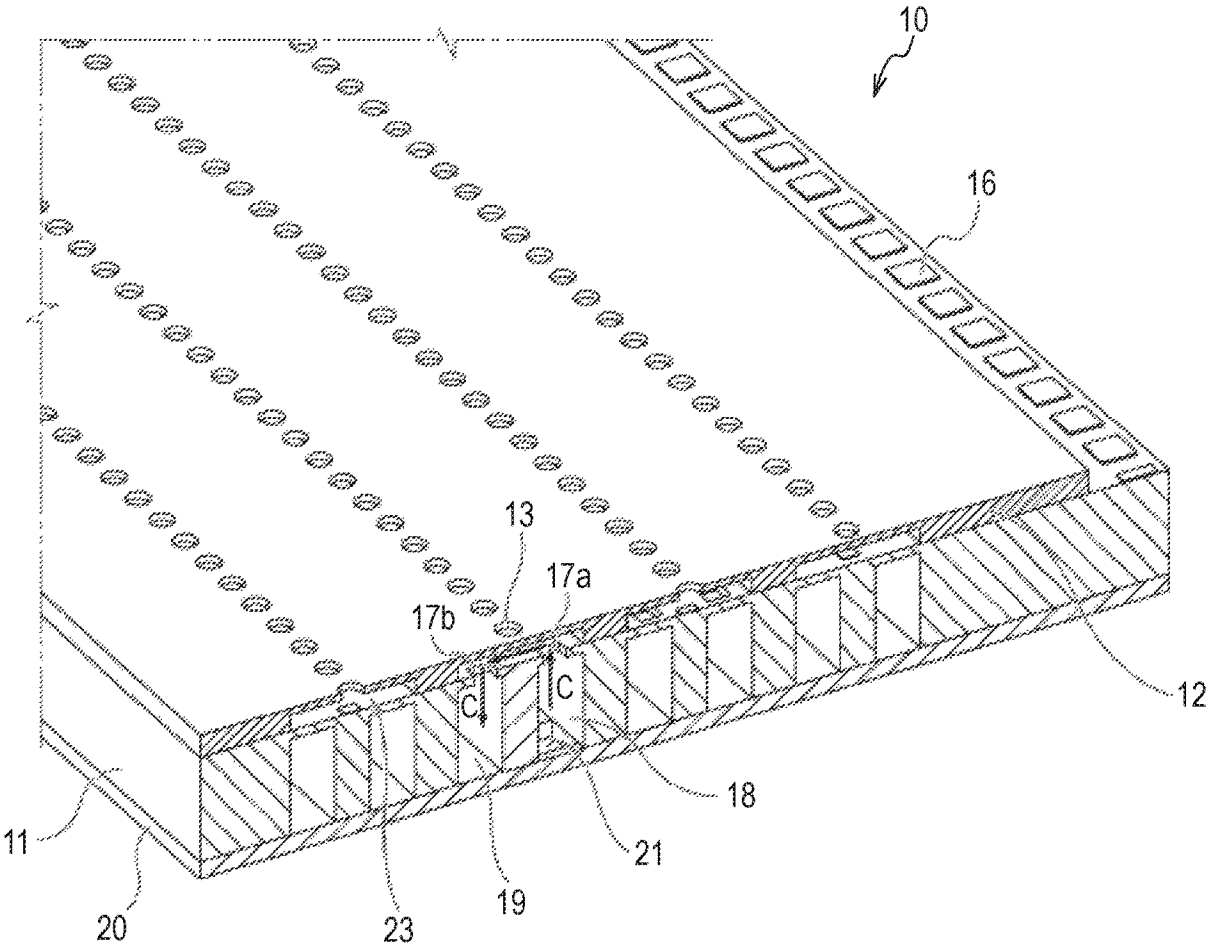
FIG. 21 is a perspective view including a cross section taken along the line 21-21 in FIG. 20A.

FIG. 21 is a perspective view showing a cross section of the recording element substrate 10 and the cover plate 20, taken along the line 21-21 in FIG. 20A. The liquid flow in the recording element substrate 10 will next be described. The cover plate 20 functions as a cover that partially defines the walls of the liquid supply paths 18 and the liquid collection paths 19 formed in a substrate 11 of the recording element substrate 10. The recording element substrate 10 is formed by stacking a Si substrate 11 and an ejection port forming member 12 made from a photosensitive polymer, and onto the back face of the substrate 11, the cover plate 20 is joined. On one face of the substrate 11, recording elements 15 are formed (see FIG. 20B), and on the back face thereof, grooves defining the liquid supply paths 18 and the liquid collection paths 19 extending along the ejection port arrays are formed. The liquid supply paths 18 and the liquid collection paths 19 defined by the substrate 11 and the cover plate 20 are connected to the common supply flow paths 211 and the common collection flow paths 212, respectively, in the flow path forming member 210, and differential pressures are generated between the liquid supply paths 18 and the liquid collection paths 19. In an ejection port not performing ejection while other ejection ports 13 eject a liquid for recording, the differential pressure allows a liquid in a liquid supply path 18 provided in the substrate 11 to flow through a supply port 17*a*, a pressure chamber 23 and a collection port 17*b* to a liquid collection path 19 (the arrow C in FIG. 21). This flow enables collection of an ink causing viscosity increase by evaporation from ejection ports 13, bubbles, foreign substances and the like in ejection ports 13 and pressure chambers 23 not performing ejection to a liquid collection path 19. This flow can also prevent an ink from causing viscosity increase or the concentration of a coloring material from increasing in ejection ports 13 or pressure chambers 23. The liquid collected to the liquid collection path 19 passes through openings 21 of the cover plate 20 and liquid communication holes 31 of the support member 30 (see FIG. 19B), flows through communication holes 51, individual collection flow paths 214 and a common collection flow path 212 in the flow path forming member 210 in this order and is collected to the supply route of the recording device 1000. In other words, a liquid supplied from the recording apparatus main unit to the liquid ejection head 3 flows to be supplied and collected in the following sequence.

With reference to FIGS. 12 and 13, a liquid flows from a liquid connection section 111 of the liquid supply unit 220 into the liquid ejection head 3. The liquid is then supplied through a joint rubber 100, a communication hole 72 and a common flow path groove 71 provided in the third flow path forming member, a common flow path groove 62 and communication holes 61 provided in the second flow path forming member and individual flow path grooves 52 and communication holes 51 provided in the first flow path forming member, in this order. The liquid is then supplied through liquid communication holes 31 provided in the support member 30, openings 21 provided in the cover plate 20 and a liquid supply path 18 and supply ports 17*a* provided in the substrate 11, in sequence, to pressure chambers 23. Of the liquid supplied to the pressure chambers 23, a liquid not ejected from ejection ports 13 flows through collection ports 17*b* and a liquid collection path 19 provided in the substrate 11, openings 21 provided in the cover plate 20 and liquid communication holes 31 provided in the support member 30 in sequence. The liquid then flows through communication holes 51 and individual flow path grooves 52 provided in the first flow path forming member, communication holes 61 and a common flow path groove 62 provided in the second flow path forming member, a common flow path groove 71 and a communication hole 72 provided in the third flow path forming member 70 and a joint rubber 100 in sequence. Finally, the liquid flows through a liquid connection section 111 provided in the liquid supply unit 220 to the outside of the liquid ejection head 3.

In the first circulation mode shown in FIG. 12, a liquid flowing from a liquid connection section 111 passes through the negative pressure control unit 230 and then is supplied to a joint rubber 100. In the second circulation mode shown in FIG. 13, a liquid collected from a pressure chamber 23 passes through a joint rubber 100 and then flows through the negative pressure control unit 230 and a liquid connection section 111 to the outside of the liquid ejection head. Not all the liquid flowing from one end of the common supply flow path 211 in the liquid ejection unit 300 is supplied through an individual supply flow path 213*a* to a pressure chamber 23. In other words, some of the liquid flowing from one end of the common supply flow path 211 may not flow in an individual supply flow path 213*a* but can flow through the other end of the common supply flow path 211 to the liquid supply unit 220. With such a route in which a liquid flows not through recording element substrates 10 as described above, a liquid circulation flow can be prevented from backflowing even with such recording element substrates 10 including fine flow paths having a comparatively large flow resistance as in the embodiment. In the liquid ejection head 3 of the embodiment, a viscosity increase or the like of a liquid in pressure chambers 23 or near ejection ports can be suppressed as described above, thus positioning error of ejection or ejection failure can be suppressed, and consequently, high quality images can be recorded.

<Description of Positional Relation Between Recording Element Substrates>

Figure 22:
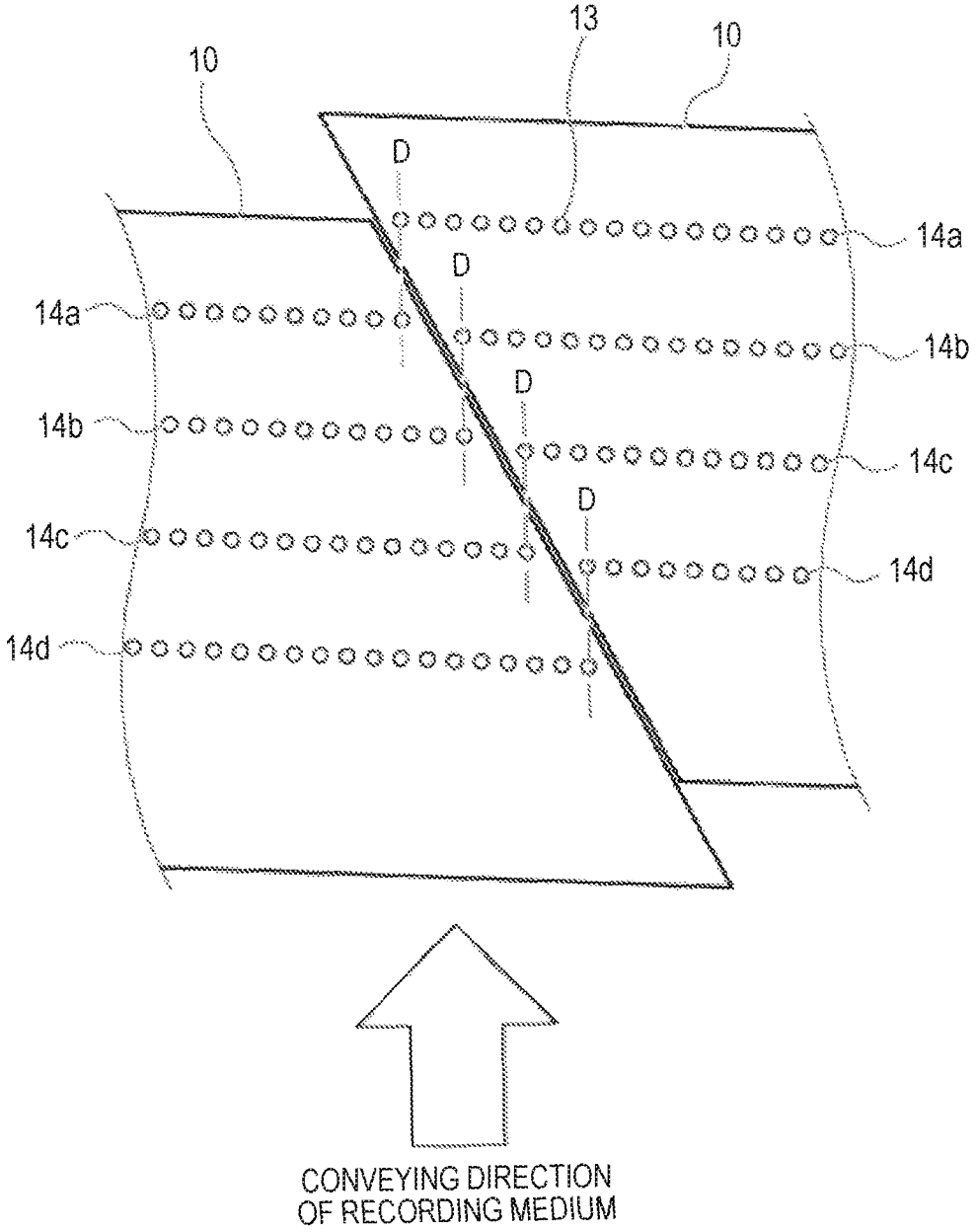
FIG. 22 is a partially enlarged plan view of an adjacent region between recording element substrates of the adjacent two ejection modules 200.

FIG. 22 is a partially enlarged plan view of the adjacent region of recording element substrates in adjacent two ejection modules 200. In the present embodiment, substantially parallelogram recording element substrates are used. Ejection port arrays (14*a* to 14*d*) in which ejection ports 13 of each recording element substrate 10 are arranged are provided to have a certain angle to the conveying direction of a recording medium. In the ejection port arrays in the adjacent region of two recording element substrates 10, at least one ejection port on one recording element substrate overlaps with at least one ejection port on the other recording element substrate in the conveying direction of a recording medium. In FIG. 22, two ejection ports on a line D overlap with each other. With such an arrangement, if a recording element substrate 10 is displaced from a predetermined position to some extent, driving control of overlapping ejection ports can make black streaks or white spots on a recorded image less noticeable. When a plurality of recording element substrates 10 are not arranged in a staggered arrangement but are linearly arranged (inline arrangement), such an arrangement as in FIG. 22 can reduce the increase in length of the liquid ejection head 10 in the conveying direction of a recording medium and can suppress the formation of black streaks or white spots in the adjacent region of recording element substrates 10. In the present embodiment, the principal plane of the recording element substrate is a parallelogram, but the present invention is not limited thereto. For example, when a recording element substrate having a rectangular shape, a trapezoidal shape or another shape is used, the structure of the invention can be preferably applied.

(Inkjet Recording Apparatus in Second Embodiment)

Next, the structure of an inkjet recording apparatus 2000 and a liquid ejection head 2003 in a second embodiment that differs from the above inkjet recording apparatus in the first embodiment will be described. In the following description, only different portions from the recording apparatus in the first embodiment are mainly described, and the same portions as in the apparatus in the first embodiment are not described.

<Description of Inkjet Recording Apparatus>

A recording apparatus 2000 in the present embodiment differs from the first embodiment in that four single-color liquid ejection heads 2003 corresponding to cyan C, magenta M, yellow Y, and black K inks are arranged in parallel to perform full color recording on a recording medium. Only a single ejection port array can be used for a single color in the first embodiment, whereas 20 ejection port arrays can be used for a single color in the present embodiment. Hence, recording data can be appropriately distributed to a plurality of ejection port arrays for recording, and this enables ultrahigh-speed recording. In addition, even when an ejection port fails to eject an ink, an ejection port in another array located at a position corresponding to the failing ejection port in the conveying direction of a recording medium can complementarily eject the ink, thus improving the reliability. Such an apparatus is preferred for business recording or the like. As with the first embodiment, a supply system, a buffer tank 1003 and a main tank 1006 of the recording apparatus 2000 (see FIG. 12 and FIG. 13) are fluidly connected to each liquid ejection head 2003. Each liquid ejection head 2003 is electrically connected to an electric controller that transmits electric power and ejection control signals to the liquid ejection head 2003.

<Description of Circulation Route>

As with the first embodiment, the liquid circulation route between the recording apparatus 2000 and the liquid ejection head 2003 can be the first or second circulation mode shown in FIG. 12 or FIG. 13.

<Description of Structure of Liquid Ejection Head>

Figure 23A:
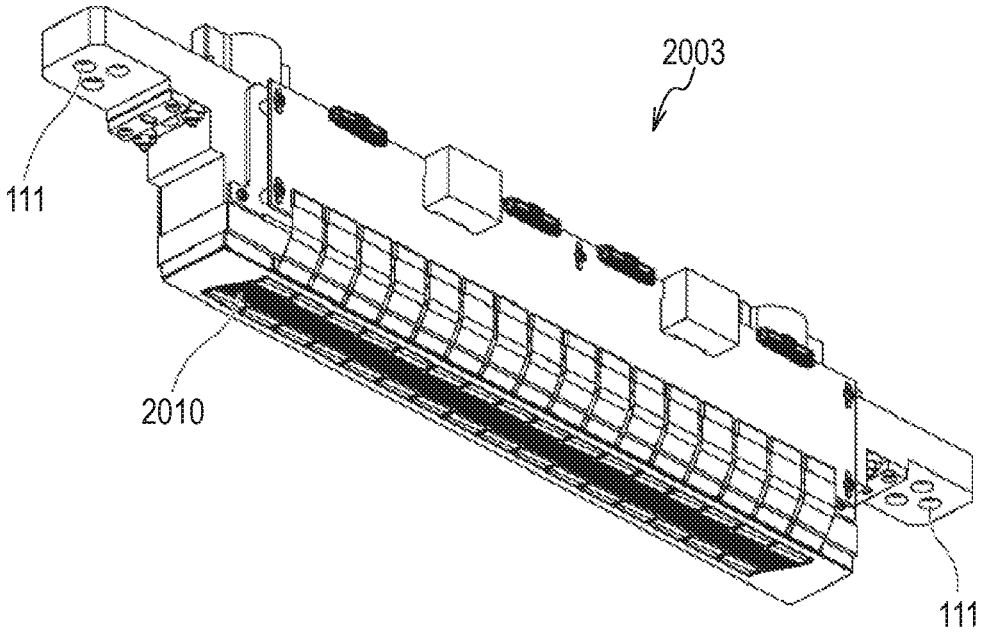
FIGS. 23A and 23B are perspective views showing a liquid ejection head in an inkjet recording apparatus in a second embodiment of the present invention.
Figure 23B:
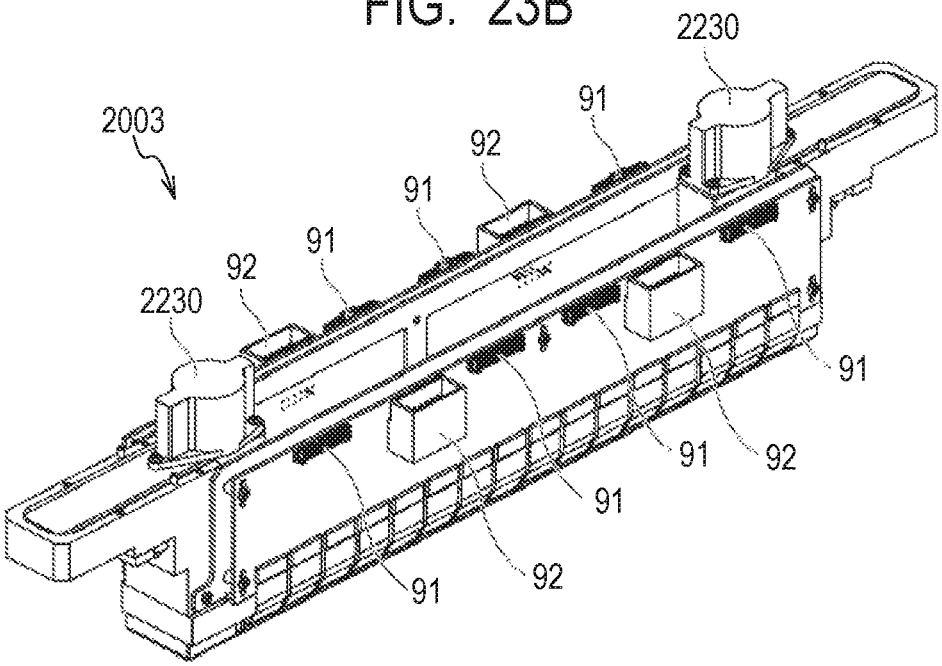

FIGS. 23A and 23B are perspective views showing a liquid ejection head 2003 pertaining to the present embodiment. The liquid ejection head 2003 is a line recording head ejecting a single color ink and including 16 recording element substrates 2010 arranged linearly in the longitudinal direction of the liquid ejection head 2003. As with the first embodiment, the liquid ejection head 2003 has liquid connection sections 111, signal input terminal 91 and power supply terminals 92. The liquid ejection head 2003 in the embodiment has more ejection port arrays than the head in the first embodiment, and thus the signal output terminals 91 and the power supply terminals 92 are provided on both sides of the liquid ejection head 2003. This structure can suppress voltage reduction or signaling delay caused at wiring sections provided on the recording element substrates 2010.

Figure 24:
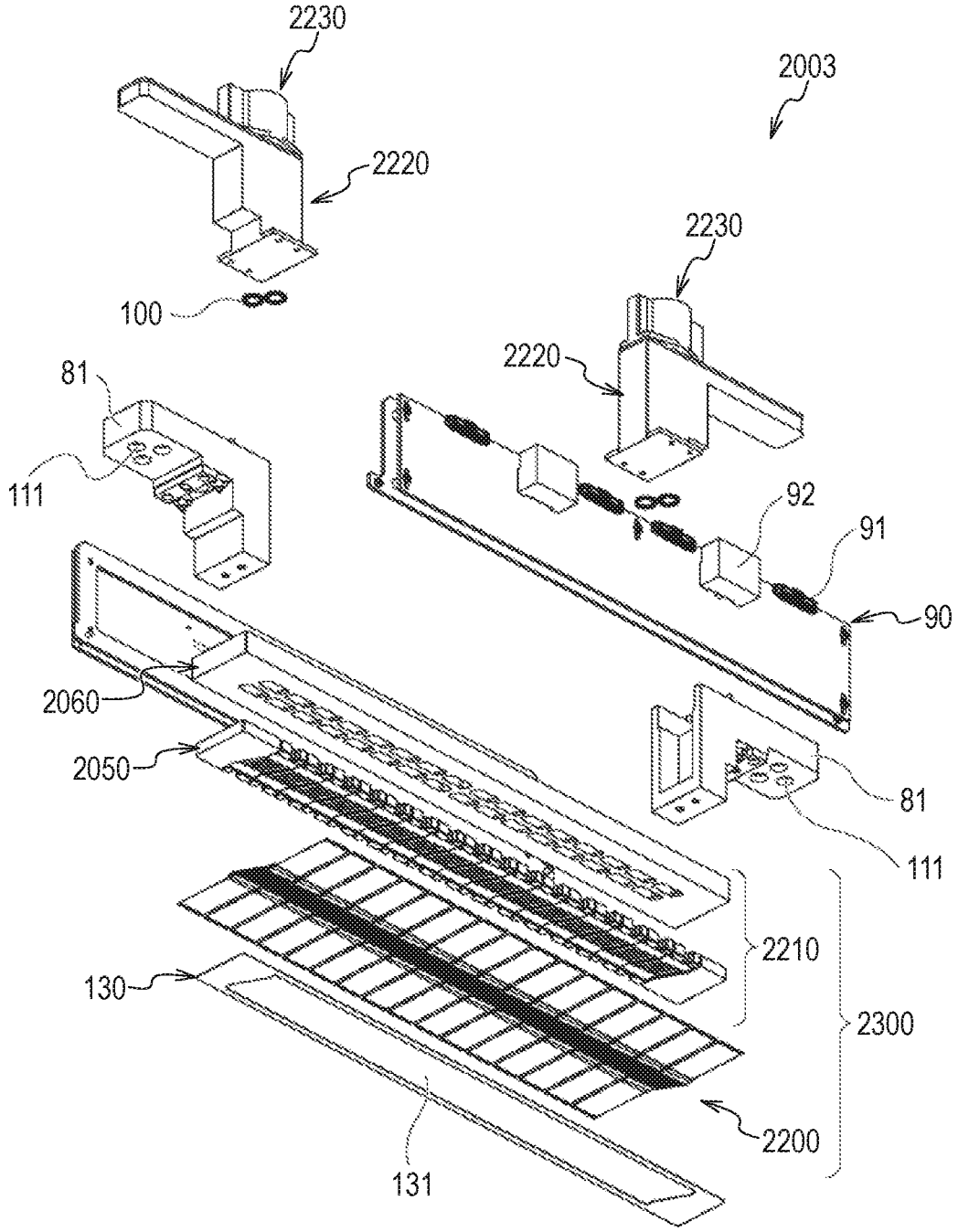
FIG. 24 is an exploded perspective view of the liquid ejection head shown in FIGS. 23A and 23B.

FIG. 24 is an exploded perspective view showing the liquid ejection head 2003 and shows components or units included in the liquid ejection head 2003 in terms of function. The functions of the units and the members and the order of a liquid flow in the liquid ejection head are basically the same as in the first embodiment, but the manner to ensure the rigidity of the liquid ejection head differs. In the first embodiment, the liquid ejection unit support section 81 mainly ensures the rigidity of the liquid ejection head, but in the liquid ejection head 2003 in the second embodiment, a second flow path forming member 2060 included in a liquid ejection unit 2300 ensures the rigidity of the liquid ejection head. Liquid ejection unit support sections 81 in the embodiment are connected to the respective ends of the second flow path forming member 2060, and the liquid ejection unit 2300 is mechanically joined with a carriage of the recording apparatus 2000 to perform positioning of the liquid ejection head 2003. Liquid supply units 2220 with negative pressure control units 2230 and an electrical wiring board 90 are joined with the liquid ejection unit support sections 81. Each of the two liquid supply units 2220 includes a filter (not shown).

The two negative pressure control units 2230 are configured to control pressures at relatively high and low negative pressures different from each other. When negative pressure control units 2230 for high pressure and for low pressure are installed on the respective ends of the liquid ejection head 2003 as shown in FIGS. 23A and 23B, a liquid in a common supply flow path extending in the longitudinal direction of the liquid ejection head 2003 flows counter to a liquid flowing in a common collection flow path extending in the longitudinal direction of the liquid ejection head 2003. Such a structure accelerates heat exchange between the common supply flow path and the common collection flow path to reduce the temperature difference between the two common flow paths. This advantageously suppresses each temperature difference in a plurality of recording element substrates 2010 provided along common flow paths, and recording unevenness due to temperature differences is unlikely to be caused.

Next, the flow path forming member 2210 of the liquid ejection unit 2300 will be specifically described. As shown in FIG. 24, the flow path forming member 2210 is prepared by stacking first flow path forming members 2050 and a second flow path forming member 2060 and distributes a liquid supplied from the liquid supply units 2220 to each ejection module 2200. The flow path forming member 2210 also functions as a flow path forming member for returning a liquid circulating from the ejection modules 2200 to the liquid supply units 2220. The second flow path forming member 2060 in the flow path forming member 2210 is a flow path forming member in which a common supply flow path and a common collection flow path are formed and also functions to mainly ensure the rigidity of the liquid ejection head 2003. Hence, the material of the second flow path forming member 2060 preferably has sufficient corrosion resistance to a liquid and high mechanical strength. Specifically, SUS, Ti or alumina can be used, for example.

Figure 25A:
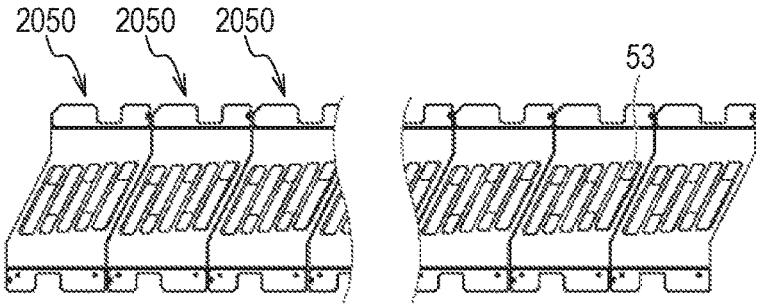
FIGS. 25A, 25B, 25C, 25D and 25E are views each showing a top face or a back face of a first or second flow path forming member of the liquid ejection head shown in FIG. 24.
Figure 25B:
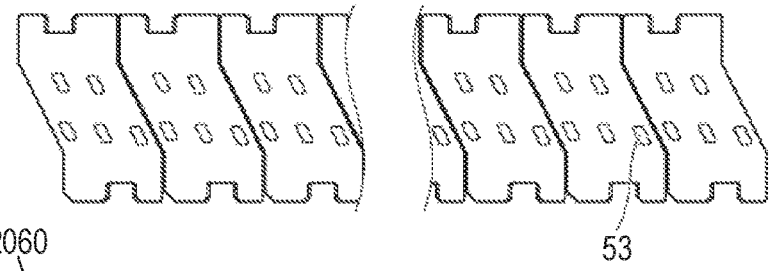
Figure 25C:
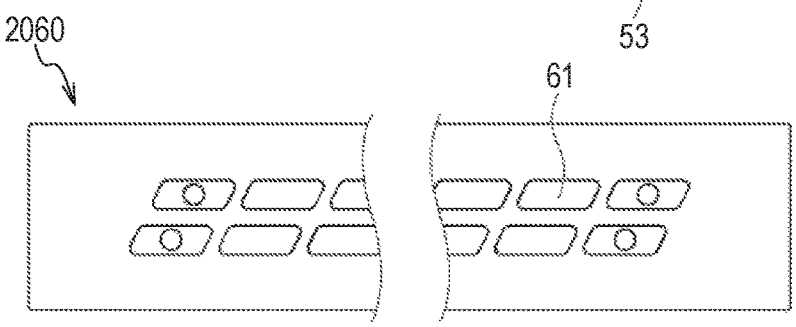
Figure 25D:
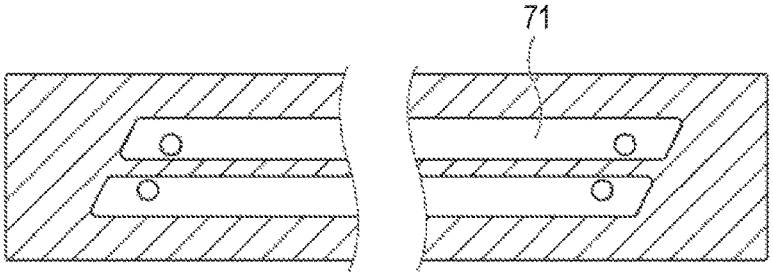
Figure 25E:
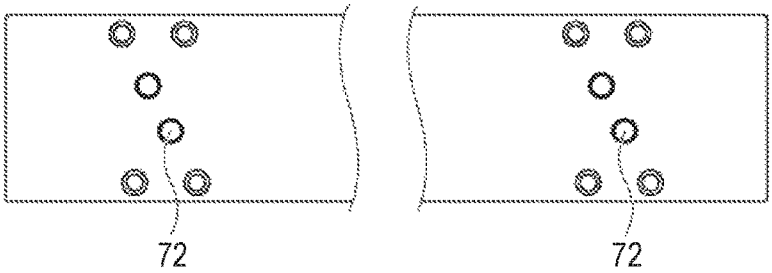

FIG. 25A is a view showing a face of the first flow path forming members 2050 on which the ejection modules 2200 are mounted, and FIG. 25B is a view showing the back face thereof in contact with the second flow path forming member 2060. Unlike the first embodiment, the first flow path forming members 2050 in the present embodiment are prepared by arranging a plurality of members side by side for the corresponding ejection modules 2200. With such a divided structure, a plurality of modules can be arranged to give a length corresponding to the liquid ejection head 2003. Hence, such a structure can be particularly preferably adopted to a comparatively long liquid ejection head corresponding to the length of a B2 size or larger sizes, for example. FIG. 25C is a view showing a face of the second flow path forming member 60 in contact with the first flow path forming members 2050, FIG. 25D is a view showing a cross section of the second flow path forming member 60 at the center in the thickness direction, and FIG. 25E is a view showing a face of the second flow path forming member 2060 in contact with the liquid supply units 2220. As shown in FIGS. 25B and 25C, individual communication holes 53 in the first flow path forming members 2050 fluidly communicate with communication holes 61 in the second flow path forming member 2060. The functions of flow paths and communication holes in the second flow path forming member 2060 are the same as those for a single color in the first embodiment. One of the common flow path grooves 71 of the second flow path forming member 2060 is the common supply flow path 2211 shown in FIG. 26, and the other is the common collection flow path 2212. Each groove is provided along the longitudinal direction of the liquid ejection head 2003, and a liquid is supplied from one end to the other end. The present embodiment differs from the first embodiment in that a liquid flow in the common supply flow path 2211 counters a liquid flow in the common collection flow path 2212.

Figure 26:
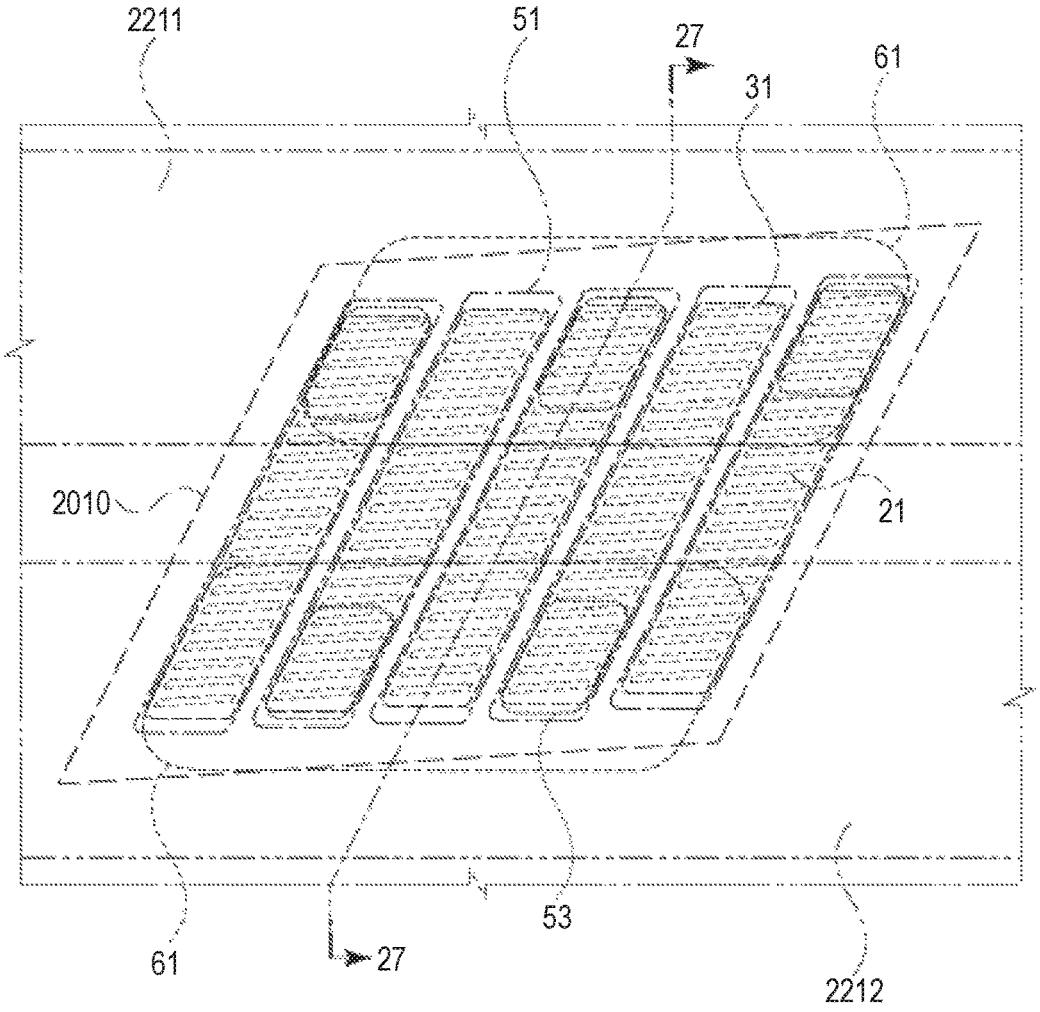
FIG. 26 is a transparent view showing the liquid connecting relationship between a recording element substrate and the flow path forming member in the liquid ejection head shown in FIG. 24.

FIG. 26 is a transparent view showing the liquid connecting relation between a recording element substrate 2010 and the flow path forming member 2210. In the flow path forming member 2210, a pair of a common supply flow path 2211 and a common collection flow path 2212 extending in the longitudinal direction of the liquid ejection head 2003 are provided. The communication holes 61 in the second flow path forming member 2060 are positioned and connected to the corresponding individual communication holes 53 in each first flow path forming member 2050, thus forming a liquid supply route communicating from a communication hole 72 in the second flow path forming member 2060 through the common supply flow path 2211 to communication holes 51 in the first flow path forming member 2050. In a similar manner, a liquid supply route communicating from a communication hole 72 in the second flow path forming member 2060 through the common collection flow path 2212 to communication holes 51 in the first flow path forming member 2050 is also formed.

Figure 27:
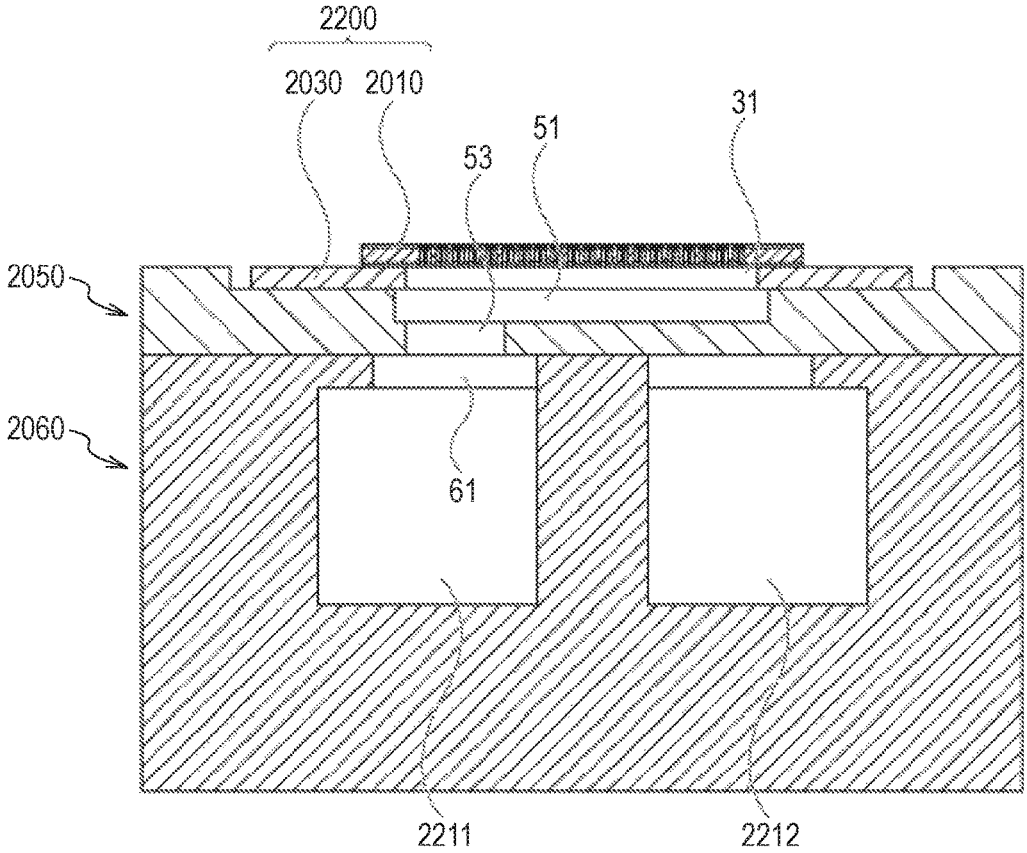
FIG. 27 is a view showing a cross section taken along the line 27-27 in FIG. 26.

FIG. 27 is a view showing a cross section taken along the line 27-27 in FIG. 26. The common supply flow path 2211 is connected through a communication hole 61, an individual communication hole 53 and a communication hole 51 to an ejection module 2200. Not shown in FIG. 27, it is apparent from FIG. 26 that the common collection flow path 2212 is connected to the ejection module 2200 through a similar route in another cross section. As with the first embodiment, in each of the ejection modules 2200 and the recording element substrates 2010, a flow path communicating with each ejection port is formed, and some or all of the liquid supplied can circulate through an ejection port not performing ejection. As with the first embodiment, the common supply flow path 2211 and the common collection flow path 2212 are connected to the negative pressure control unit 2230 (for high pressure) and the negative pressure control unit 2230 (for low pressure), respectively, through the liquid supply units 2220. The resulting differential pressure generates a flow flowing from the common supply flow path 2211 through the ejection ports in the recording element substrate 2010 to the common collection flow path 2212.

<Description of Ejection Module>

Figure 28A:
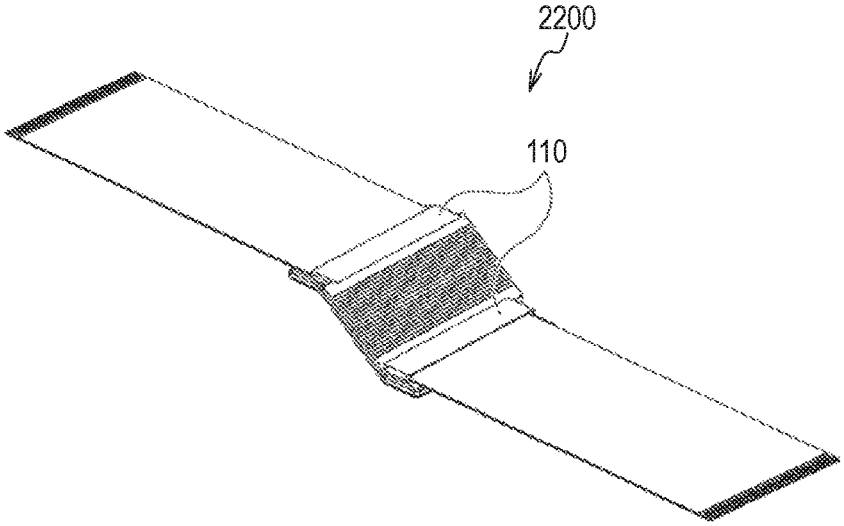
FIG. 28A is a perspective view showing a single ejection module 2200.
Figure 28B:
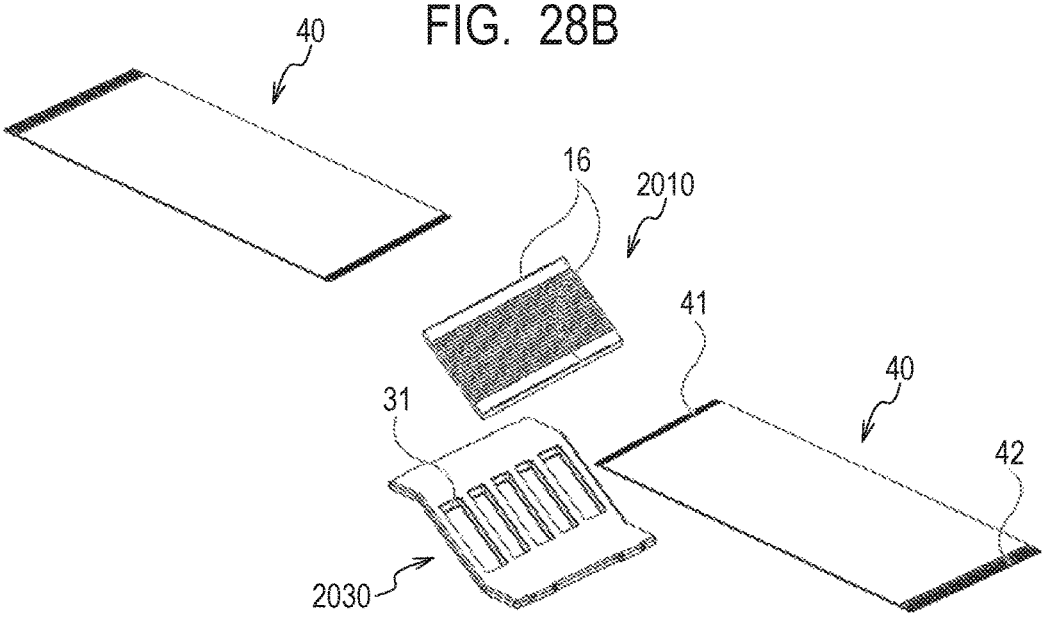
FIG. 28B is an exploded view thereof.

FIG. 28A is a perspective view showing one ejection module 2200, and FIG. 28B is an exploded view thereof. The difference from the first embodiment is that a plurality of terminals 16 are provided on both sides along the direction of a plurality of ejection port arrays of the recording element substrate 2010 (on both long sides of the recording element substrate 2010). Accordingly, two flexible wiring boards 40 electrically connected to the recording element substrate 2010 are provided for a single recording element substrate 2010. This is because the recording element substrate 2010 includes 20 ejection port arrays, which are significantly more than the first embodiment including four arrays, and such a module can shorten the maximum distance from a terminal 16 to a recording element, thus suppressing voltage reduction or signaling delay caused at wiring sections in the recording element substrate 2010. Liquid communication holes 31 of a support member 2030 open across ejection port arrays provided in the recording element substrate 2010. The other points are the same as in the first embodiment.

<Description of Structure of Recording Element Substrate>

Figure 29A:
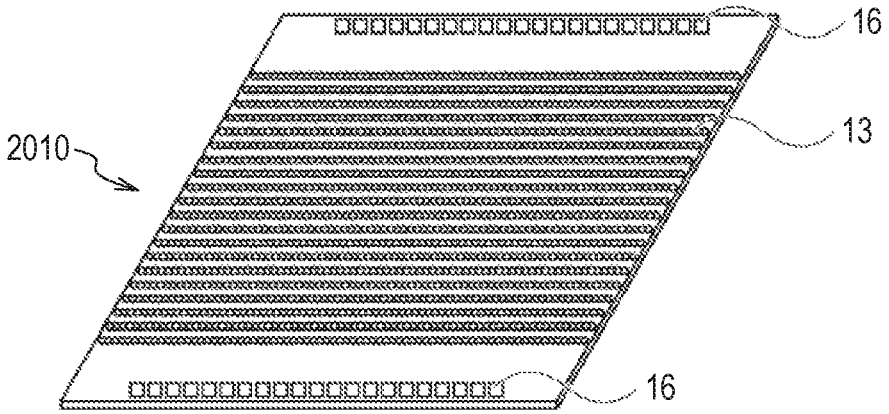
FIG. 29A is a schematic view showing a face of a recording element substrate 2010 on which ejection ports are arranged.
Figure 29B:
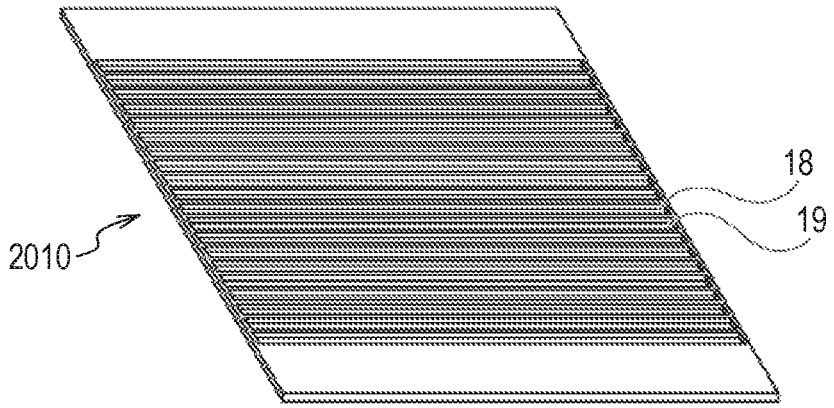
FIG. 29B is a schematic view showing the recording element substrate shown in FIG. 29C from which a cover plate on the back face is removed.
Figure 29C:
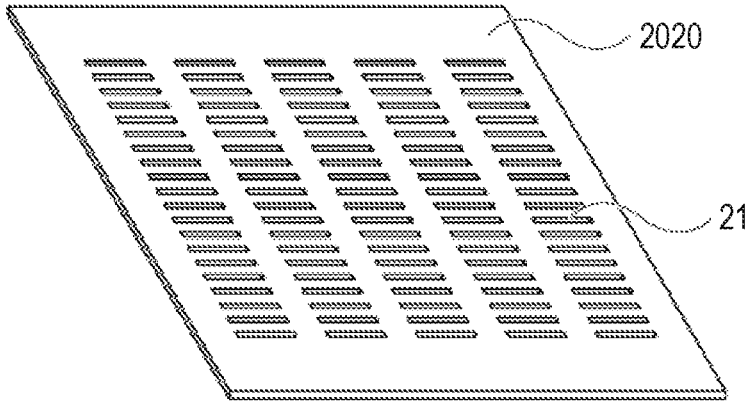
FIG. 29C is a schematic view showing the opposite face thereto (back face)

FIG. 29A is a schematic view of a face of the recording element substrate 2010 on which ejection ports 13 are arranged, and FIG. 29C is a schematic view showing the back face of the face in FIG. 29A. FIG. 29B is a schematic view showing a face of the recording element substrate 2010 when a cover plate 2020 provided on the back face of the recording element substrate 2010 in FIG. 29C is removed. As shown in FIG. 29B, liquid supply paths 18 and liquid collection paths 19 are arranged alternately along the ejection port array direction on the back face of the recording element substrate 2010. Although the number of ejection port arrays significantly increases as compared with the first embodiment, the essential difference from the first embodiment is that terminals 16 are arranged on both sides of the recording element substrate along the ejection port array direction as mentioned above. The basic structure is the same as in the first embodiment: a set of a liquid supply path 18 and a liquid collection path 19 is provided for each ejection port array; and the cover plate 2020 has openings 21 communicating with the liquid communication holes 31 in the support member 2030, for example.

The description in the above embodiments is not intended to limit the scope of the invention. As an example, the present embodiment has described a thermal system that uses heat generation elements for generating bubbles to eject a liquid, but the present invention is also applicable to liquid ejection heads using a piezoelectric system or other various liquid ejection systems.

The present embodiment has described an inkjet recording apparatus (recording device) in which a liquid such as an ink is circulated between a tank and a liquid ejection head, but other modes may be used. In another exemplary mode, an ink is not circulated, but two tanks are provided at an upstream side and a downstream side of a liquid ejection head to allow an ink to flow from one tank to the other tank, thereby allowing the ink to flow in a pressure chamber.

First Embodiment

Figure 30A:
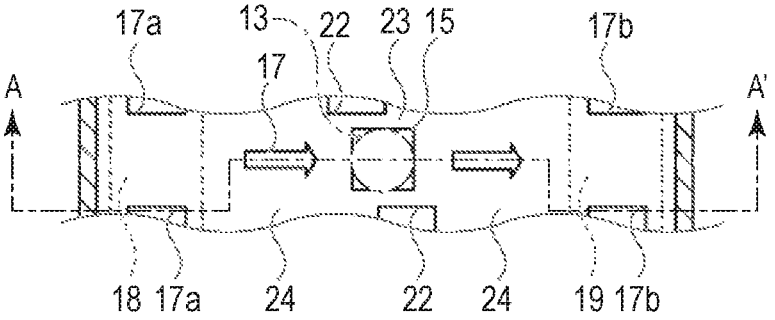
FIGS. 30A, 30B and 30C are views describing the structure of an ejection port in a liquid ejection head and an ink flow path near the ejection port.
Figure 30B:
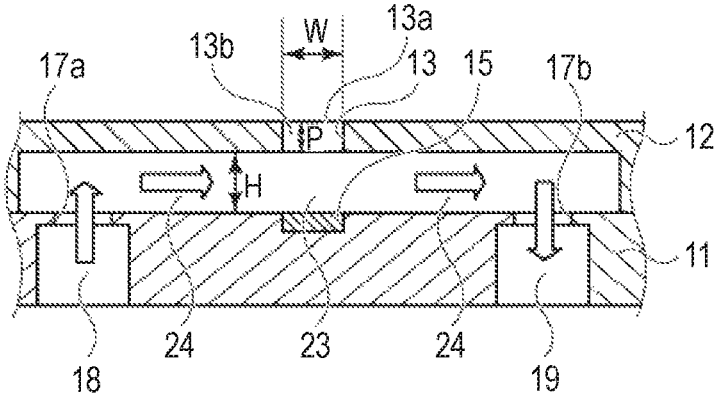
Figure 30C:
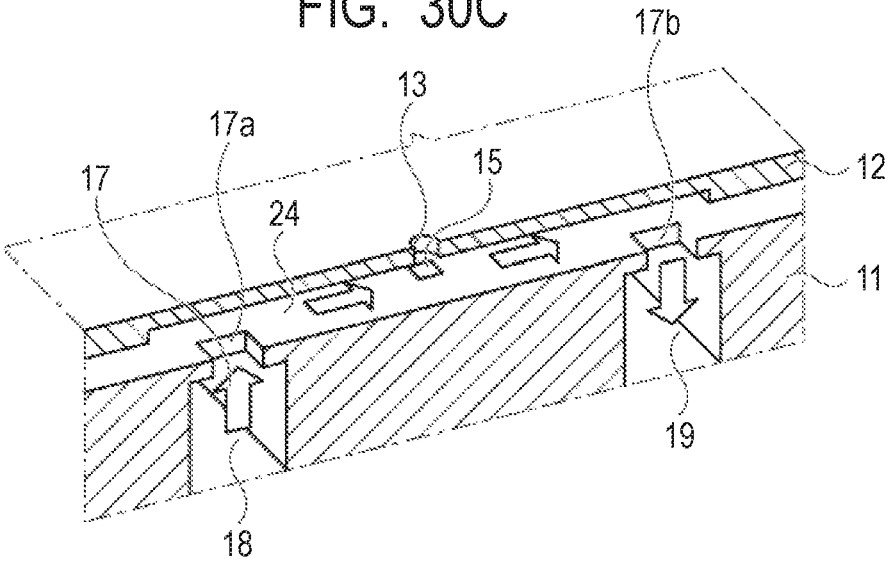

FIGS. 30A to 30C are views describing the structure of an ejection port and an ink flow path near the ejection port in a liquid ejection head pertaining to a first embodiment of the present invention. FIG. 30A is a plan view showing the ink flow path and the like viewed from an ink ejection side, FIG. 30B is a cross-sectional view taken along the line A-A' in FIG. 30A, and FIG. 30C is a perspective view of the cross section taken along the line A-A' in FIG. 30A.

As shown in these figures, the above-mentioned ink circulation generates an ink flow 17 through a pressure chamber 23 with a recording element 15 on a substrate 11 of the liquid ejection head and through flow path 24 before and after the pressure chamber. In other words, a differential pressure generating an ink circulation allows an ink supplied from a liquid supply path (supply flow path) 18 through a supply port 17*a* provided in the substrate 11 passes through the flow path 24, the pressure chamber 23 and the flow path 24 and flows through a collection port 17*b* to a liquid collection path (discharge flow path) 19.

While an ink flows as above, the space from the recording element (energy generating element) 15 to an ejection port 13 located above the element is filled with the ink at the time of non-ejection, and an ink meniscus (ink interface 13*a*) is formed near the end of the ejection port 13 in the ejection direction. In FIG. 30B, the ink interface is indicated by a straight line (flat surface), but the shape depends on a member forming the wall of the ejection port 13 and on an ink surface tension and is typically a concave or convex curve (curved surface). To simplify the figure, the interface is indicated by a straight line. When an electrothermal conversion element (heater) as the energy generating element 15 is driven while the meniscus is formed, the generated heat can be used to form bubbles in an ink, ejecting the ink from the ejection port 13. The present embodiment describes an example using an electrothermal conversion element as the energy generating element, but the present invention is not limited to the example, and various energy generating elements such as a piezoelectric element are applicable. In the present embodiment, the flow speed of the ink flowing through the flow path 24 is, for example, about 0.1 to 100 mm/s, and the effect on impact accuracy or the like can be comparatively minimized even when ejection is performed while an ink flows.

<Relationship Among P, W and H>

In the liquid ejection head of the present embodiment, the relationship among the height H of the flow path 24, the thickness P of an orifice plate (flow path forming member 12) and the length (diameter) W of the ejection port is defined in the following description.

In FIG. 30B, the height of the flow path 24 in the upstream side at the lower end (a communication section between the ejection port section and the flow path) of a space of an ejection port 13 in an orifice plate having a thickness P (hereinafter called an ejection port section 13*b*) is represented as H. The length of the ejection port section 13*b* is represented as the thickness P. The length of the ejection port section 13*b* in the liquid flow direction in the flow path 24 is represented as W. In the liquid ejection head of the embodiment, H is 3 to 30 μm, P is 3 to 30 μm, and W is 6 to 30 μm. The ink is adjusted to have a non-volatile solvent concentration of 30%, a coloring material concentration of 3% and a viscosity of 0.002 to 0.003 Pa·s.

In the present embodiment, in order to suppress the increase in viscosity of an ink due to evaporation of the ink from an ejection port 13 or the like, the following structure is adopted. FIG. 30C is a view showing an ink flow 17 in the ejection port 13, the ejection port section 13*b* and the flow path 24 when the ink flow 17 of an ink flowing through the flow path 24 and the pressure chamber 23 in the liquid ejection head is in a stationary state. In the figure, the length of the arrows does not indicate the speed of an ink flow. FIG. 30C shows a flow when an ink flows from the liquid supply path 18 to the flow path 24 at a flow rate of $1.26\times10^{-4}$ ml/min in a liquid ejection head in which the flow path 24 has a height H of 14 μm, the ejection port section 13*b* has a length P of 10 μm and the ejection port has a length (diameter) W of 17 μm, for example.

In the present embodiment, the height H of the flow path 24, the length P of the ejection port section 13*b* and the length W of the ejection port section 13*b* in the ink flow direction satisfy the relationship of Formula (1).

$$H^{-0.34}\times P^{-0.66}\times W>1.5 \qquad \text{Formula (1)}$$

In the liquid ejection head in the embodiment satisfying the condition, as shown in FIGS. 30A to 30C, the ink flow 17 flowing in the flow path 24 flows into the ejection port section 13*b* to at least a position of the ejection port section 13*b* at half the thickness of the orifice plate and then flows back to the flow path 24. The ink back to the flow path 24 flows through the liquid collection path 19 to the above-mentioned common collection flow path 212. In other words, at least some of the ink flow 17 reaches a position not lower than ½ of the ejection port section 13*b* in the direction from the pressure chamber 23 toward the ink interface 13*a* and then returns to the flow path 24. This flow can suppress the increase in viscosity of an ink in a large region in the ejection port section 13*b*. Such an ink flow in the liquid ejection head can allow an ink in not only the flow path 24 but also the ejection port section 13*b* to flow out to the flow path 24. As a result, the increase in viscosity of an ink or the increase in concentration of an ink coloring material can be suppressed.

Figure 31A:
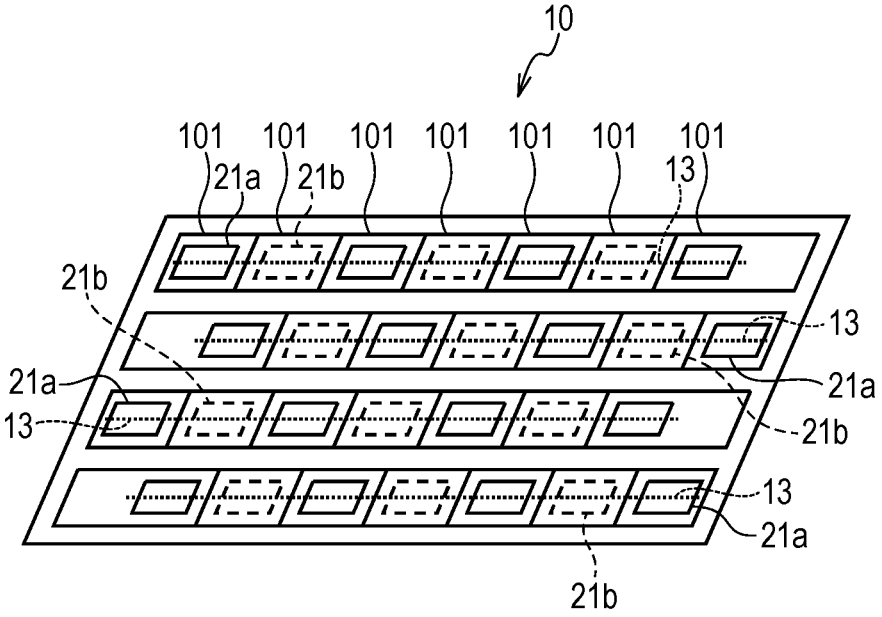
FIGS. 31A and 31B are schematic views showing the positional relationship among openings 21, heaters, and temperature sensors on a recording element substrate in an inkjet recording apparatus pertaining to an embodiment of the present invention.
Figure 31B:
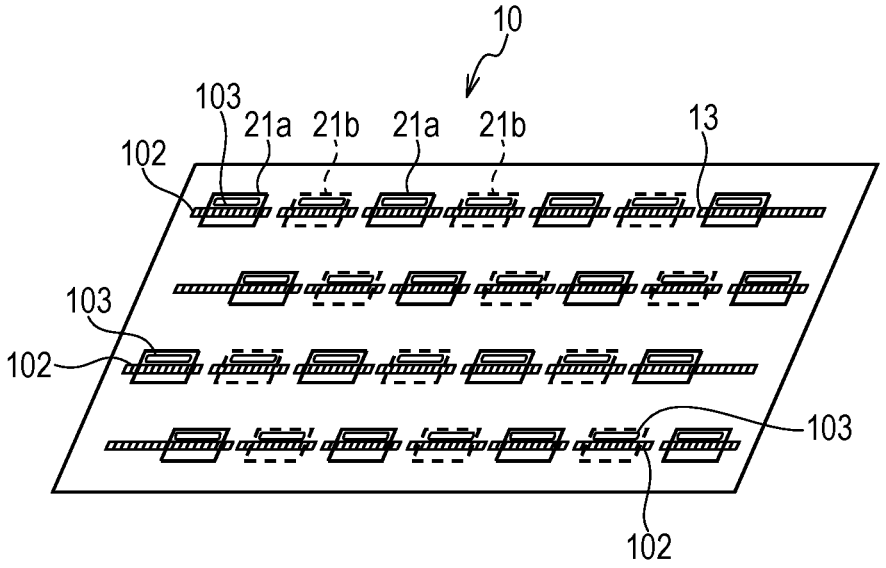

FIGS. 31A and 31B are schematic views showing the positional relationship among openings 21, heaters, and temperature sensors in a recording element substrate in the first embodiment of the present invention. FIG. 31A shows the arrangement of openings 21 along the ejection port arrays in which ejection ports 13 are arranged in a recording element substrate 10. Openings 21 are arranged on a liquid supply path 18 and a liquid collection path 19 extending along the corresponding sides of an ejection port array, but FIGS. 31A and 31B show linearly arranged openings for simple views and explanation. In this point, 21*a* is an opening provided on the liquid supply path 18, and 21*b* is an opening provided on the liquid collection path 19. The size of each opening is schematically shown, unlike those shown in FIGS. 20A to 20C and other figures, and the number of openings is not limited to the above embodiment in which three openings are formed for one liquid supply path 18 and two openings are formed for one liquid collection path 19. FIG. 31B shows the positional relationship of the openings 21*a* and openings 21*b* with respect to temperature control heaters 102 (and heater arrays) and temperature sensors 103 (and temperature sensor arrays) in terms of positions along the ejection port arrays. The number of the openings 21*a*, 21*b* is an example. Two openings 21*a* may be formed for one liquid supply path 18, and one opening 21*b* may be formed for one liquid collection path 19. The numbers of the openings 21*a* and the openings 21*b* may be the same.

In the present embodiment, the neighboring region corresponding to an opening 21*a* or opening 21*b* is regarded as a temperature control adjustment area 101 as shown in FIG. 31A. In each area, a temperature sensor 103 and a temperature control heater 102 are placed as shown in FIG. 31B. Specifically, the temperature control heater 102 and the temperature sensor 103 are placed around a recording element 15 as a heat generation element for ejection in FIG. 20B in such a manner as not to interfere with the respective performances. Specific examples of the temperature sensor include a diode sensor. The shape of the temperature sensor 103 in the figure is elongated in the ejection port array direction but the shape may be a circle or a regular square, for example.

When the temperature sensor 103 in an area 101 detects a temperature not lower than a certain threshold T1 temperature, the temperature control heater 102 in the area is stopped, and when the temperature sensor detects a temperature lower than the threshold T1, the corresponding temperature control heater 102 is driven for heating. In this manner, a target temperature T1 can be maintained. With this structure, an ink having a relatively low temperature flows near the openings 21*a* through which the ink flows into the recording element substrate, and thus the corresponding temperature sensors 103 detect relatively low temperatures. In the resulting temperature control, heating with the corresponding temperature control heaters 102 is performed more frequently or for a longer time. In contrast, an ink near the openings 21*b* through which the ink flows out has a comparatively high temperature, and thus the corresponding temperature sensors 103 detect relatively high temperatures. In the resulting temperature control, heating with the corresponding temperature control heaters 102 is performed less frequently or for a shorter time or the heating is not performed. As a result, ink temperature fluctuations that can be caused along ejection port arrays by ink circulation can be suppressed. In the present embodiment, the number of openings can be the same as the number of temperature control areas, and the member of temperature sensors or temperature control heaters can be reduced. The temperature control of the liquid ejection head can be performed at the preliminary recovery position POS2 or the recovery position POS3 as escape positions displaced from the image forming position shown in FIG. 11.

The present invention is not limited by the above embodiments, and various changes and modifications can be made without departing from the spirit and scope of the invention.

The ink application amount can be expressed by an image density or an ink thickness, for example. In the present embodiment, the mass of each ink dot is multiplied by the number of dots applied, and the result is divided by a printed area to give an average as the ink application amount ($g/m^2$). The maximum ink application amount in an image region means an ink application amount in at least an area of 5 $mm^2$ or more within a region used as information of an ejection target medium (transfer medium) from the viewpoint of removing the liquid component in an ink.

The ink applying device 3104 may include a plurality of inkjet heads in order to apply various color inks onto an ejection target medium. For example, when a yellow ink, a magenta ink, a cyan ink and a black ink are used to form a color image, the ink applying device includes four inkjet heads each ejecting a corresponding ink of the four inks onto an ejection target medium. These inkjet heads are arranged in the X-direction.

The ink applying device may include an inkjet head for ejecting a clear ink that contains no coloring material, or contains a coloring material at an extremely small content, and is substantially transparent. The clear ink can be used to form an ink image together with a reaction liquid and color inks. For example, the clear ink can be used to improve the glossiness of an image. To express a glossy appearance on an image after transfer, appropriate polymer components can be added, and the ejection position of the clear ink can be adjusted. The clear ink is preferably present more closely to the surface layer than the color ink in a final recorded product, and thus the clear ink is applied onto the transfer medium 3101 before the application of color inks in a transfer type recording apparatus. Hence, in the moving direction of the transfer medium facing the ink applying device, the inkjet head for a clear ink can be provided at the upstream side from the inkjet heads for color inks.

Separately from the clear ink for gloss, a clear ink can be used to improve the transferability of an image from the transfer medium 3101 to a recording medium. For example, a large amount of a component exhibiting higher tackiness than that of color inks is added, and a resulting clear ink can be applied onto the color inks and thus can be used as a transferability improving liquid. For example, in the moving direction of the transfer medium facing the recording device 1000, an inkjet head for the clear ink for improving transferability is provided at the downstream side from the inkjet heads for color inks. After application of color inks onto the transfer medium, the clear ink is applied onto the transfer medium with the color inks, and consequently the clear ink is present on the outermost face of an ink image. When the ink image is transferred to a recording medium by the transfer section 3111, the clear ink on the surface of the ink image adheres to the recording medium 3108 at a certain adhesive power, and this facilitates the transfer of the ink image after liquid removal to the recording medium 3108.

<Ink>

Each component of the ink applied to the present embodiment will be described.

(Coloring Material)

As the coloring material contained in the ink applied to the present embodiment, a pigment or a dye can be used. In the ink, the content of the coloring material is preferably 0.5% by mass or more to 15.0% by mass or less and more preferably 1.0% by mass or more to 10.0% by mass or less relative to the total mass of the ink.

The pigment usable as the coloring material is not limited to particular types. Specific examples of the pigment include inorganic pigments such as carbon black and titanium oxide; and organic pigments such as azo pigments, phthalocyanine pigments, quinacridone pigments, isoindolinone pigments, imidazolone pigments, diketopyrrolopyrrole pigments and dioxazine pigments. These pigments can be used singly or in combination of two or more of them as needed. The dispersion manner of the pigment is not limited to particular manners. For example, a polymer-dispersed pigment dispersed with a polymer dispersant or a self-dispersible pigment in which a hydrophilic group such as an anionic group is bonded directly or through an additional atomic group to the particle surface of a pigment can be used. Needless to say, pigments different in dispersion manners can be used in combination.

As the polymer dispersant for dispersing a pigment, a known polymer dispersant used in an aqueous inkjet ink can be used. Specifically, an acrylic, water-soluble polymer dispersant having both a hydrophilic unit and a hydrophobic unit in the molecular chain is preferably used in the embodiment. Examples of the polymer, in terms of structure, include a block copolymer, a random copolymer, a graft copolymer and combinations of them.

The polymer dispersant in the ink may be in a dissolved state in a liquid medium or in a dispersed state as polymer particles in a liquid medium. In the present invention, the water-soluble polymer is a polymer that does not form particles having such a particle diameter as to be determined by dynamic light scattering when the polymer is neutralized with an equivalent amount of an alkali to the acid value thereof.

The hydrophilic unit (unit having a hydrophilic group such as an anionic group) can be formed by polymerizing a monomer having a hydrophilic group, for example. Specific examples of the monomer having a hydrophilic group include acidic monomers having an anionic group, such as (meth)acrylic acid and maleic acid and anionic monomers including anhydrides and salts of these acidic monomers. Examples of the cation included in a salt of an acidic monomer include a lithium ion, a sodium ion, a potassium ion, an ammonium ion and organic ammonium ions.

The hydrophobic unit (unit not having a hydrophilic group such as an anionic group) can be formed by polymerizing a monomer having a hydrophobic group, for example. Specific examples of the monomer having a hydrophobic group include monomers having an aromatic ring, such as styrene, α-methylstyrene and benzyl (meth)acrylate; and monomers having an aliphatic group, such as ethyl (meth)acrylate, methyl (meth)acrylate and butyl (meth)acrylate (i.e., (meth)acrylate monomers).

The polymer dispersant preferably has an acid value of 50 mg KOH/g or more to 550 mg KOH/g or less and more preferably 100 mg KOH/g or more to 250 mg KOH/g or less. The polymer dispersant preferably has a weight average molecular weight of 1,000 or more to 50,000 or less. The mass ratio of the content (% by mass) of the pigment to the content of the polymer dispersant (pigment/polymer dispersant) is preferably 0.3 times or more to 10.0 times or less.

As the self-dispersible pigment, a pigment in which an anionic group such as a carboxylic acid group, a sulfonic acid group and a phosphonic acid group is bonded directly or through an additional atomic group (—R—) to the particle surface of the pigment can be used. The anionic group may be either an acid form or a salt form. An anionic group in a salt form may dissociate partly or completely. Examples of the cation as the counter ion of an anionic group in a salt form include alkali metal cations; ammonium; and organic ammoniums. Specific examples of the additional atomic group (—R—) include linear or branched alkylene groups having 1 to 12 carbon atoms, arylene groups such as a phenylene group and a naphthylene group, an amido group, a sulphonyl group, an amino group, a carbonyl group, an ester group, and an ether group. The additional atomic group may be a combination group of them.

The dye usable as the coloring material is not limited to particular types, but a dye having an anionic group is preferably used. Specific examples of the dye include azo dyes, triphenylmethane dyes, (aza)phthalocyanine dyes, xanthene dyes and anthrapyridone dyes. These dyes can be used singly or in combination of two or more of them as needed.

What is called a self-dispersible pigment that is dispersible due to surface modification of a pigment itself and eliminates the use of the dispersant is also preferably used in the present embodiment.

(Polymer Particles)

The ink applied to the present embodiment can contain polymer particles. The polymer particles do not necessarily contain a coloring material. Polymer particles may have the effect of improving image quality or fixability and thus are preferred.

The material of the polymer particles usable in the present embodiment is not limited to particular materials, and known polymers can be appropriately used. Specific examples include polymer particles made of various materials such as an olefinic polymer, a styrenic polymer, a urethane polymer and an acrylic polymer. The polymer particles preferably have a weight average molecular weight (Mw) of 1,000 or more to 2,000,000 or less. The polymer particles preferably have a volume average particle diameter of 10 nm or more to 1,000 nm or less and more preferably 100 nm or more to 500 nm or less, where the volume-average particle diameter is determined by dynamic light scattering. In the ink, the content (% by mass) of the polymer particles is preferably 1.0% by mass or more to 50.0% by mass or less and more preferably 2.0% by mass or more to 40.0% by mass or less relative to the total mass of the ink.

(Aqueous Medium)

The ink usable in the present embodiment can contain water or an aqueous medium as a mixed solvent of water and a water-soluble organic solvent. As the water, deionized water or ion-exchanged water is preferably used. In an aqueous ink, the content (% by mass) of water is preferably 50.0% by mass or more to 95.0% by mass or less relative to the total mass of the ink. In an aqueous ink, the content (% by mass) of the water-soluble organic solvent is preferably 3.0% by mass or more to 50.0% by mass or less relative to the total mass of the ink. As the water-soluble organic solvent, any solvent usable in inkjet inks, such as alcohols, (poly)alkylene glycols, glycol ethers, nitrogen-containing compounds and sulfur-containing compounds, can be used, and the ink can contain one or more water-soluble organic solvents.

(Additional Additives)

The ink usable in the present embodiment can contain, in addition to the above components, various additives such as an antifoaming agent, a surfactant, a pH adjuster, a viscosity modifier, an anticorrosive, an antiseptic agent, an antifungal agent, an antioxidant, a reduction inhibitor and a water-soluble polymer, as needed.

<Liquid Removing Device>

A liquid removing device 3105 in the embodiment is a liquid absorbing device including a liquid absorbing member 3105*a* and a pressing member for liquid absorption 3105*b* that presses the liquid absorbing member 3105*a* against an ink image on the transfer medium 3101. The liquid absorbing member 3105*a* and the pressing member 3105*b* may have any shape. Such a configuration as shown in FIG. 1 is exemplified. In the configuration, the pressing member 3105*b* has a column shape, the liquid absorbing member 3105*a* has a belt shape, and the column-shaped pressing member 3105*b* presses the belt-shaped liquid absorbing member 3105*a* against the transfer medium 3101. In another exemplified configuration, the pressing member 3105*b* has a column shape, the liquid absorbing member 3105*a* has a hollow column shape formed on the peripheral surface of the column-shaped pressing member 3105*b*, and the column-shaped pressing member 3105*b* presses the hollow column-shaped liquid absorbing member 3105*a* against the transfer medium.

In the present embodiment, the liquid absorbing member 3105*a* preferably has a belt shape in consideration of the space in the inkjet recording apparatus, for example.

The liquid absorbing device 3105 including such a belt-shaped liquid absorbing member 3105*a* may also include stretching members for stretching the liquid absorbing member 3105*a*. In FIG. 1, 3105*c* are stretching rollers as the stretching members. In FIG. 1, the pressing member 3105*b* is also a roller member rotating as with the stretching rollers, but is not limited to this.

In the liquid absorbing device 3105, the pressing member 3105*b* allows the liquid absorbing member 3105*a* including a porous body to come into contact with and to press against an ink image, and thus the liquid absorbing member 3105*a* absorbs a liquid component contained in the ink image to reduce the liquid component.

As the method of removing and reducing the liquid component in an ink image, the above system of bringing a liquid absorbing member into contact with an ink image is not used, but other systems including a heating method, a method of blowing air with low humidity and a decompression method can be used. Such a method can be applied to an ink image after liquid removal by the system of bringing a liquid absorbing member into contact with an ink image, thus further reducing the liquid component.

The liquid absorbing device 3105 may further include a liquid amount adjusting means 3105*d* for optimizing the amounts of a liquid and a treatment liquid absorbed in the liquid absorbing member 3105*a*, a pretreatment means 3105*e* for applying a treatment liquid to the liquid absorbing member and a cleaning member 3105*f* for cleaning the liquid absorbing member. 3105*d* to 3105*f* are optional members, and a structure not including any or all of these members is encompassed.

<Liquid Absorbing Member>

In the present embodiment, at least some of the liquid component is absorbed and removed from an ink image before liquid removal by bringing the liquid absorbing member having a porous body into contact, and thus the content of the liquid component in the ink image is reduced. The contact face of the liquid absorbing member with an ink image is regarded as a first face, and the porous body is placed on the first face. Such a liquid absorbing member including a porous body preferably has such a configuration that the liquid absorbing member moves as the ejection target medium moves, then comes into contact with an ink image, and further rotates at a certain cycle to come into contact with another ink image before liquid removal, enabling liquid absorption. Examples of the shape include an endless-belt shape and a drum shape.

(Porous Body)

The porous body of the liquid absorbing member pertaining to the present embodiment preferably has a smaller average pore diameter on the first face than the average pore diameter on a second face that is opposite to the first face. In order to suppress the adhesion of a coloring material in an ink to the porous body, the pore diameter is preferably small, and at least the porous body on the first face that comes into contact with an image preferably has an average pore diameter of 10 μm or less. In the present embodiment, the average pore diameter means an average diameter on the surface of the first face or the second face, and can be determined by a known technique such as a mercury penetration method, a nitrogen adsorption method and SEM image observation.

In order to evenly achieve high breathability, the porous body preferably has a small thickness. The breathability can be expressed as a Gurley value in accordance with JIS P8117, and the Gurley value is preferably 10 seconds or less.

A thin porous body, however, cannot ensure a capacity sufficient to absorb a liquid component in some cases, and thus the porous body can have a multilayer structure. In the liquid absorbing member, only the layer to come into contact with an ink image is required to be a porous body, and a layer not to come into contact with an ink image is not necessarily a porous body.

In this manner, an ink image from which the liquid component is removed to reduce the liquid component is formed on the transfer medium 3101. The ink image after liquid removal is transferred onto a recording medium 3108 by the subsequent transfer section 3111. The device configuration and conditions for transfer will be described.

<Pressing Member for Transfer>

In the present embodiment, the ink image after liquid removal on the transfer medium 3101 is brought into contact with a recording medium 3108 conveyed by recording medium conveying devices 3107, by a pressing member for transfer 3106 and is thereby transferred onto the recording medium 3108. The liquid component contained in the ink image on the transfer medium 3101 is removed, then the image is transferred onto the recording medium 3108, and consequently a recorded image prevented from causing curling, cockling or the like can be produced.

The pressing member 3106 is required to have a certain structural strength from the viewpoint of the conveyance accuracy of a recording medium 3108 and durability. As the material of the pressing member 3106, metals, ceramics, polymers and the like are preferably used. Specifically, aluminum, iron, stainless steel, acetal polymers, epoxy polymers, polyimide, polyethylene, polyethylene terephthalate, nylon, polyurethane, silica ceramics and alumina ceramics are preferably used in terms of the rigidity capable of withstanding the pressure at the time of transfer, dimensional accuracy, and reduction of the inertia during operation to improve the control responsivity. These materials may be used in combination.

The pressing time of the pressing member 3106 against the transfer medium for transferring an ink image after liquid removal on the transfer medium 3101 to a recording medium 3108 is not limited to particular values, but is preferably 5 ms or more to 100 ms or less in order to achieve satisfactory transfer and not to deteriorate the durability of the transfer medium. The pressing time in the embodiment represents the time during the contact of a recording medium

3108 with a transfer medium 3101 and is the value determined by the following procedure: a surface pressure distribution measuring device ("I-SCAN" manufactured by Nitta) is used to perform surface pressure measurement; and the length of a pressed region in the conveying direction is divided by the conveying speed to give the pressing time.

The pressure of the pressing member 3106 against the transfer medium 3101 for transferring an ink image after liquid removal on the transfer medium 3101 to a recording medium 3108 is also not limited to particular values, but is so controlled as to achieve satisfactory transfer and not to deteriorate the durability of the transfer medium. Hence, the pressure is preferably 9.8 $N/cm^2$ (1 $kg/cm^2$) or more to 294.2 $N/cm^2$ (30 $kg/cm^2$) or less. The pressure in the embodiment represents the nip pressure between a recording medium 3108 and a transfer medium 3101, and is a value determined by the following procedure: a surface pressure distribution measuring device is used to perform surface pressure measurement; and the load in a pressed region is divided by the area to give the pressure.

The temperature when the pressing member 3106 presses against the transfer medium 3101 for transferring an ink image after liquid removal on the transfer medium 3101 to a recording medium 3108 is also not limited to particular values, but is preferably not lower than the glass transition point or not lower than the softening point of a polymer component contained in an ink. A preferred embodiment for heating includes a heating means for heating an ink image after liquid removal (a second image) on the transfer medium 3101 and a recording medium 3108. In a preferred embodiment, a transfer medium heating device 3112 is used for heating.

The shape of the pressing member 3106 is not limited to particular shapes, and is exemplified by a roller shape.

<Recording Medium and Recording Medium Conveying Device>

In the present embodiment, the recording medium 3108 is not limited to particular media, and any known recording medium can be used. Examples of the recording medium include long media rolled into a roll and sheet media cut into a certain size. Examples of the material include paper, plastic films, wooden boards, cardboard and metal films.

In FIG. 1, the recording medium conveying device 3107 for conveying a recording medium 3108 includes a recording medium delivery roller 3107*a* and a recording medium winding roller 3107*b*, but may include any members capable of conveying a recording medium, and is not specifically limited to the structure.

<Control System>

Figure 3:
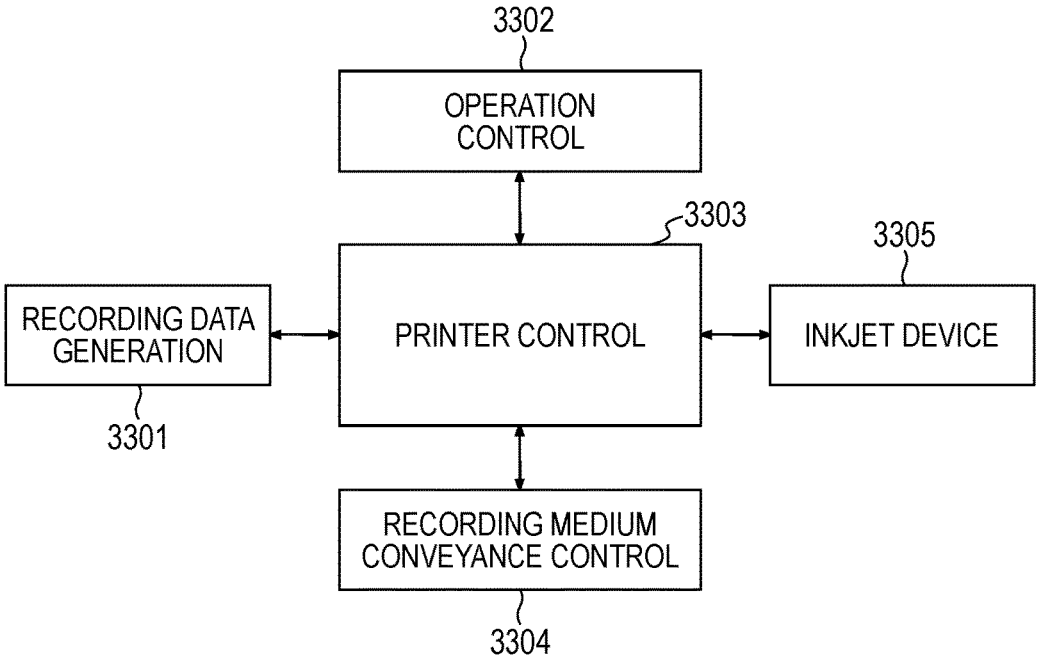
FIG. 3 is a block diagram showing a whole control system of the transfer type inkjet recording apparatus shown in FIG. 1.

The transfer type inkjet recording apparatus in the present embodiment includes a control system for controlling each device. FIG. 3 is a block diagram of the control system for the whole transfer type inkjet recording apparatus shown in FIG. 1.

In FIG. 3, 3301 is a recording data generation section such as an external print server, 3302 is an operation control section such as an operation panel, 3303 is a printer control section for executing a recording process, 3304 is a recording medium conveyance control section for conveying a recording medium, and 3305 is an inkjet device for printing.

Figure 4:
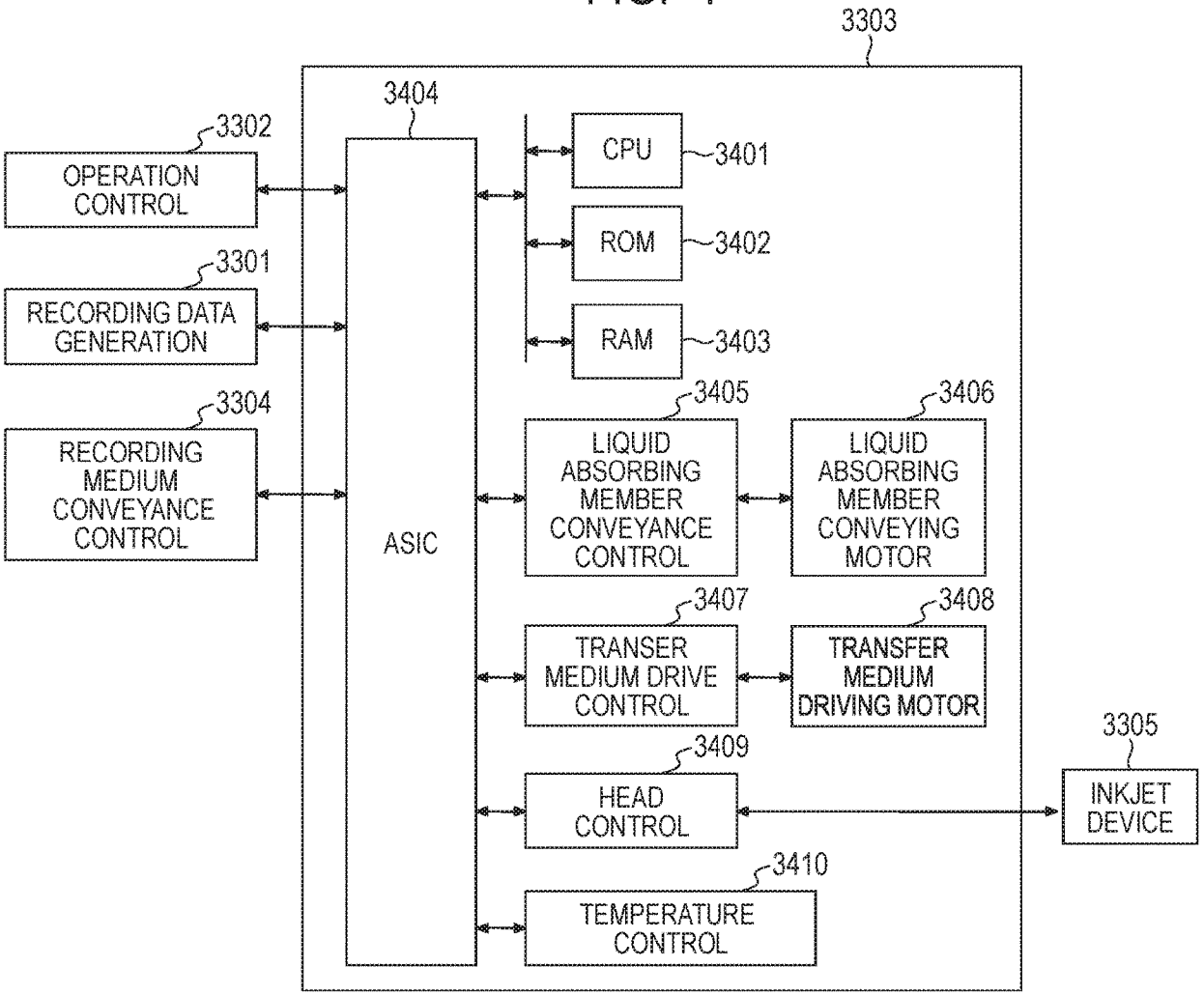
FIG. 4 is a block diagram of the printer control section of the transfer type inkjet recording apparatus shown in FIG. 1.

FIG. 4 is a block diagram of the printer control section in the transfer type inkjet recording apparatus in FIG. 1.

3401 is a CPU for controlling the whole printer, 3402 is a ROM for storing a control program of the CPU, and 3403 is a RAM for executing a program. 3404 is an application specific integrated circuit (ASIC) including a network controller, a serial IF controller, a controller for generating head data, a motor controller and the like. 3405 is a liquid absorbing member conveyance control section for driving a liquid absorbing member conveying motor 3406 and is controlled by a command from the ASIC via a serial IF. 3407 is a transfer medium drive control section for driving a transfer medium driving motor 3408 and is also controlled by a command from the ASIC via a serial IF. 3409 is a head control section and performs final discharge data generation for the inkjet device 3305 and drive voltage generation, for example. 3410 is a temperature control section and corresponds to the control unit 3115 shown in FIG. 1.

(Direct Drawing Type Inkjet Recording Apparatus)

As another embodiment of the present invention, a direct drawing type inkjet recording apparatus is exemplified. In the direct drawing type inkjet recording apparatus, the ejection target medium is a recording medium on which an image is to be formed.

Figure 32:
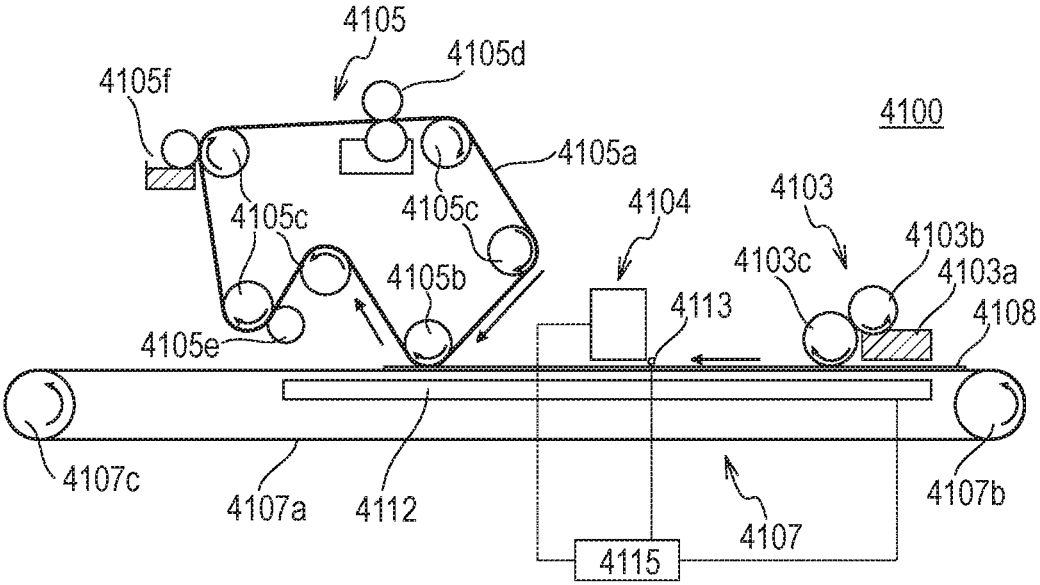
FIG. 32 is a schematic view showing an exemplary structure of a direct drawing type inkjet recording apparatus pertaining to an embodiment of the present invention.

FIG. 32 is a schematic view showing an exemplary schematic structure of a direct drawing type inkjet recording apparatus 4100 in the embodiment. As compared with the above transfer type inkjet recording apparatus, the direct drawing type inkjet recording apparatus includes the same means as the transfer type inkjet recording apparatus except that the transfer medium 3101, the support member 3102, the transfer medium cleaning member 3109 and the like are excluded, and an image is formed on a recording medium 4108.

Hence, a reaction liquid applying device 4103 for applying a reaction liquid onto a recording medium 4108, an ink applying device 4104 for applying an ink onto the recording medium 4108 and a liquid absorbing device 4105 including a liquid absorbing member 4105*a* that comes into contact with an ink image on the recording medium 4108 to absorb a liquid component contained in the ink image have the same structures as those in the transfer type inkjet recording apparatus, and are not described.

In the direct drawing type inkjet recording apparatus of the embodiment, the liquid absorbing device 4105 includes a liquid absorbing member 4105*a* and a pressing member for liquid absorption 4105*b* that presses the liquid absorbing member 4105*a* against an ink image on the recording medium 4108. The liquid absorbing member 4105*a* and the pressing member 4105*b* may have any shape, and members having substantially the same shapes as those of the liquid absorbing member and the pressing member usable in the transfer type inkjet recording apparatus can be used. The liquid absorbing device 4105 may further include stretching members for stretching the liquid absorbing member. In FIG. 32, 4105*c* are stretching rollers as the stretching members. The number of stretching rollers is not limited to 5 as shown in FIG. 32, and an intended number of rollers can be arranged depending on the design of an apparatus. As with the transfer type inkjet recording apparatus, a liquid adjusting means 4105*d*, a pretreatment means 4105*e* and a cleaning member 4105*f* may be included.

<Recording Medium Conveying Device>

In the direct drawing type inkjet recording apparatus 4100 of the embodiment, a recording medium conveying device 4107 is not limited to particular devices, and a conveying means in a known direct drawing type inkjet recording apparatus can be used. As shown in FIG. 32, an exemplary recording medium conveying device includes a belt-shaped support member 4107*a* as a means for supporting a recording medium and stretching rollers 4107*b*, 4107*c* for stretching the support member 4107*a*. The support member 4107*a* faces an ejection head of the ink applying device 4104 in at least the image forming position and is not limited to the member shown in the figures.

<Heating Device>

In the direct drawing type inkjet recording apparatus 4100 of the embodiment, a heating device 4112 is a mechanism of heating an ink image on a recording medium 4108 through the support member 4107*a*. The heating device 4112 may be a known heating device such as various lamps including an infrared lamp and a warm air fan. In terms of heating efficiency, an infrared heater can be used.

The temperature detecting device for a recording medium 4108 and the support member 4107*a* may be any device, and a noncontact detecting device using, for example, luminance, color or infrared intensity or a contact detecting device using, for example, thermoelectromotive force, electric resistance or magnetism can be used.

The location of the temperature detecting device for the transfer medium is not limited to particular sites, and the temperature can be detected from an ink applying side of the recording medium 4108 or from the back face of the support member 4107*a*. FIG. 32 shows a temperature detecting device 4113 for detecting the temperature under the ejection head. In the present invention, the temperature T2 of the recording medium 4108 and the support member 4107*a* is detected by the temperature detecting device 4113, for example.

<Temperature Control Section>

4115 is a control unit for controlling the working (heating adjustment) of a heater of an ejection head included in the ink applying device 4104 and the heating device 4112 in response to temperature information from the temperature detecting device 4113 and a means for detecting the temperature of the ejection head in the ink applying device 4104 (not shown). The control unit 4115 can also control the working (transfer, drive) of the reaction liquid applying device, the ink applying device, the liquid absorbing device and the recording medium conveying device.

Figure 33:
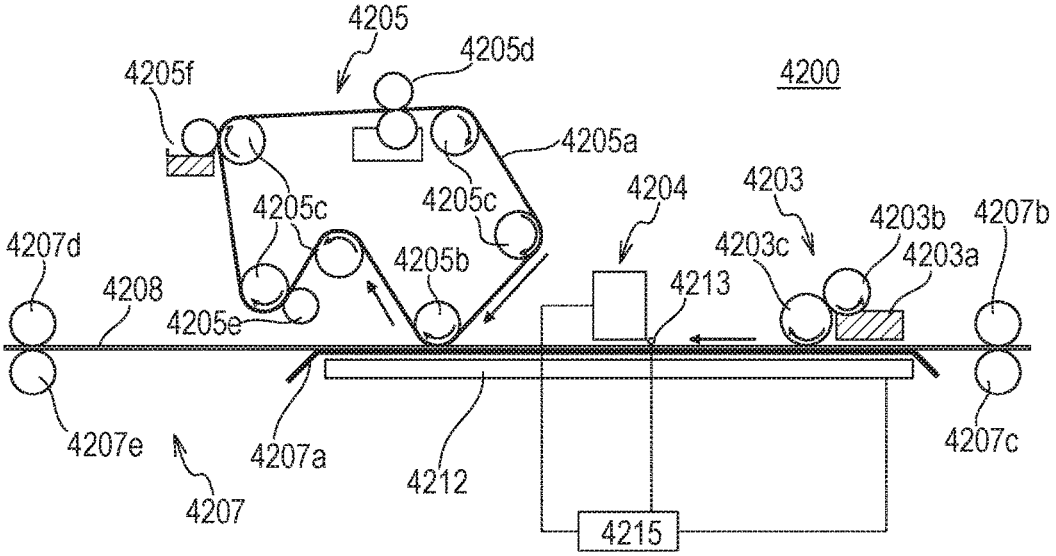
FIG. 33 is a schematic view showing an exemplary structure of a direct drawing type inkjet recording apparatus in an embodiment of the present invention.

FIG. 33 shows a direct drawing type inkjet recording apparatus 4200 in another embodiment. The difference from the recording apparatus 4100 is that a recording medium conveying device 4207 includes a platen or the like as a support member 4207*a* for supporting a recording medium and recording medium conveying rollers 4207*b*, 4207*c*, 4207*d*, 4207*e*.

<Control System>

The direct drawing type inkjet recording apparatus in the embodiment has a control system for controlling each device. A block diagram of the control system for the whole direct drawing type inkjet recording apparatuses 4100, 4200 shown in FIGS. 32 and 33 is the same as in the transfer type inkjet recording apparatus shown in FIG. 1, and is as shown in FIG. 3.

Figure 34:
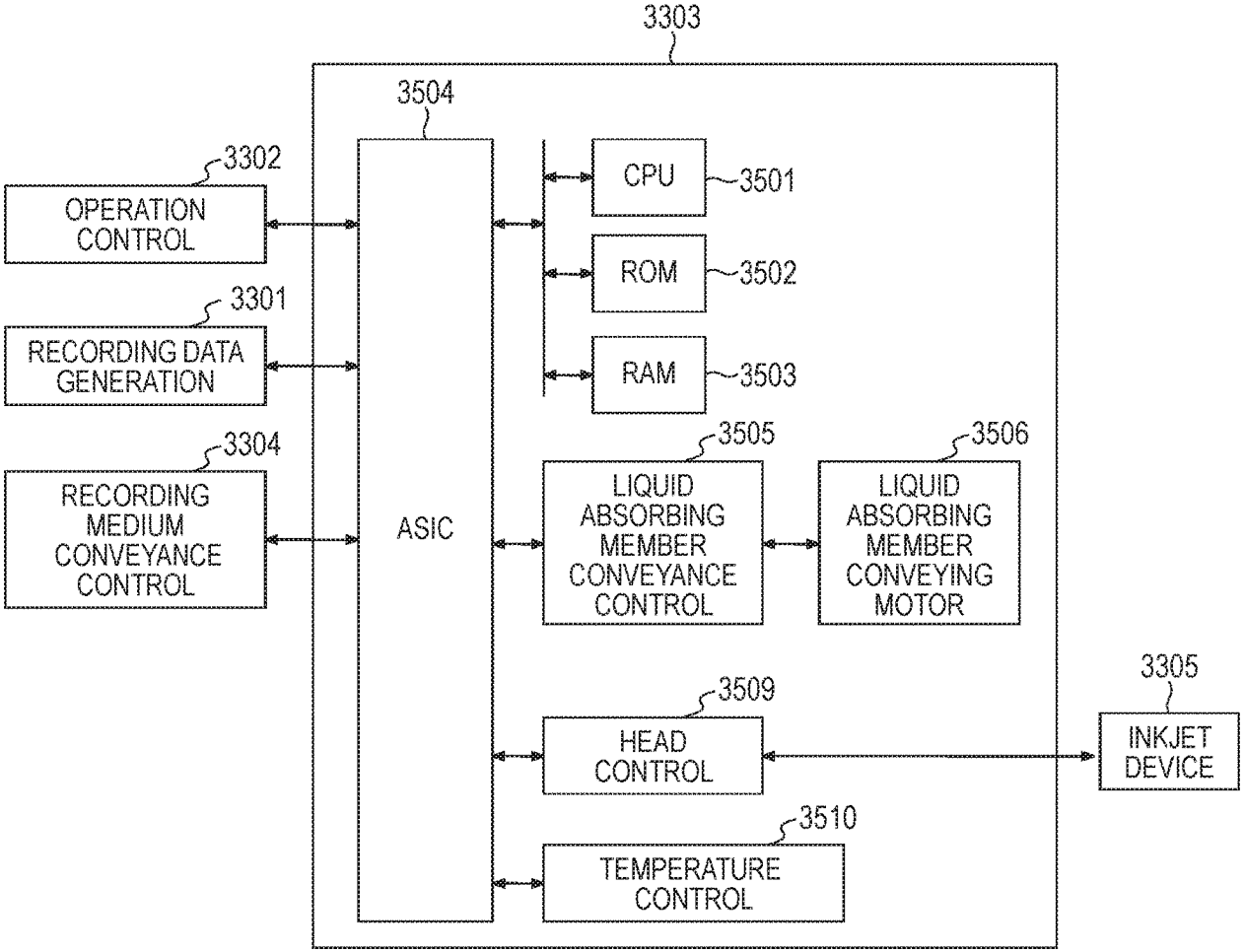
FIG. 34 is a block diagram of a printer control section in a direct drawing type inkjet recording apparatus.

FIG. 34 is a block diagram of the printer control section in the direct drawing type inkjet recording apparatuses 4100, 4200. The block diagram is the same as that of the printer control section in the transfer type inkjet recording apparatus in FIG. 4 except that the transfer medium drive control section 3407 and the transfer medium driving motor 3408 are excluded.

<Inkjet Recording Method>

FIGS. 2A to 2F show conditions of the transfer type inkjet recording apparatus shown in FIG. 1 at the time of apparatus startup, and devices around the transfer medium 3101 each have a movable means from the transfer medium 3101 to a predetermined escape position. The pressing member for transfer 3106 and the recording medium conveying devices 3107 are configured as a block to be movable integrally, but are not limited thereto. At the time of apparatus startup, no recording medium 3108 is placed yet. The pressing member for transfer 3106 and the recording medium conveying devices 3107 are collectively called a "transferring conveying unit".

Figure 2A:
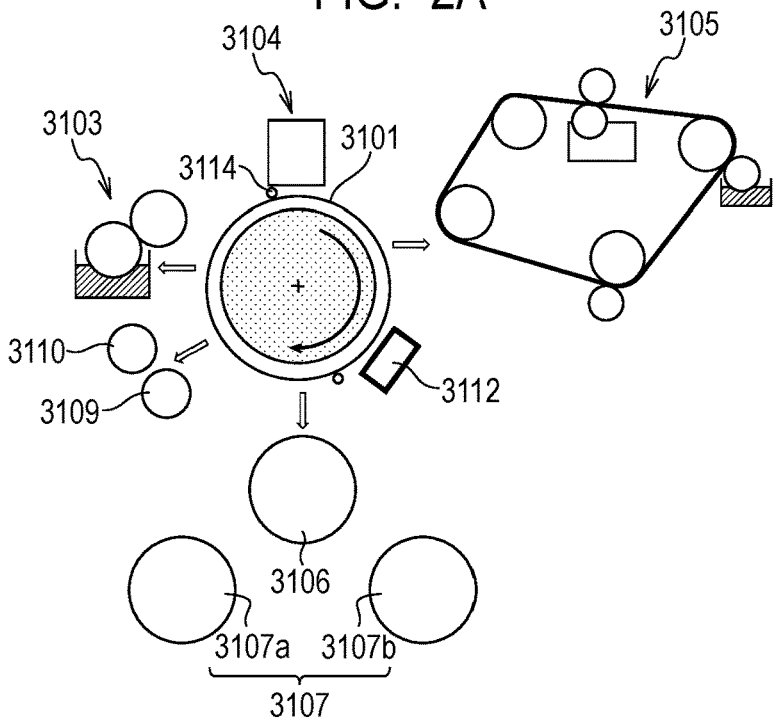
FIGS. 2A, 2B, 2C, 2D, 2E and 2F are schematic views showing various movement examples of a transfer type inkjet recording apparatus in an embodiment of the present invention.
Figure 2B:
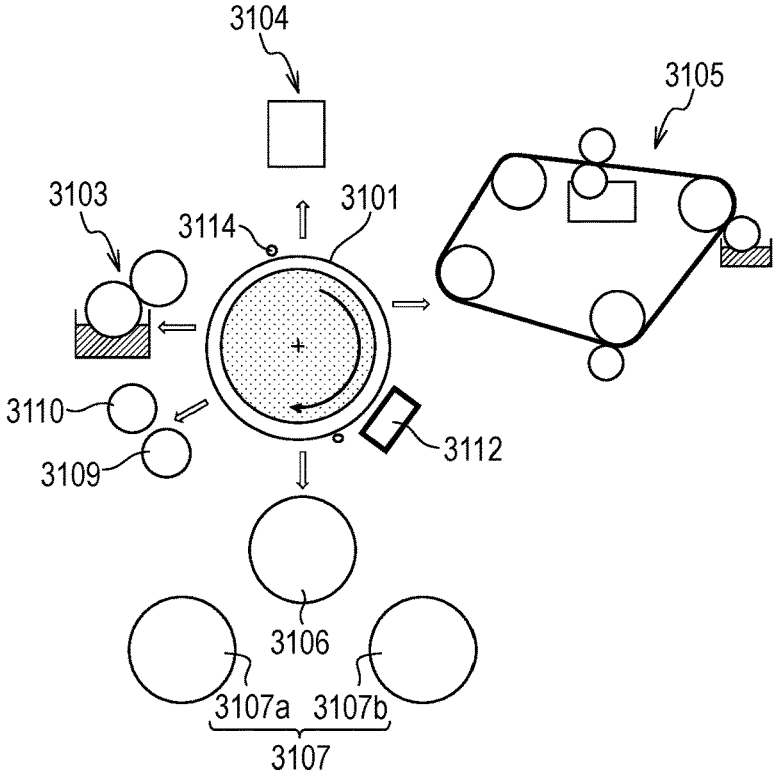
Figure 2C:
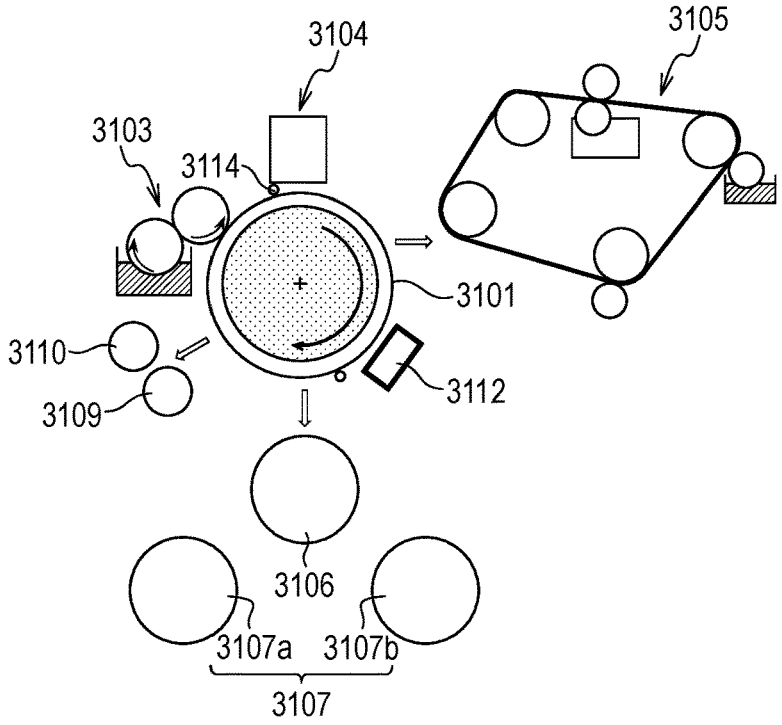
Figure 2D:
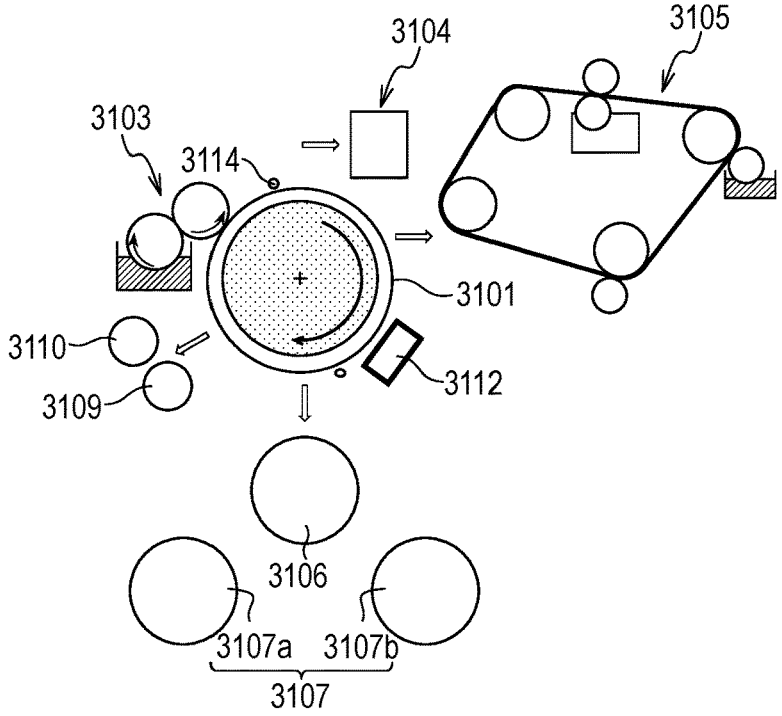
Figure 2E:
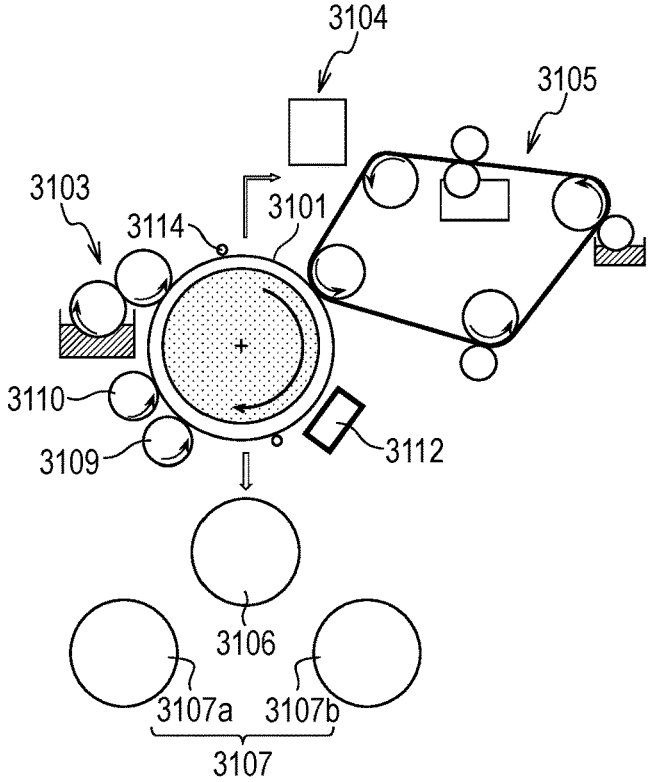
Figure 2F:
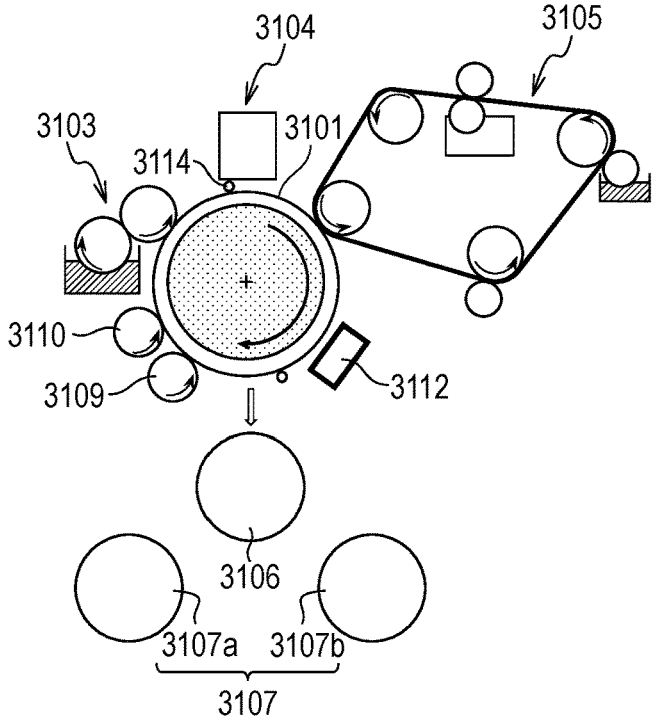

FIG. 2A shows a condition in which the transfer medium is heated while the ejection head (indicated as the ink applying device 3104, the same applies hereinafter) is maintained at the image forming position and the other devices are displaced. FIG. 2B is the same as FIG. 2A except that the ejection head is displaced to an escape position and the transfer medium is heated. FIG. 2C is the same as FIG. 2A except that the reaction liquid applying device 3103 is in contact with the transfer medium 3101 and the transfer medium is heated. FIG. 2D is the same as FIG. 2C except that the ejection head is displaced to an escape position and the transfer medium is heated. The escape direction of the ejection head is the X-direction. FIG. 2E shows a manner in which the transfer medium is heated while devices other than the ejection head and the transferring conveying unit are at home positions. FIG. 2F shows a manner in which the transfer medium is heated while devices other than the transferring conveying unit are at home positions.

Figure 2G:
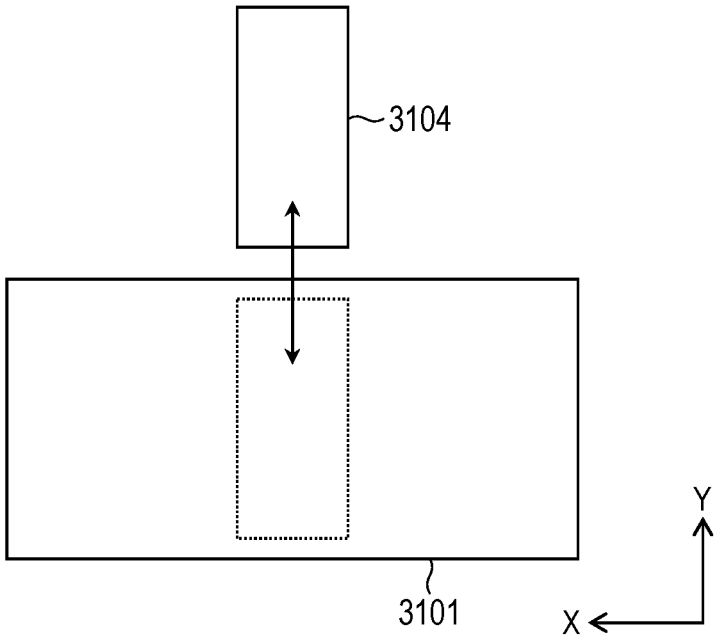
FIG. 2G is a schematic view showing an exemplary movement of an ejection head of a transfer type inkjet recording apparatus in an embodiment of the present invention.

FIG. 2G is a schematic view showing an escape movement of the ink applying device 3104 on the X-Y plane in FIG. 1 viewed from the ink applying device 3104 side. Details will be described in examples. The ink applying device 3104 can escape in the Y-direction, which is preferred because the ejection ports of the ink applying device 3104 can be located at the position not facing the transfer medium 3101.

Figure 5:
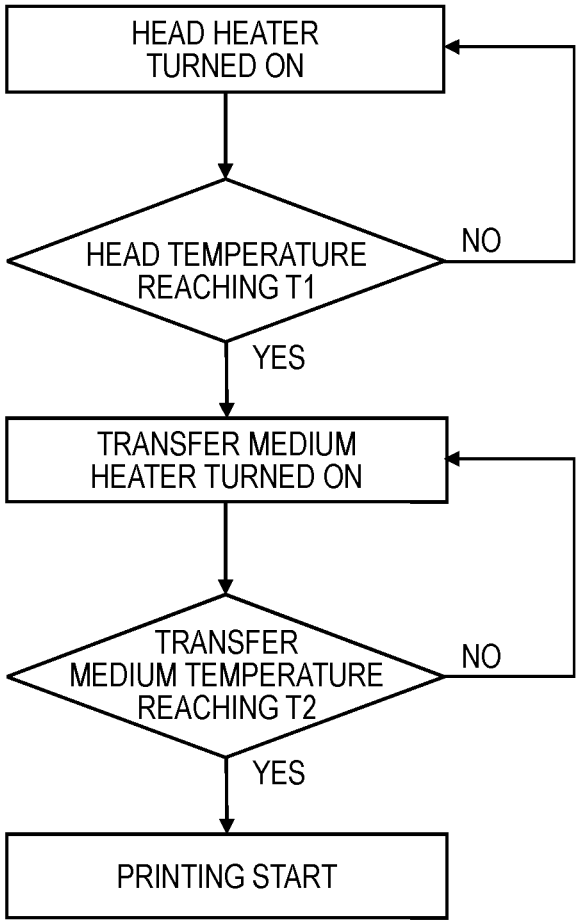
FIG. 5 is a flowchart for a transfer type inkjet recording apparatus in an embodiment of the present invention, from startup to printing.
Figure 7:
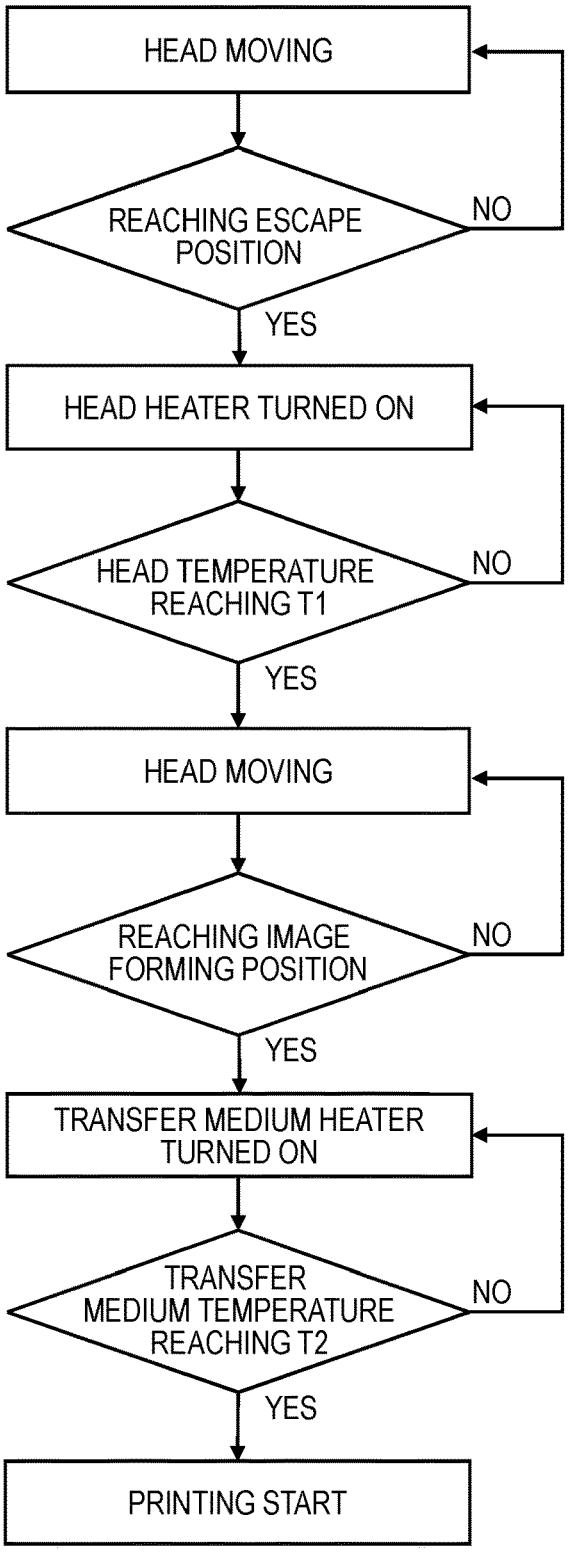
FIG. 7 is a flowchart for a transfer type inkjet recording apparatus in an embodiment of the present invention, from startup to printing.

FIG. 5 and FIG. 7 show preferred flows for suppressing condensation on the ink ejection head at the time of apparatus startup before the start of image formation. Details will be described in examples.

Figure 6:
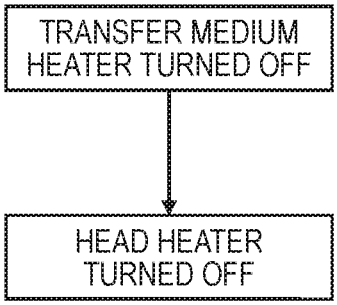
FIG. 6 is a flowchart for a transfer type inkjet recording apparatus in an embodiment of the present invention, from printing completion to end.
Figure 8:
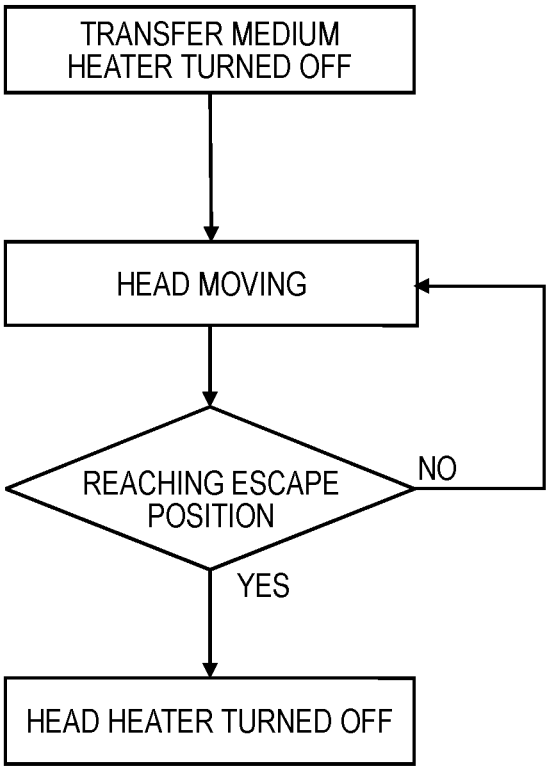
FIG. 8 is a flowchart for a transfer type inkjet recording apparatus in an embodiment of the present invention, from printing completion to end.

FIG. 6 and FIG. 8 show flow after the completion of image formation before the stop of the apparatus. To suppress the condensation on the ink ejection head in the present invention, it is preferred that the temperature control of the transfer medium be stopped and then the temperature control of the ejection head be stopped as shown in FIG. 6 and FIG. 8. As shown in FIG. 8, it is particularly preferred that the ejection head be displaced from the image forming position and then the temperature control of the ejection head be stopped.

Figure 9A:
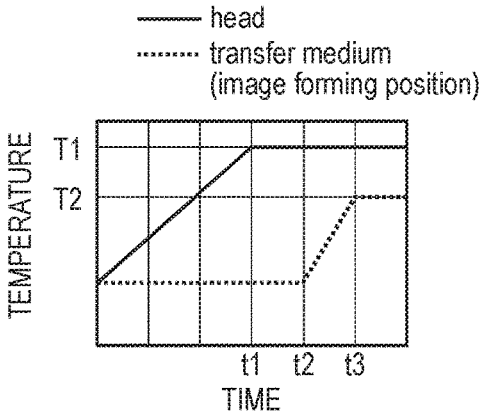
FIGS. 9A, 9B, 9C, 9D and 9E are graphs showing various temperature history profiles of a head and a transfer medium of a transfer type inkjet recording apparatus in an embodiment of the present invention.
Figure 9B:
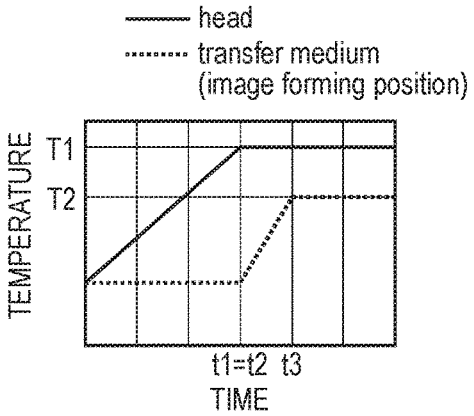
Figure 9C:
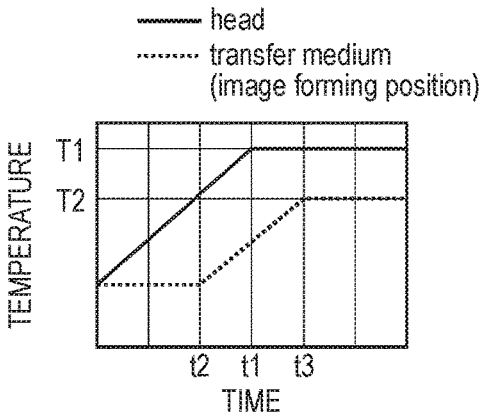
Figure 9D:
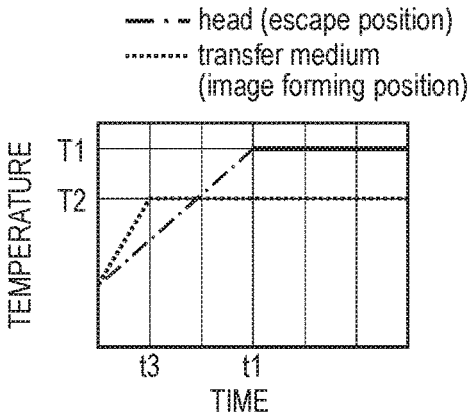
Figure 9E:
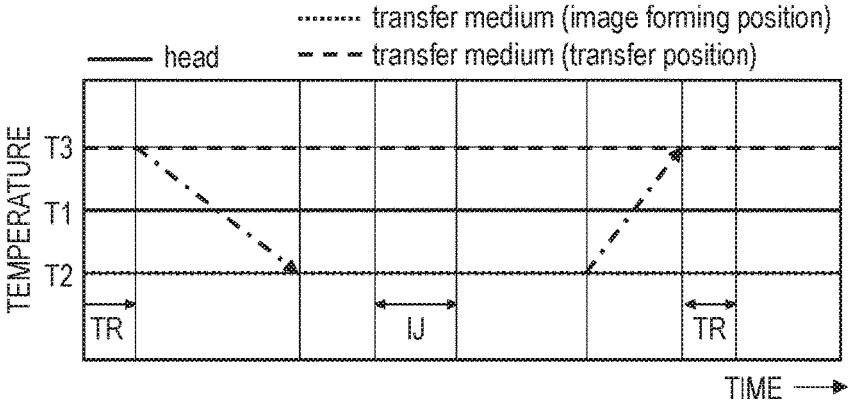

FIGS. 9A to 9E are graphs showing relationships of the head temperature and the transfer medium temperature, FIGS. 9A to 9D are graphs at the time of apparatus startup, and FIG. 9E is a graph at the time of continuous printing. The head temperature and the transfer medium temperature at the time of apparatus startup are room temperature, and as apparent from the figures, "heating" in the present specification means heating from room temperature. In FIGS. 9A to 9D, time t1 on the horizontal axis is the time when the head temperature reaches T1, t2 is the time when the heating of the transfer medium is started, and t3 is the time when the temperature of the transfer medium reaches T2. In FIG. 9E, temperatures T1, T2 on the vertical axis are the same as in FIGS. 9A to 9D. T3 represents the temperature of the transfer medium at the time of transfer and is not lower than the glass transition point or not lower than the softening point of a polymer component contained in an ink. In the figures, T3 is higher than T1, but may be equal to T1 or lower than T1 as long as transfer can be performed. T3 can be 100° C. or higher, for example. In FIG. 9E, the dot-dash arrows indicate temperature rise/drop at the same position on the transfer medium. In FIGS. 9A to 9E, the ejection head temperature and the transfer medium temperature are constant (stable) after reaching T1 to T3, but slightly fluctuate practically. A temperature rise or drop is indicated by a straight line, but may be curved. To stabilize the transfer medium temperature, reaction liquid application, liquid removal, transfer medium cleaning, or cooling is preferably performed because such a treatment may reduce the temperature fluctuation range to stabilize the temperature for a short time.

The temperature T1 of the ejection head is a temperature at which liquid components in an ink do not boil, and when an aqueous ink is used, the temperature T1 is lower than 100° C. and preferably 90° C. or lower. Meanwhile, the temperature T2 of the transfer medium strongly depends on the temperature T3 of the transfer medium at the time of transfer and varies with treatments after transfer. When T2 is excessively low, much energy is required for heating to T3. When a reaction liquid is applied, T2 is preferably not lower than the cloud point of a surfactant in the reaction liquid. The cloud point of a surfactant can be determined by heating a 1% by mass aqueous surfactant solution. For example, T2 can be 50° C. or higher. The difference between T1 and T2 is not limited to particular values as long as a vaporizing liquid on the transfer medium does not cause condensation on the ejection surface of the ejection head, and the difference is preferably 5° C. or more, more preferably 10° C. or more, and most preferably 20° C. or more. T2 at the time of apparatus startup may be the same as or different from T2 at the time of continuous printing.

As described above, the transfer type inkjet recording apparatus pertaining to the present embodiment and the inkjet recording method using the recording apparatus are characterized in that, at the time of apparatus startup, the temperature of the ejection head at an image forming position is adjusted by heating to a temperature higher than the temperature of the transfer medium at the image forming position. To achieve this, the following techniques are included.

(1) The temperature of the ejection head is adjusted by heating to the temperature T1, and then the temperature of the transfer medium at the image forming position is adjusted by heating to the temperature T2.

(2) The apparatus further includes a means of moving the ejection head between the image forming position and an escape position displaced from the image forming position, and is so controlled that temperature heating of the ejection head is started at the escape position, then the temperature of the ejection head is adjusted by heating to the temperature T1, and the ejection head is moved to the image forming position.

Figure 35A:
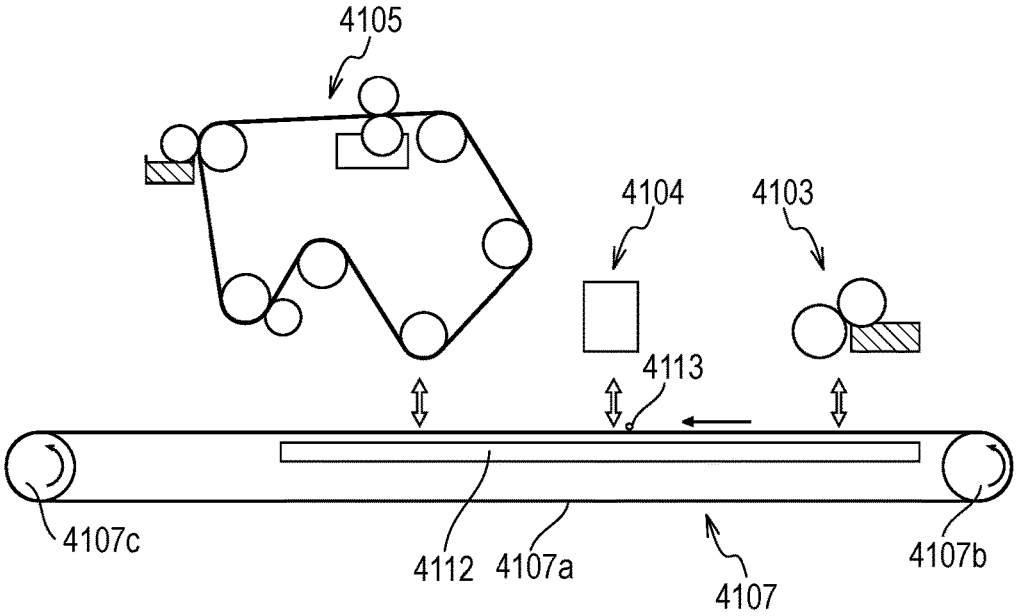
FIGS. 35A and 35B are schematic views describing the startup movement of the inkjet recording apparatus in FIG. 32.
Figure 35B:
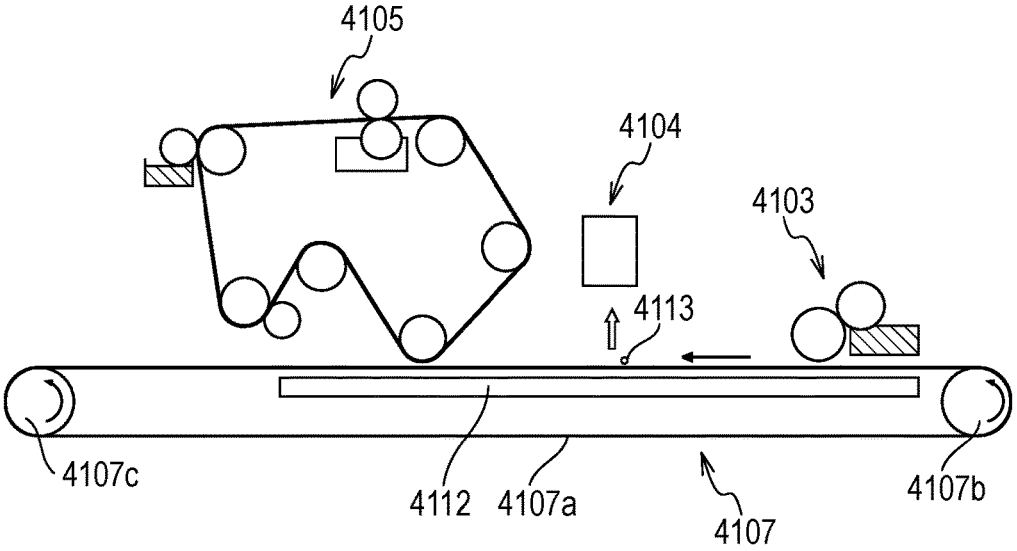

FIGS. 35A and 35B are schematic views showing the startup movement of the direct drawing type inkjet recording apparatus 4100 shown in FIG. 32. In FIG. 35A, the recording medium conveying device 4107 is separated from devices arranged thereabove, and in FIG. 35B, the ink applying device 4104 including the head is displaced to an escape position. As with the transfer type apparatus, the ink applying device can move in the direction penetrating the figure to escape to a position at which ejection ports does not face the support member 4107*a*. Also in the direct drawing type inkjet recording apparatus, by controlling the ejection head temperature of the ink applying device and the temperature of the support member 4107*a* at the time of startup in the same manner as in the transfer type inkjet recording apparatus, condensation at the time of apparatus startup can be suppressed. After the temperature is stabilized, a recording medium is conveyed, and an image is formed. Consequently, the recording medium temperature (T2) at the image forming position is set to a temperature lower than the head temperature (T1), and thus condensation during image formation is also suppressed. As compared with the transfer type apparatus, the direct drawing type inkjet recording apparatus includes a recording medium heating means of adjusting the temperature of the recording medium by heating, at the image forming position by the ejection head, to T2 through the support member. At the time of apparatus startup, the temperature of the ejection head at the image forming position is adjusted by heating to a temperature higher than the temperature of the support member at the image forming position.

EXAMPLES

The present invention will next be described in further detail with reference to examples and comparative examples. The present invention is not intended to be limited to the following examples without departing from the scope of the invention. In the following description in examples, "part" is based on mass unless otherwise noted.

Example 1

In the example, the transfer type inkjet recording apparatus shown in FIG. 1 was used.

The transfer medium 3101 in the example is fixed to the support member 3102 with an adhesive. In the example, a PET sheet having a thickness of 0.5 mm was coated with a silicone rubber (KE12 manufactured by Shin-Etsu Chemical) into a thickness of 0.3 mm, and the resulting sheet was used as the elastic layer of the transfer medium. Glycidoxypropyltriethoxysilane and methyltriethoxysilane were mixed at a molar ratio of 1:1, and the mixture was heated and refluxed. The resulting condensate was mixed with a photocationic polymerization initiator (SP150 manufactured by ADEKA) to give a mixture. The surface of the elastic layer was subjected to atmospheric pressure plasma treatment to have a contact angle with water of 10° or less. The above mixture was applied onto the elastic layer and subjected to UV irradiation (with a high-pressure mercury lamp, an integrated exposure amount of 5,000 mJ/cm$^2$) and to thermal curing (150° C., 2 hours) to form a film, yielding a transfer medium 3101 including the elastic body on which a surface layer having a thickness of 0.5 μm was formed.

In the structure, a double-sided adhesive tape, not shown in the drawings for simple explanation, was used between the transfer medium 3101 and the support member 3102 for holding the transfer medium 3101.

The reaction liquid to be applied by the reaction liquid applying device 3103 had the following formulation, and the application amount was 1 g/m$^2$.

Levulinic acid: 40.0 parts
Glycerol: 5.0 parts
Surfactant: 1.0 part (product name: Megaface F444, manufactured by DIC)
Ion-exchanged water: 54.0 parts The ink to be applied by the ink applying device 3104 was prepared by the following procedure.

<Preparation of Polymer Particles>

In a four-necked flask with a stirrer, a reflux condenser and a nitrogen inlet tube, 18.0 parts of butyl methacrylate, 2.0 parts of polymerization initiator (2,2'-azobis(2-methylbutyronitrile)) and 2.0 parts of n-hexadecane were placed, then nitrogen gas was introduced into the reaction system, and the mixture was stirred for 0.5 hours. Into the flask, 78.0 parts of 6.0% aqueous solution of an emulsifier (product name: NIKKOL BC15, manufactured by Nikko Chemicals) was added dropwise, and the whole was stirred for 0.5 hours. Next, the mixture was sonicated with a sonicator for 3 hours to be emulsified. Subsequently, the mixture was polymerized under a nitrogen atmosphere at 80° C. for 4 hours. The reaction system was cooled to 25° C., then the component was filtered, and an appropriate amount of pure water was added, giving an aqueous dispersion liquid of polymer particles 1 having a polymer particle 1 content (solid content) of 20.0%.

<Preparation of Aqueous Polymer Solution>

A styrene-ethyl acrylate-acrylic acid copolymer (polymer 1) having an acid value of 150 mg KOH/g and a weight average molecular weight of 8,000 was prepared. Next, 20.0 parts of the polymer 1 was neutralized with potassium hydroxide in an equivalent molar amount to the acid value, and an appropriate amount of pure water was added, giving an aqueous solution of polymer 1 having a polymer content (solid content) of 20.0%.

<Preparation of Pigment Dispersion Liquid>

First, 10.0 parts of a pigment (carbon black), 15.0 part of an aqueous solution of polymer 1 and 75.0 parts of pure water were mixed. The mixture and 200 parts of 0.3-mm zirconia beads were placed in a batch type vertical sand mill (manufactured by Aimex) and dispersed for 5 hours while cooled with water. Next, the mixture was centrifuged to remove coarse particles and was subjected to pressure filtration through a cellulose acetate filter with a pore size of 3.0 μm (manufactured by Advantec), giving a pigment dispersion liquid K having a pigment content of 10.0% and a polymer dispersant (polymer 1) content of 3.0%.

(Preparation of Ink)

The components shown below were mixed and thoroughly stirred, and the resulting mixture was subjected to pressure filtration through a cellulose acetate filter with a pore size of 3.0 μm (manufactured by Advantec), giving an ink. Acetylenol E100 is a surfactant manufactured by Kawaken Fine Chemicals.

Pigment dispersion liquid 20.0% by mass
Aqueous dispersion liquid of polymer particles 1 50.0% by mass
Aqueous solution of polymer 1 5.0% by mass
Glycerol 5.0% by mass
Diethylene glycol 7.0% by mass
Surfactant (product name: Acetylenol E100, manufactured by Kawaken Fine Chemicals) 0.5% by mass
Ion-exchanged water 12.5% by mass As the ink applying unit, an inkjet head including an electrothermal transducer for ejecting an ink on demand was used, and the ink application amount was 20 g/m$^2$. The liquid absorbing member 3105*a* is so adjusted by the stretching rollers 3105*c* as to have substantially the same speed as the moving speed of the transfer medium 3101. The recording medium 3108 is conveyed by the recording medium delivery roller 3107*a* and the recording medium winding roller 3107*b* so as to have substantially the same speed as the moving speed of the transfer medium 3101. In the example, the conveyance speed was 0.2 m/s, and Aurora Coat paper (manufactured by Nippon Paper Industries, a basis weight of 104 g/m$^2$) was used as the recording medium 3108.

The flow at the time of apparatus startup before the start of image formation in Example 1 will be described with reference to FIG. 5. First, temperature heating of the ejection head was started at the image forming position as shown in FIG. 2A. After the temperature T1 of the ejection head reached 80° C., the temperature of the transfer medium under the head was detected by a temperature detector 3114, and the transfer medium was heated until T2 reached 60° C. As the temperature detector 3114, a radiation thermometer was used. The ejection head was heated by the temperature control heaters 102 shown in FIG. 31B, and the temperature T1 was the average of temperatures detected by temperature sensors 103 twice or more within a predetermined time period. The transfer medium was heated by using the following device as the transfer medium heating device 3112.

In the transfer medium heating device 3112, a plurality of radiation heating sources each including a halogen lamp and a reflecting mirror as a pair are arranged in the rotation direction of the transfer medium 3101. The halogen lamps and the reflecting mirrors used were manufactured by Fintech Tokyo. The halogen lamp had a maximum output of $10\times10^3$ W/m, and the reflecting mirror was a parabolic mirror made of aluminum and having a mirror polished surface.

At the time of printing, the moving speed of the transfer medium was 0.4 m/s, and the output of the halogen lamp was so adjusted as to give a transfer medium temperature of 120° C. that was detected by the temperature detector 3113.

After the flow shown in FIG. 5, the condensation on the ejection head and the time from the start of transfer medium heating to the temperature stabilization of the transfer medium were evaluated on the basis of the criteria described later. The temperature control of the ejection head and the transfer medium under the ejection head was performed in accordance with the temperature profile shown in FIG. 9A. The temperature control of the transfer medium under the ejection head may be activated upon the ejection head reaches T1 in accordance with the temperature profile as shown in FIG. 9B. The temperature of the ejection head from the start of temperature control to T1 may be constantly higher than the temperature of the transfer medium under the ejection head as shown in FIG. 9C.

In the step sequence shown in Table 1, the condensation on the ejection head and the temperature change from the start of transfer medium heating to the temperature stabilization of the transfer medium were evaluated as described later.

Example 2

Example 2 is the same as in Example 1 except that the ejection head was heated at the escape position. The step sequence is shown in Table 1.

The flow in Example 2 at the time of apparatus startup before the start of image formation will be described with reference to FIG. 11. First, temperature heating of the ejection head was started while the ejection head was at an escape position displaced from the image forming position as shown in FIG. 2B. The escape position of the ejection head may be any position at which the ejection head moves relative to the transfer medium. The ejection head may move up relative to the transfer medium as shown in FIG. 2B or may move in the axis direction of the transfer medium (Y-direction) as shown in FIG. 2G or FIG. 11.

After the temperature T1 of the ejection head reached 80° C., the ejection head was controlled to move to the image forming position as shown in FIG. 2A. After the movement of the ejection head to the image forming position, the temperature T2 of the transfer medium under the head was controlled to rise to 60° C. Except the above, the same procedure as in Example 1 was performed, and the condensation on the ejection head and the temperature change from the start of transfer medium heating to the temperature stabilization of the transfer medium were evaluated.

When the temperature control of the ejection head is performed while the ejection head is displaced from the image forming position as in Example 2, the temperature of the ejection head from the start of temperature control to T1 may be lower than the temperature of the transfer medium under the ejection head as shown in FIG. 9D. Alternatively, after the temperature of the ejection head exceeds T2, the ejection head may be moved to the image forming position.

Example 3

The same procedure as in Example 1 was performed except that the temperature T2 was 75° C., and the condensation on the ejection head and the temperature change from the start of transfer medium heating to the temperature stabilization of the transfer medium were evaluated.

Example 4

The same procedure as in Example 1 was performed except that transfer medium heating was started and then a reaction liquid was applied with the reaction liquid applying device 3103 (FIG. 2C), and the condensation on the ejection head and the temperature change from the start of transfer medium heating to the temperature stabilization of the transfer medium were evaluated.

Example 5

The same procedure as in Example 4 was performed except that a reaction liquid was applied with the reaction liquid applying device 3103 (FIG. 2C) before the start of transfer medium heating, and the condensation on the ejection head and the temperature change from the start of transfer medium heating to the temperature stabilization of the transfer medium were evaluated.

Example 6

The same procedure as in Example 1 was performed except that the transfer medium cooling device 3110, the transfer medium cleaning member 3109, the reaction liquid applying device 3103 and the liquid removing device 3105 were in contact with the transfer medium 3101 and each unit was activated (FIG. 2F) before the start of transfer medium heating, and the condensation on the ejection head and the temperature change from the start of transfer medium heating to the temperature stabilization of the transfer medium were evaluated.

Example 7

Figure 36:
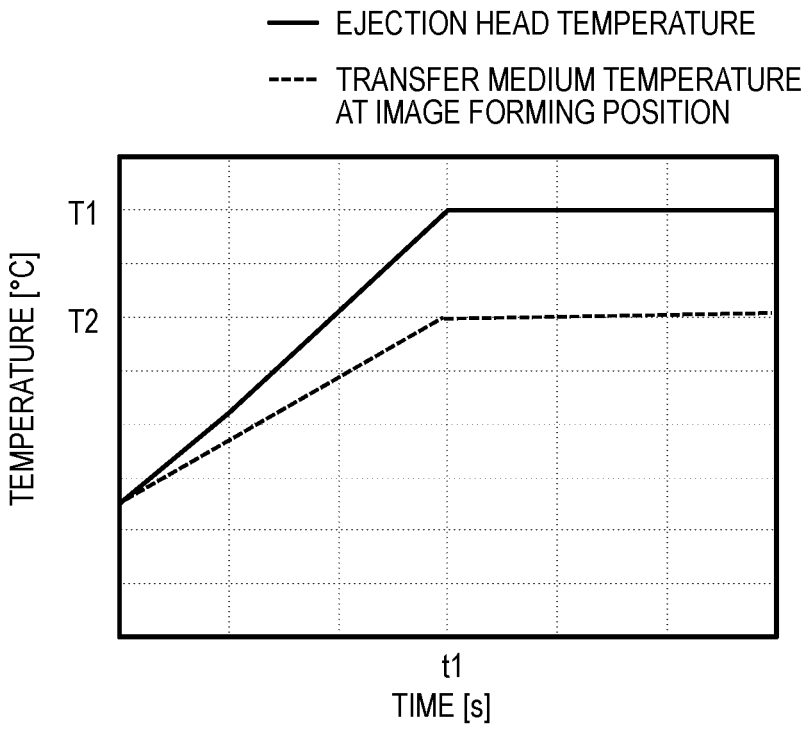
FIG. 36 is a graph showing an exemplary temperature history profile of an ejection head and a transfer medium at an image forming position in an inkjet recording apparatus in an embodiment of the present invention.

The same procedure as in Example 1 was performed except that the transfer medium heating and the head heating were simultaneously performed while the ejection head was placed at the image forming position (FIG. 2A), and the condensation on the ejection head and the temperature change from the start of transfer medium heating to the temperature stabilization of the transfer medium were evaluated. Heating was so performed that the transfer medium temperature was lower than the head temperature as shown in FIG. 36.

Comparative Example 1

The same procedure as in Example 1 was performed (FIG. 2A) while the ejection head was not displaced from the image forming position under a condition T1<T2, and the condensation on the ejection head and the temperature change from the start of transfer medium heating to the temperature stabilization of the transfer medium were evaluated.

Comparative Example 2

The same procedure as in Example 2 was performed (FIG. 2B) under a condition T1<T2, and the condensation on the ejection head and the temperature change from the start of transfer medium heating to the temperature stabilization of the transfer medium were evaluated.

Comparative Example 3

The same procedure as in Example 1 was performed (FIG. 2A) while the ejection head was not displaced from the image forming position but after the start of transfer medium heating, head heating was started, and the condensation on the ejection head and the temperature change from the start of transfer medium heating to the temperature stabilization of the transfer medium were evaluated.

Comparative Example 4

Figure 37:
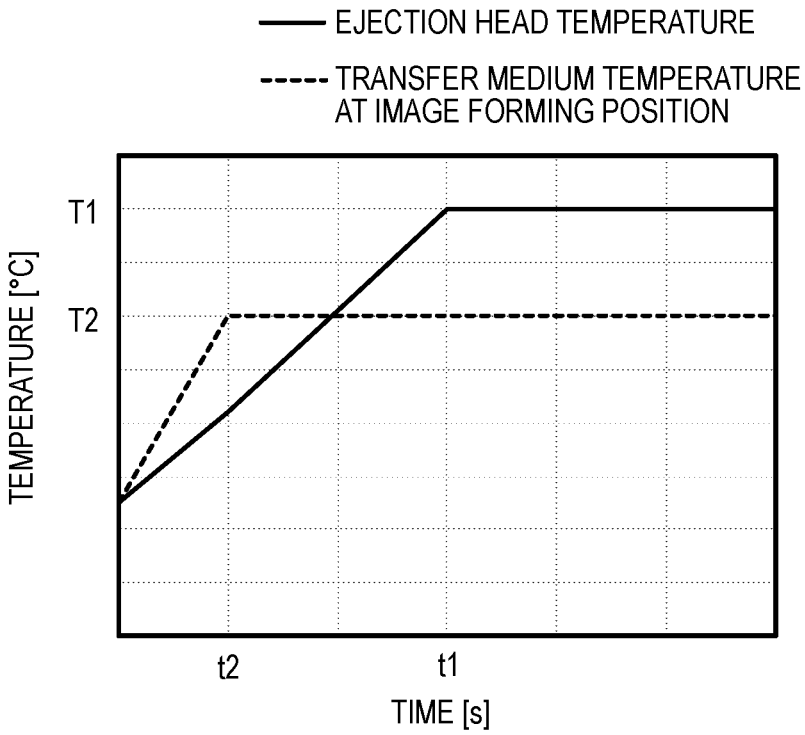
FIG. 37 is a graph showing another exemplary temperature history profile of an ejection head and a transfer medium at an image forming position in an inkjet recording apparatus in an embodiment of the present invention.

The same procedure as in Example 1 was performed (FIG. 2A) except that the transfer medium heating and the head heating were simultaneously performed while the ejection head was placed at the image forming position, and the condensation on the ejection head and the temperature change from the start of transfer medium heating to the temperature stabilization of the transfer medium were evaluated. As for the temperature at the time of heating, the transfer medium temperature temporarily exceeded the head temperature around the ejection port face as shown in FIG. 37.

[Evaluation]

In the examples and comparative examples, the condensation on the ejection head and the transfer medium was evaluated.

The temperature change after the start of transfer medium heating before the transfer medium temperature reached T2 and was stabilized was evaluated.

(Condensation)

A: No condensation was observed.

B: Condensation was partly observed on an ejection head.

C: Condensation was observed on an ejection head. Some ejection ports of an ejection head leaked an ink, and the ink adhered onto a transfer medium. This is supposed to be because a dew condensation on the ejection head came into contact with an ink in an ejection port.

(Temperature Change Before Temperature Stabilization)

The temperature change by transfer medium temperature heating after the temperature of a transfer medium under an ejection head once reached T2 before stabilization of temperature T2 was A: within ±5° C. or less, B: more than ±5° C. and not more than ±10° C., or C: more than ±10° C.

The obtained evaluation results are shown in Table 1.

TABLE 1

| | Temperature | | Step sequence | | | | | | | Evaluation | |
|---|---|---|---|---|---|---|---|---|---|---|---|
| | Ejection head temperature: T1 | Temperature of transfer medium under ejection head: T2 | Head movement: Escape position | Head movement: Image forming position | Head heating | Transfer medium cleaning | Reaction liquid application | Liquid removal | Transfer medium heating | Condensation | Temperature change from start of transfer medium heating to temperature stabilization |
| Example 1 | 80° C. | 60° C. | — | 1 | 2 | — | — | — | 3 | A | A |
| Example 2 | 80° C. | 60° C. | 1 | 3 | 2 | — | — | — | 4 | A | A |
| Example 3 | 80° C. | 75° C. | 1 | 3 | 2 | — | — | — | 4 | A | A |
| Example 4 | 80° C. | 60° C. | 1 | 3 | 2 | — | 5 | — | 4 | A | B |
| Example 5 | 80° C. | 60° C. | 1 | 3 | 2 | — | 4 | — | 5 | A | A |
| Example 6 | 80° C. | 60° C. | 1 | 3 | 2 | 4 | 5 | 6 | 7 | A | A |
| Example 7 | 80° C. | 60° C. | — | 1 | 2 | — | — | — | 2 | | A |
| Comparative Example 1 | 70° C. | 80° C. | — | 1 | 3 | — | 4 | — | 2 | C | C |
| Comparative Example 2 | 70° C. | 80° C. | 1 | 3 | 2 | — | — | — | 4 | C | B |
| Comparative Example 3 | 80° C. | 60° C. | — | 1 | 3 | — | — | — | 2 | C | B |
| Comparative Example 4 (simultaneous start of heating) | 80° C. | 60° C. | — | 1 | 2 | — | — | — | 2 | B | B |

Effect of the Invention

The inkjet recording apparatus and the inkjet recording method according to the present invention can suppress the condensation on an ink ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131278, filed Jul. 4, 2017, which is hereby incorporated by reference herein in its entirety.

What is claimed is:

1. An inkjet recording apparatus comprising:

an ejection head configured to eject an ink to form an image;

a transfer medium configured to temporarily hold the image formed by the ejection head;

a head heater configured to heat the ejection head to a target temperature T1;

a transfer medium heater configured to heat the transfer medium;

a transfer unit configured to transfer the image, temporarily held on the transfer medium, onto a recording medium; and a control unit configured to perform such adjustment as to satisfy a a relationship of T1>T2, where T1 is the target temperature of the ejection head and T2 is a heated temperature of the transfer medium at an image forming position by the ejection head, wherein the ejection head is movable between the image forming position and an escape position displaced from the image forming position, and wherein the control unit is configured to perform such control as to start heating of the ejection head at the escape position and, after heating adjustment of the temperature of the ejection head to the target temperature T1, to move the ejection head to the image forming position.

2. The inkjet recording apparatus according to claim 1, further comprising a cleaning unit including a cleaning member that is brought into contact with the transfer medium to clean the transfer medium, wherein, before a start of heating adjustment of the transfer medium, the control unit is configured to control the cleaning member to come into contact with the transfer medium.

3. The inkjet recording apparatus according to claim 1, further comprising a reaction liquid applying unit configured to apply, to the transfer medium, a reaction liquid that causes aggregation of the ink, wherein, before a start of heating adjustment of the transfer medium, the control unit is configured to control the reaction liquid applying unit to start application of the reaction liquid.

4. The inkjet recording apparatus according to claim 1, further comprising a liquid removing unit including a liquid removing member that is brought into contact with the transfer medium to remove a liquid from an image formed on the transfer medium, wherein, before a start of heating adjustment of the transfer medium, the control unit is configured to control the liquid removing member to come into contact with the transfer medium.

5. The inkjet recording apparatus according to claim 1, further comprising a transfer medium cooling unit including a cooling member that is brought into contact with the transfer medium to cool the transfer medium, wherein the control unit is configured to control contact of the transfer medium cooling unit in such a way that the heated temperature T2 of the transfer medium is lower than the target temperature T1 of the ejection head.

6. The inkjet recording apparatus according to claim 1, wherein the ejection head includes a plurality of recording element substrates, each recording element substrate including an element configured to generate energy used to eject an ink, a pressure chamber having the element provided therein, and an ejection port configured to eject an ink, and an ink in the pressure chamber is circulated between the pressure chamber and outside of the pressure chamber.

7. The inkjet recording apparatus according to claim 1, wherein the control unit is configured to control the transfer medium heater to stop heating of the transfer medium and then to control the head heater to stop heating of the ejection head.

8. An inkjet recording apparatus comprising:

an ejection head configured to eject an ink to form an image;

a transfer medium configured to temporarily hold the image formed by the ejection head;

a head heater configured to heat the ejection head to a target temperature T1;

a transfer medium heater configured to heat the transfer medium;

a transfer unit configured to transfer the image, temporarily held on the transfer medium, onto a recording medium; and a control unit configured to perform such adjustment as to satisfy a relationship of T1>T2, where T1 is the target temperature of the ejection head and T2 is a heated temperature of the transfer medium at an image forming position by the ejection head, wherein, after heating adjustment of the ejection head to the target temperature T1, the control unit starts heating adjustment of the transfer medium at the image forming position.

9. An inkjet recording apparatus comprising:

an ejection head configured to eject an ink to form an image;

a transfer medium configured to temporarily hold the image formed by the ejection head;

a head heater configured to heat the ejection head to a target temperature T1;

a transfer medium heater configured to heat the transfer medium;

a transfer unit configured to transfer the image, temporarily held on the transfer medium, onto a recording medium; and a control unit configured to perform such adjustment as to satisfy a relationship of T1>T2, where T1 is the target temperature of the ejection head and T2 is a heated temperature of the transfer medium at an image forming position by the ejection head, wherein the control unit allows the head heater to heat the ejection head at the image forming position and the transfer medium heater to heat the transfer medium, and controls the head heater and the transfer medium heater in such a way that a temperature of the transfer medium is lower than a temperature of the ejection head before the ejection head reaches the target temperature T1.

10. An inkjet recording apparatus comprising:

an ejection head configured to eject an ink to form an image;

a support unit facing the ejection head at an image forming position and configured to support a recording medium on which an image is formed;

a head heater configured to heat the ejection head to a target temperature T1;

a support unit heater configured to heat the support unit; and a control unit configured to perform such adjustment as to satisfy a relationship of T1>T2, where T1 is the target temperature of the ejection head and T2 is a heated temperature of the recording medium on the support unit at the image forming position by the ejection head, wherein the control unit is configured to perform such adjustment that, at startup of the apparatus, a temperature of the ejection head at the image forming position is maintained to be higher than a temperature of the support unit at the image forming position.

11. An inkjet recording method using an inkjet recording apparatus including an ejection head configured to eject an ink to form an image, a transfer medium configured to temporarily hold the image formed by the ejection head, a head heater configured to heat the ejection head, a transfer medium heater configured to heat the transfer medium, and a transfer unit configured to transfer the image, temporarily held on the transfer medium, onto a recording medium, the method comprising:

a head heating step of adjusting the ejection head by heating to a target temperature T1; and a transfer medium heating step of adjusting the transfer medium by heating, at an image forming position by the ejection head, to a heated temperature T2, wherein the temperature T1 and the temperature T2 satisfy a relationship of T1>T2, wherein, in the head heating step, the heating of the ejection head is started at an escape position displaced from the image forming position and, after heating adjustment of the ejection head to the target temperature T1, the ejection head moves to the image forming position, and wherein, in the transfer medium heating step, before or after movement of the ejection head to the image forming position, a temperature of the transfer medium at the image forming position is adjusted by heating to the temperature T2.

12. The inkjet recording method according to claim 11, further comprising a cleaning step of bringing a cleaning member into contact with the transfer medium to clean the transfer medium, wherein, at the time of setup of the apparatus, the cleaning step is performed before or after start of heating of the transfer medium.

13. The inkjet recording method according to claim 11, further comprising a reaction liquid applying step of applying, to the transfer medium, a reaction liquid that causes aggregation of the ink, wherein the reaction liquid applying step starts before start of heating of the transfer medium.

14. The inkjet recording method according to claim 11, further comprising a liquid removing step of bringing a liquid removing member into contact with the transfer medium to remove a liquid from an image formed on the transfer medium, wherein, before start of heating of the transfer medium, the liquid removing member is brought into contact with the transfer medium.

15. The inkjet recording method according to claim 11, further comprising a transfer medium cooling step of bringing a cooling member into contact with the transfer medium to cool the transfer medium, wherein, before start of heating of the transfer medium, the cooling member is brought into contact with the transfer medium.

16. The inkjet recording method according to claim 11, wherein heating of the transfer medium is stopped, and then heating of the ejection head is stopped.

17. The inkjet recording method according to claim 11, wherein the ejection head includes a plurality of recording element substrates, each recording element substrate including an element configured to generate energy used to eject an ink, a pressure chamber having the element provided therein, and an ejection port configured to eject an ink, and, during the head heating step, an ink in the pressure chamber is circulated between the pressure chamber and outside of the pressure chamber.

* * * * *